US005360700A

United States Patent [19]

Kawamura et al.

[11] Patent Number: 5,360,700

[45] Date of Patent: Nov. 1, 1994

[54] PROCESS FOR TREATING SILVER HALIDE PHOTOGRAPHIC LIGHT-SENSITIVE MATERIAL

[75] Inventors: Tomonori Kawamura, Hachioji; Shigeharu Koboshi, Hino, both of Japan

[73] Assignee: Konica Corporation, Tokyo, Japan

[21] Appl. No.: 131,927

[22] Filed: Oct. 5, 1993

Related U.S. Application Data

[63] Continuation of Ser. No. 958,599, Oct. 7, 1992, abandoned, which is a continuation of Ser. No. 782,712, Oct. 25, 1991, abandoned, which is a continuation of Ser. No. 707,277, May 28, 1991, abandoned, which is a continuation of Ser. No. 460,805, Jan. 4, 1990, abandoned.

[30] Foreign Application Priority Data

Jan. 13, 1989 [JP] Japan ..... 1-6664

[51] Int. Cl.[5] ..... G03C 5/39

[52] U.S. Cl. ..... 430/428; 430/372; 430/386; 430/393; 430/400; 430/430; 430/558

[58] Field of Search ..... 430/372, 430, 558, 555, 430/400, 393, 386, 384, 428

[56] References Cited

U.S. PATENT DOCUMENTS

| | | | |
|---|---|---|---|
| 3,879,202 | 4/1975 | Tamaguchi | 430/372 |
| 4,301,236 | 11/1981 | Idota et al. | 430/430 |
| 4,778,743 | 10/1988 | Ishikawa | 430/428 |
| 4,786,583 | 11/1988 | Schwartz | 430/372 |
| 4,820,623 | 4/1989 | Koshimizu et al. | 430/428 |
| 4,855,217 | 8/1989 | Kurematsu et al. | |
| 4,927,746 | 5/1990 | Schwartz | 430/490 |

OTHER PUBLICATIONS

Vol. XXXI, Helv. Chem. Acta, 1948, "Experimental Part", pp. 1045-1046 (1-2).

*Primary Examiner*—Thorl Chea

*Attorney, Agent, or Firm*—Finnegan, Henderson, Farabow, Garrett & Dunner

[57] ABSTRACT

A process for developing and its after-treatment of an exposed silver halide photographic material which is capable of replacing a step of rinsing by water washing and a step of final stabilization by formaldehyde, with a single stabilizing step without water rinsing followed by directly to a drying step is disclosed.

The process comprises a solution capable of bleaching containing a ferric complex salt of organic acid, diethylenetriaminepentaacetic acid and a like, and a stabilizing solution containing a certain aldehyde compound.

8 Claims, No Drawings

PROCESS FOR TREATING SILVER HALIDE PHOTOGRAPHIC LIGHT-SENSITIVE MATERIAL

This application is a continuation of application Ser. No. 07/958,599, filed Oct. 7, 1992, now abandoned, which is a continuation of Ser. No. 07/782,712 filed Oct. 25, 1991, abandoned, which is a continuation of application Ser. No. 07/707,277, filed May 28, 1991, abandoned, which is a continuation of application Ser. No. 07/460,805, filed Jan. 4, 1990, abandoned.

FIELD OF THE INVENTION

The present invention relates to a processing method for silver halide color photographic photosensitive materials, more specifically to a processing method for silver halide color photographic photosensitive materials which permits improvement in image storage property and processing liquid preservability even when the stabilizing solution being used instead of water washing and the stabilizing is used.

BACKGROUND OF THE INVENTION

In general, a silver halide color photographic photosensitive material, after image exposure, is subjected to color development, bleaching, fixation or bleach-fixation with a processing solution capable of fixation, and then stabilization, washing and other processes. In this washing process following the process with a processing solution capable of fixation, it is known that thiosulfate, which reacts with silver halide to form water-soluble complex salt, other water-soluble silver complex salts, and sulfite, metabisulfite and other substances added as preservatives are contained in, or adhere to, the photosensitive material and are transferred into the process solution, and thus adversely affect the image storage property in cases where the amount of washing water is small. To overcome this drawback, a large amount of water is used to wash out the preceding salts from the photographic material in washing after processing with a processing solution capable of fixing. In recent years, however, due to limited water resource availability, economic aspects such as rises in sewage fee and light and fuel expenses, and aspects concerning environmental pollution prevention, it has been desired to develop a process which permits reduction of the amount of washing water and which ensures prevention of environmental pollution.

Traditionally, some methods have been designed such as those in which the washing tank is configured with a number of stages where counterflow is produced, described in West German Patent No.2,920,222 and "Water Flow Rate in Immersion Washing of Motion Picture Film", SMPTE. Vol.64, pp.248–253, May (1955), edited by S. R. Goldwasser.

Also known is the method in which a preliminary washing bath is provided in the immediate rear of a fixing bath to reduce the amount of environmental contaminants entering the washing process as contained in, or adhered to, the photosensitive material and to reduce the amount of washing water.

However, none of these processing methods uses no washing water. Therefore, this drawback poses an increasingly serious problem under the recent conditions in which water resource availability has become limited and washing cost has increased due to crude oil price rise.

On the other hand, there is another processing method in which stabilization is conducted immediately after photographic processing without washing. For example, silver stabilization using thiocyanate is known, which is described in, for example, U.S. Pat. No.3,335,004. This method, however, is faulty in that post-drying staining occurs on the surface of photosensitive material because a large amount of inorganic salt is contained in the stabilization bath. Also, these stabilization processes have another fault in that dye image deterioration occurs during long-term storage.

On the other hand, when processing a color photographic photosensitive material for picture-taking containing silver bromo-iodide as the silver halide, a stabilizing bath containing formalin is generally employed in the final process following the washing process. Formalin contained in such bath prevents changes in the physical properties of a photosensitive material, especially deterioration of image gradation which tends to occur with the lapse of time or is induced by a scar on the surface of a photosensitive material. In addition, by the use of the formalin-containing stabilizing bath, dye image deterioration by an unreacted coupler can be effectively prevented. At present, after treatment with a processing solution capable of fixing, a color photosensitive material for picture-taking is generally subjected to other processes, i.e., stabilization and washing. As mentioned above, since the washing process is costly and may cause environmental pollution, processing methods without the washing process have been developed and part of them are practically employed.

Recently, for the rapid processing and the elimination of the washing step, a bath for nonwater washing treatment and a formalin-containing stabilizing bath have come to be employed in combination. This method yields satisfactory results when employed for the processing of a large amount of photosensitive materials. However, color negative films are generally processed in small amounts (20 to 30 rolls a day) unlike color paper. The use of the above method for the processing of a small amount of films is defective, since the maintenance and control of a processing liquid is difficult and, image quality deterioration, especially the formation of yellow stains, may occur during storage, depending on the kind of a color negative film.

To solve these problems, the use of an alkanol amine has been proposed in U.S. Pat. No. 4,786,583. The use of an alkanol amine improves the preservability of a processing liquid to some extent, but cannot avoid the formation of yellow stains in unexposed portions.

The use of a hexahydrotriazine-based compound is described in Japanese Patent Publication Open to Public Inspection Nos. 27742/1987 and 151538/1986. The use of this compound, however, cannot prevent yellow stain formation sufficiently. Further, this method is defective in the preservability of a processing liquid, and tends to make the backside of a photosensitive material uneven.

Object of the Invention

The object of the present invention is to provide a processing method of a silver halide color photographic photosensitive material with greatly improved preservability of a stabilizing solution for nonwater washing treatment as well as excellent image storage property.

Constituents of the invention

The above-mentioned object is accomplished by the processing method for silver halide color photographic photosensitive materials comprising a process in which a silver halide color photographic photosensitive material is color developed after imagewise exposure, a process using a processing solution capable of bleaching and a process using a stabilizing solution which is used instead of water washing and the stabilizing, wherein said processing solution capable of bleaching contains a ferric complex salt of organic acid represented by the following Formula [A], [B] or diethylenetriaminepentaacetic acid and the preceding stabilizing solution which is used instead of water washing and the stabilizing contains a formaldehyde compound at a concentration of not more than $1.0\times10^{-2}$ mol/1, and contains a compound represented by the following Formula I or hexamethylene tetramine or its derivatives.

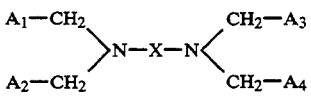

Formula [A]

wherein $A_1$ through $A_4$ independently represent $-CH_2OH$, —COOM or $—PO_3M_1M_2$, whether identical or not. M, $M_1$ and $M_2$ independently represent a hydrogen atom, a sodium atom, a potassium atom or an ammonium group. X represents an alkylene group with a carbon number of 3 to 6, and in this specification, hereafter, "alkylene group" means an alkylene which may have substituent(s).

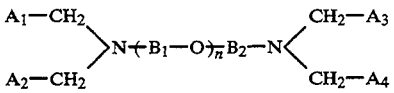

Formula [B]

wherein $A_1$ through $A_4$ independently represent $—CH_2OH$, —COOM or $—PO_3M_1M_2$, whether identical or not.

M, $M_1$ and $M_2$ independently represent a hydrogen atom, a sodium atom, a potassium atom or an ammonium group; n represents an integer of 1 to 8.

$B_1$ and $B_2$ independently represents an alkylene group with a carbon number of 2 to 5, whether identical or not.

Formula [I ]

$R_1$—CHO wherein $R_1$ represents or an alkyl group with a carbon number of 1 to 5 or a formyl group and in this specification, hereafter, "formyl group" means a formyl which may have substituent(s).

The present invention can effectively applied to the processing of a silver halide photographic photosensitive material for picture-taking. The effects of the present invention can be effectively produced when the concentration of the formaldehyde compound is not more than $5.0\times10^{-3}$ mol/ , preferably $2.0\times10^{-3}$ mol/ . The effects of the present invention can be maximized by treating a photosensitive material with a stabilizing solution for nonwater washing treatment immediately after the treatment with a solution capable of fixing, and further, by using a stabilizing solution for nonwater washing treatment as the final processing liquid. The objects of the present invention can be achieved more effectively by the use of a magenta coupler represented by Formula I or XI. These facts are unexpected for the inventors of the present invention.

Specific constituents of the invention

The compound represented by Formula [A] is first described in detail.

In Formula [A], $A_1$ through $A_4$ independently represent $CH_2OH$, —COOM or $—PO_3M_1M_2$, whether identical or not; M, $M_1$ and $M_2$ independently represent a hydrogen atom, a sodium atom, a potassium atom or an ammonium group. X represents an alkylene group with a carbon number of 3 to 6 (e.g. trimethylene, tetramethylene, pentamethylene).

The examples of the substituent include hydroxyl group and lower alkyl groups with a carbon number of 1 to 3.

Examples of preferable compounds represented by the preceding Formula [A] are given below.

(A-1)

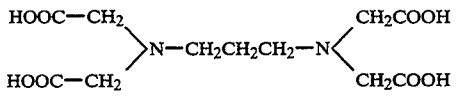

(A-2)

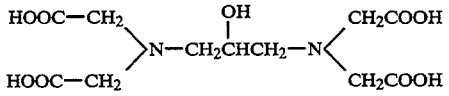

(A-3)

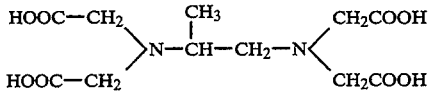

(A-4)

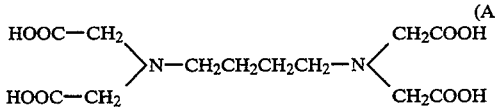

(A-5)

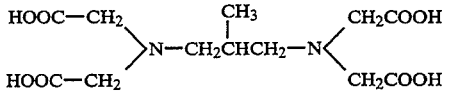

(A-6)

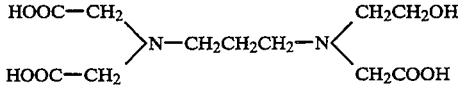

(A-7)

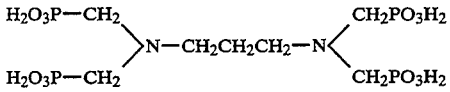

(A-8)

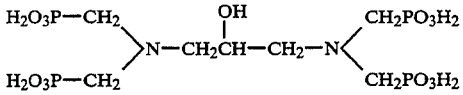

(A-9)

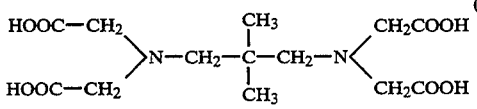

-continued (A-10)

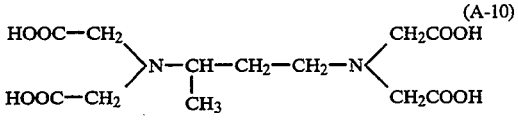

(A-11)

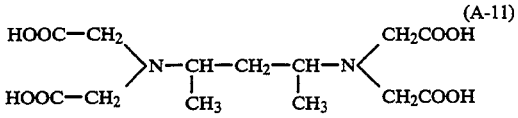

(A-12)

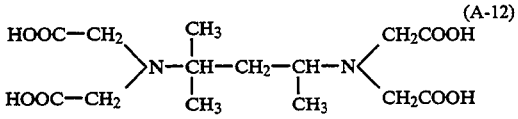

In addition to these compounds (A-1) through (A-12), their sodium salt, potassium salt or ammonium salt can be preferably used as well.

From the viewpoint of the desired effect of the present invention and solubility, it is preferable to use an ammonium salt of these ferric complex salts.

Of the preceding compounds, (A-1), (A-4), (A-7) and (A-9) are especially preferable, with special preference given to (A-1) and (A-9).

The compound represented by Formula [B] is next described in detail.

In Formula [B], $A_1$ through $A_4$ have the same definitions as $A_1$ through $A_4$ in the preceding Formula [A]; n represents an integer of 1 to 8. $B_1$ and $B_2$ independently represents an alkylene group with a carbon number of 2 to 5 (e.g. ethylene, trimethylene, tetramethylene, pentamethylene), whether identical or not.

The examples of the substituent include hydroxyl group and lower alkyl groups with a carbon number of 1 to 3 (e.g. methyl group, ethyl group, propyl group).

Examples of preferable compounds represented by the preceding Formula [B] are given below.

(B-1)

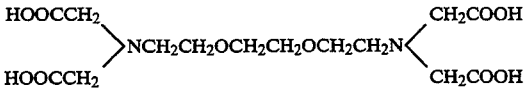

(B-2)

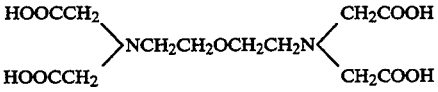

(B-3)

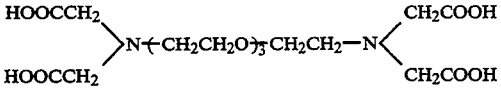

(B-4)

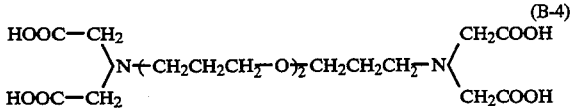

(B-5)

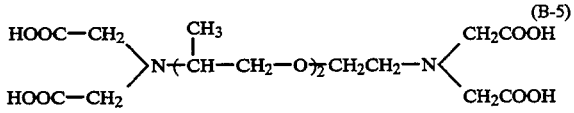

-continued (B-6)

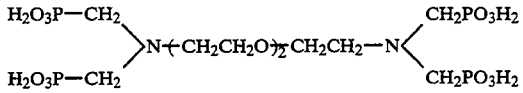

(B-7)

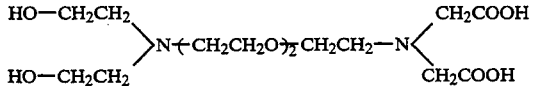

In addition to these compounds (B-1) through (B-7), their sodium salt, potassium salt or ammonium salt can be preferably used as well.

From the viewpoint of the desired effect of the present invention and solubility, it is preferable to use an ammonium salt of these ferric complex salts.

The preceding compounds, (B-1), (B-4) and (B-7) are especially preferable, with special preference given to (B-1).

It is preferable, from the viewpoint of its silver bleaching property and for the maximization of the effects of the invention, to use a ferric complex salt of these compounds represented by Formula [A], [B] or diethylenetriaminepentaacetic acid at a ratio of at least 0.1 mol per liter processing solution capable of bleaching, more preferably between 0.15 and 2.00 mol/l, and ideally between 0.2 and 1.0 mol/l.

A ferric complex salt of the compounds represented by Formula [A], [B] or diethylenetriaminepentaacetic acid is contained in a bleacher or a bleach-fixer. For the maximization of the effects of the present invention, it is preferred that a ferric complex salt of an organic acid represented by Formula [A] or [B] be contained in a bleacher, and a ferric complex salt of an organic acid represented by Formula [B] or diethylenetriaminepentaacetic acid be contained in a bleach-fixer.

In the processing solution capable of bleaching of the present invention, a ferric complex salt of the preceding compound represented by Formula [A] or [B] or diethylenetriaminepentaacetic acid can be used in combination with another aminopolycarboxylic acid ferric complex salt (e.g. ethylenediaminetetraacetic acid ferric complex salt, 1,2-cyclohexanediaminetetraacetic acid ferric complex salt). However, for enhancement of the desired effect of the present invention, it is preferable to use a processing solution capable of bleaching containing a ferric complex salt of a compound represented by the preceding Formula [A] or [B] or diethylenetriaminepentaacetic acid substantially alone. In this context, the term "substantially" means that the concentration of the ferric complex salt in question is at least 70% (calculated as molar ratio) relative to the total amount of all ferric complex salts involved. The ratio is preferably more than 80%, more preferably more than 90%, and ideally more than 95%.

The processing solution capable of bleaching may contain a normally used bleaching accelerator. Typical examples of bleaching accelerators include (I-1) through (I-10), (II-1) through (II-27), (III-1) through (III-15), (IV-1) through (IV-3), (V-1) through (V-23), (VI-1) through (VI-7), (VII-1) through (VII-15), (VIII-1) through (VIII-7), (IX-1)through (IX-5) and (A-1) through (A-8) described in pp.17–39 of Japanese Patent Application No.32501/1988.

These bleaching accelerators may be used singly or in combination. Good results are obtained when the addition amount falls in the range of from about 0.01 to 100 g per liter bleacher. However, when the addition amount is too small, the bleaching accelerating effect is weak, and when the addition amount is excessively great, precipitation may occur, which in turn may contaminate the silver halide color photographic photosensitive material to be processed. It is therefore preferable that the addition amount be 0.05 to 50 g, more preferably 0.05 to 15 g, per liter solution capable of bleaching.

When a bleaching accelerator is added, it may be directly added and dissolved, but it is common to add it after being dissolved in water, alkali, organic acid etc.; it is also possible to add it in solution in an organic solvent such as methanol, ethanol or acetone as necessary.

The bleacher of the present invention can be used between pH2 and 5.5; it is preferable to use it between pH3.0 and 5.0. It is preferable that the pH of the bleach-fixer be between 3.0 and 9.0, more preferably between 4.0 and 8.0. Processing temperature is normally 20° C. to 45° C., preferably 25° C. to 42° C.

The bleacher or bleach-fixer of the present invention may be used in the presence of a halide such as ammonium bromide. The bromide is added in small amounts, specifically not more than 2.0 mol/l, preferably 0.5 to 1.5 mol/l, since the bleaching agent of the present invention has strong oxidizing power and the tar property is low.

The bleacher or bleach-fixer of the present invention may contain one or more pH buffers comprising various salts such as boric acid, borax, sodium hydroxide, potassium hydroxide, sodium carbonate, potassium carbonate, sodium bicarbonate, potassium bicarbonate, acetic acid, sodium acetate and ammonium hydroxide.

In the present invention, it is preferable to use acetic acid as pH buffer, which reduces bleach fogging and which is economical. It is preferable that the amount of acetic acid be 0.1 to 3 mol/l, more preferably 0.4 to 2 mol/l. When the amount of acetic acid is small, more bleach fogging occurs; when the amount of acetic acid is great, the desilvering property lowers.

In the present invention, the use of sulfate is preferable as a mode of its embodiment. When used in combination with the bleaching agent of the present invention, sulfate shows an enhanced effect to prevent the formation of ferrous complex salt and improves color reproducibility. A rust preventive effect is also obtained. The use of sulfate is therefore very advantageous with respect to cost performance.

Nitrate is normally used at ratios of 0.1 to 3 mol/l, preferably 0.3 to 2 mol/l.

Various fluorescent whitening agents, defoaming agents, surfactants and antifungal agents can also be contained.

When the solution capable of bleaching according to the present invention is used as the bleacher, it is preferable that the replenishment amount for the solution capable of bleaching be 20 ml to 500 ml per $m^2$ silver halide color photographic photosensitive material, more preferably 30ml to 350 ml, still more preferably 40 ml to 300 ml, and ideally 50 ml to 250 ml.

The processing solution having bleaching power, according to the invention, means a bleacher or bleach-fixer solution.

The processing solution having fixing power, according to the invention, means a bleach-fixer or fixer solution.

In the method of the present invention, it is preferable, from the viewpoint of rapid processing, that the photosensitive material be processed with a fixer or bleach-fixer immediately after processing with a bleacher.

Specific examples of preferable processing procedures for the present invention are given below.

(1) Color development—bleaching—fixing—processing with a stabilizing solution which is used instead of water washing and the stabilizing
(2) Color development—bleaching—fixing—rinsing—processing with a stabilizing solution which is used instead of water washing and the stabilizing
(3) Color development—bleaching—bleach—fixing—processing with a stabilizing solution which is used instead of water washing and the stabilizing
(4) Color development—bleaching—bleach—fixing—rinsing —processing with a stabilizing solution which is used instead of water washing and the stabilizing
(5) Color development—breach—fixing—processing with a stabilizing solution which is used instead of water washing and the stabilizing
(6) Color development—bleach—fixing—rinsing—processing with a stabilizing solution which is used instead of water washing and the stabilizing Of these procedures, (1), (3) and (5) are especially preferable, with special preference given to (1) and (5).

In the present invention, it is preferable that the thiosulfate concentration of the bleach-fixer or fixer be not less than 1 mol/l.

It is more preferable that the thiosulfate concentration of the bleach-fixer or fixer be not less than 1.3 mol/l, still more preferably 1.5 to 3 mol/l. Too high a thiosulfate concentration leads easily to poor fixing. The examples of thiosulfates include potassium thiosulfate, sodium thiosulfate and ammonium thiosulfate, with preference given to ammonium thiosulfate.

It is especially preferable to use thiocyanate in combination with thiosulfate for fixing agent.

As compared with thiosulufate, the use of thiocyanate is more preferable in emboding the present invention, since it contributes not only to rapid fixing but also to improvement in the preservability of a stabilizing solution which is used instead of water washing and the stabilizing and the image storage property.

Some specific examples of thiocyanate compounds are given below.

F-1 Ammonium thiocyanate
F-2 Potassium thiocyanate
F-3 Sodium thiocyanate
F-4 Thiocyanocatechol Of these thiocyanate compounds, (F-1), (F-2) and (F-3) are preferable.

These thiocyanates may be used singly or in combination.

It is preferable to use thiocyanate in amounts 0.1 to 7 mol, more preferably 0.2 to 5 mol per liter of a processing liquid.

In addition to these fixing agents, the fixer and bleach-fixer can contain one or more pH buffers comprising various salts, e.g. sulfites such as ammonium sulfite, potassium sulfite, ammonium bisulfite, potassium bisulfite, sodium bisulfite, ammonium metabisulfite, potassium metabisulfite and sodium metabisulfite; and boric acid, borax, sodium hydroxide, potassium hydroxide, sodium carbonate, potassium carbonate, sodium bicarbonate, potassium bicarbonate, acetic acid, sodium acetate and ammonium hydroxide. It is also possible to add additives known to be normally added to fixer and bleach-fixer, such as pH buffers, alkylamines and polyethylene oxides.

In the present invention, if desired, air blowing or oxygen blowing may be conducted in a processing bath or processing solution replenisher storage tank to enhance the activity of the bleacher or bleach-fixer. It is also possible to add an appropriate oxidizer, e.g. hydrogen peroxide, bromate or persulfate.

In the embodiment of the method of the present invention, silver or a halogen may be recovered from the fixer or bleach-fixer by a known method. The examples of silver recovery methods which can be efficiently used include electrolysis (French Patent No. 2,299,667), precipitation (Japanese Patent Publication Open to Public Inspection No. 73037/1977, German Patent No. 2,331,220) , ion exchange (Japanese Patent Publication Open to Public Inspection No. 17114/1976, German Patent No.2,548,237) and metal replacement (British Patent No. 1,353,805).

In this silver or halogen recovery, in-line silver or halogen recovery from tank solution is especially preferable because the rapid processing property and the preservability of a stabilizing solution which is used instead of water washing and the stabilizing are enhanced, but is is possible to recover silver from overflow waste solution and regenerate it for second use.

The desired effect of the present invention is enhanced when the replenishment amount for the fixer and bleach-fixer of the present invention is not more than 1200 ml per $m^2$ photosensitive material. Still better results are obtained when the replenishment amount is 10 to 1000 ml per $m^2$ photosensitive material, specifically 150 to 800 ml.

The stabilizing solution which is used instead of water washing and the stabilizing is described below.

The stabilizing solution which is used instead of water washing and the stabilizing of the present invention is the processing solution for processing bath used in place of washing bath after processing with a processing solution capable of fixing.

The formaldehyde is normally added at not more than $1.0\times10-2$ mol per liter stabilizing solution which is used instead of water washing and the stabilizing, preferably not more than $5.0\times10^{-3}$ mol/l, still more preferably not more than $2.0\times10^{-3}$ mol/l, and it is ideal that they are not contained.

The use of a reduced amount of or no formaline is preferable in view of its cancer-causing property. In the U.S., Chemical Industry Institute of Toxicity (CIIT) reported that a rat infused with 15 ppm formaldehyde developed a cancer of nasal cavity. Also, National Institute for Occupational Safety (NIOS) and Authority Conference of Government for Industrial Health (ACGIH) suggested the cancer-causing property of formaline. The use of formaline is strictly controlled in Europe; West Germany has limited the amount of formaline used in houses to not more than 0.1 ppm for the past ten years.

The harmful effects of formaline to human body, especially its irritation to mucous membrane, are recognized also in Japan. Formaline is designated as a dangerous substance and drug, and its industrial use is controlled by Organic Solvent Poisoning Regulation, the special regulation for chemistry of the Labour Safety Act. The use of formaline is household goods, fibers and plywood is also controlled. By the Ministry of Health and Welfare, the amount of formaline used in underwear and baby clothes has been controlled since 1975. In view of these facts, to use a reduced amount or no formaline is desirable for the prevention of environmental pollution.

The examples of the alkyl group with a carbon number of 1 to 5 represented by $R_1$ in the preceding Formula [I] include acetyl group, hydroxyl group, alkoxy group, formyl group, amino group, hydroxyimino group and halogen atoms.

Some specific examples of compounds represented by the preceding Formula [I] are given below, but the present invention is not by any means limited by these examples.

[Example Compounds ]

I-1 Mucochloric acid
I-2 Acetaldehyde
I-3 Propionaldehyde
I-4 Isobutylaldehyde
I-5 n-butylaldehyde
I-6 n-valeraldehyde
I-7 Isovaleraldehyde
I-8 Methylethylacetaldehyde
I-9 Trimethylacetaldehyde
1-10 n-hexaaldehyde
1-11 Methyl-n-propylacetaldehyde
1-12 Isohexaaldehyde
1-13 Glyoxal
1-14 Malonaldehyde
1-15 Succinaldehyde
1-16 Glutaraldehyde
I-17 Adipaldehyde
I-18 Methylglyoxal
I-19 Acetoacetaldehyde
I-20 Glycolaldehyde
I-21 Ethoxyacetaldehyde
I-22 Aminoacetaldehyde
I-23 Betaine aldehyde
I-24 Chloral
I-25 Chloroacetaldehyde
I-26 Dichloroacetaldehyde
I-27 Bromal
I-28 Dibromacetaldehyde
I-29 Iodoacetaldehyde
I-30 α-chloropropionacetaldehyde
I-31 α-bromopropionacetaldehyde The above-mentioned aldehyde derivatives except for formaline are used in an amount of from $1.0\times10^{-4}$ to $1.0\times10^{-1}$ mol, preferably not less than $1.0\times10^{-3}$ mol, per liter stabilizing solution which is used instead of water washing and the stabilizing.

If no formaline is used, a stain tends to be formed in a dye image during storage, and, as found by the inventors of the present invention, the maximum density portion is apt to be changed. The latter drawback can be overcome by the use of the compound of the present invention.

An explanation will be made as to hexamethylene tetramine-based compound to be used in the present invention.

A hexamethylene tetramine-based compound can produce almost same effects as produced by aldehyde derivatives.

A hexamethylene tetramine-based compound as referred in the present invention means hexamethylene tetramine and its derivatives. Examples of the hexamethylene tetramine derivatives include addition products with a halogen, an inorganic acid, a metal salt, a phenol derivative, an alkylsulfonic acid, an arylsulfonic acid, an alkylsulfuric acid ester, and alkylcarboxylic acid, an arylcarboxylic acid and an alkylhalide.

The specific examples of hexamethylene tetramine and its derivatives to be used in the present invention are described in Beilsteins Handbuch der Organischen Chemie, Vol. 2, second edition,. pp 200 to 212. Of those examples, water-soluble compounds are preferred for use in the present invention. The representative examples of a hexamethylene tetramine-based compound to be used in the present invention (hereinafter referred to as "the compound of the present invention" will be listed below, which are given only for the illustrative purpose.

(1)

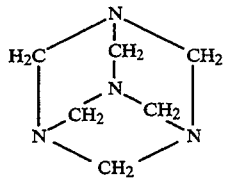

(2)

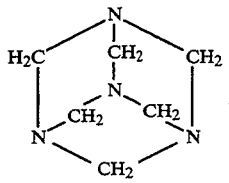

.HCl (3)

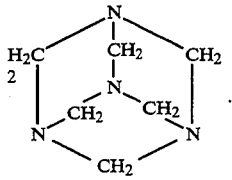

.$H_2SO_4$ (4)

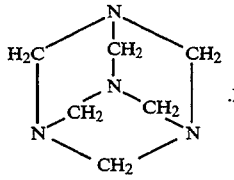

.$H_2SO_4$ (5)

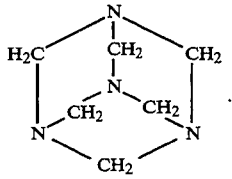

.$2HNO_3$ (6)

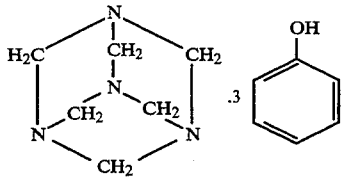

(7)

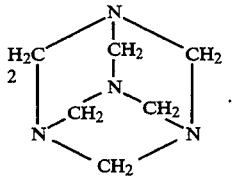

.$FeCl_2.9H_2O$

-continued (8)

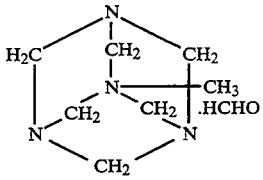

(9)

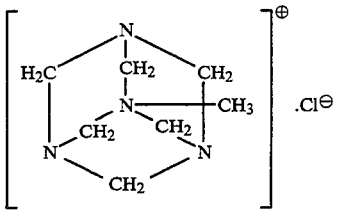

(10)

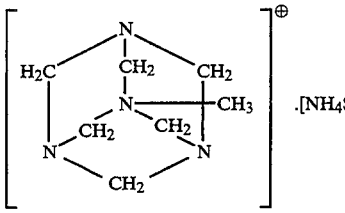

(11)

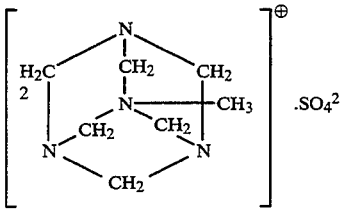

(12)

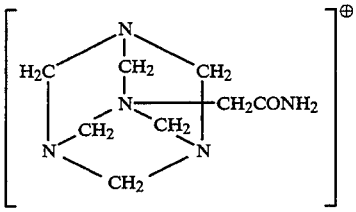

(13)

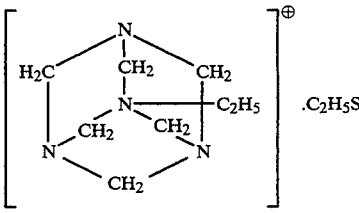

(14)

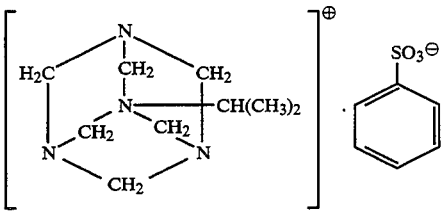

-continued (15)

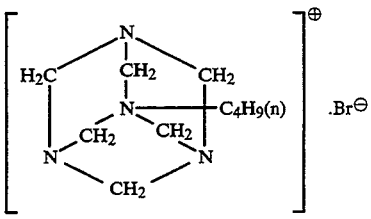

(16)

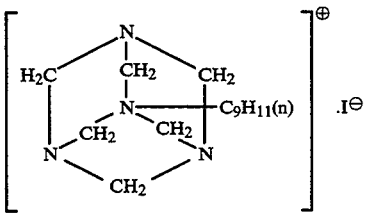

(17)

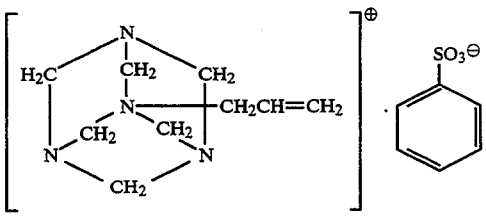

(18)

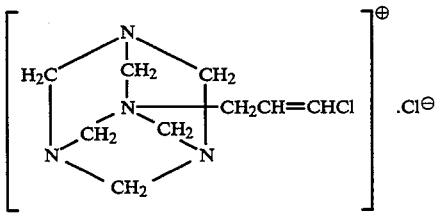

(19)

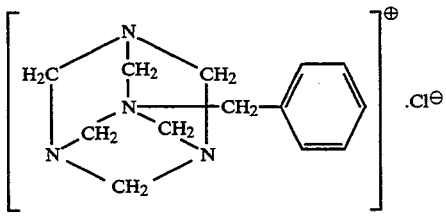

(20)

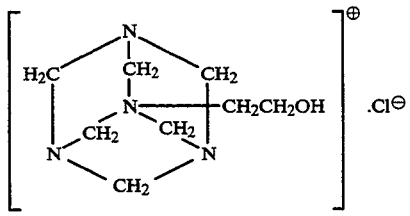

(21)

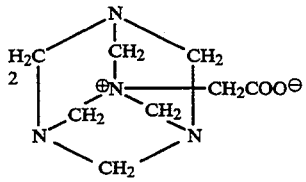

-continued (22)

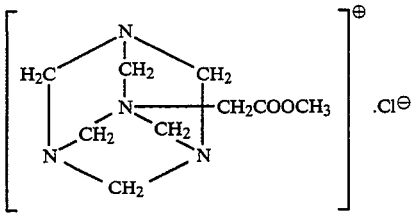

(23)

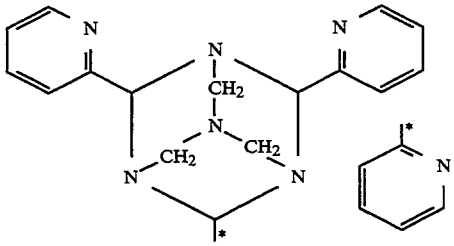

(24)

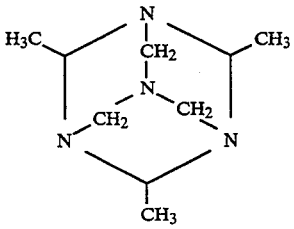

(25)

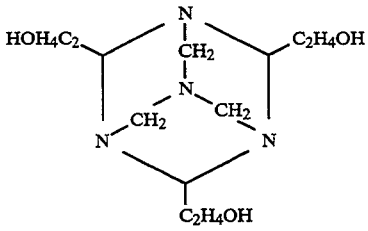

The compound of the present invention is commercially available, or can be synthesized readily by the method described in the above-mentioned literature.

The compound of the present invention can be used either alone or in combination, and is employed preferably in an amount of not less than 0.05 g, more preferably 0.3 to 20 g, per liter stabilizing solution.

In the processing method of the present invention, processing with a stabilizer is conducted substantially without washing after processing with a processing solution capable of fixing. This processing procedure is totally different from conventional procedures in which washing and processing with a stabilizer follow processing with a fixing bath or bleach-fixing bath.

As stated above, processing with a stabilizing solution which is used instead of water washing and the stabilizing serves for stabilization in which stabilizing treatment is conducted immediately after processing with a processing solution capable of fixing substantially without washing.

In the present invention, a better effect is obtained when the stabilizing tank comprises 1 to 5 chambers; it is specially preferable that the stabilizing tank comprise 1 to 3 chambers.

In the present invention, it is preferable that the stabilizing solution which is used instead of water washing and the stabilizing contain a surfactant and an antifungal agent.

From the viewpoint of the effect of the present invention, it is especially preferable to use at least one compound as surfactant selected from the group comprising compounds represented by the following Formula [B1] or [B2] and water-soluble organic siloxane compounds.

Formula [B1]

$$A-O-(B)_m-X_2$$

In Formula [B1], A represents a monovalent organic group such as an alkyl group with a carbon number of 6 to 20, preferably 6 to 12, e.g. hexyl, heptyl, octyl, nonyl, decyl, undecyl or dodecyl.

A also represents an aryl group substituted with an alkyl group with a carbon number of 3 to 20. It is preferable that the substituent be an alkyl group with a carbon number of 3 to 12, e.g. propyl, butyl, pentyl, hexyl, heptyl, octyl, nonyl, decyl, undecyl or dodecyl.

The aryl group includes phenyl, tolyl, xylyl, biphenyl and naphthyl, with preference given to phenyl or tolyl.

The alkyl may bind to the aryl group at any position, whether it is ortho, meta or para.

B represents ethylene oxide or propylene oxide; m represents an integer of 4 to 50.

$X_2$ represents a hydrogen atom, $-SO_3Y$ or $-PO_3Y_2$, wherein Y represents a hydrogen atom, an alkali metal atom (e.g. Na, K or Li) or an ammonium ion.

Formula [B2]

$$R_7-\overset{\overset{R_4}{|}}{\underset{\underset{R_5}{|}}{N}}\oplus-R_6 \quad X_3\ominus$$

In Formula [B2], $R_4$, $R_5$, $R_6$ and $R_7$ independently represent a hydrogen atom, an alkyl group, or a phenyl group, with a total number of carbon atoms in $R_4$, $R_5$, $R_6$ and $R_7$ falling in the range of from 3 to 50.

$X\theta_3$ represents an anion such as a halogen atom, a hydroxyl group, a sulfuric acid group, carbonic acid group, nitric acid group, acetic acid group or a p-toluenesulfonic acid group.

The preceding water-soluble organic siloxane compounds mean ordinary water-soluble organic siloxane compounds as described in, for example, Japanese Patent Publication Open to Public Inspection No.18333/1972, Japanese Patent Examined Publication Nos.51172/1980 and 37538/1976, Japanese Patent Publication Open to Public Inspection No.62128/1974 and U.S. Pat. No.3,545,970.

Some specific examples of compounds represented by Formula [B1] or [B2] and water-soluble organic siloxane compounds are given below, but the present invention is not by any means limited by these examples.

(Example Compounds represented by Formula [B1])

$C_{12}H_{25}(C_2H_4O)_{10}H$ — $B_1$-1

$C_8H_{17}O(C_{13}H_6O)_{15}H$ — $B_1$-2

$C_9H_{10}O(C_2H_4O)_4SO_3Na$ — $B_1$-3

$C_{10}H_{21}O(C_2H_4O)_{15}PO_3Na_2$ — $B_1$-4

$B_1$-5

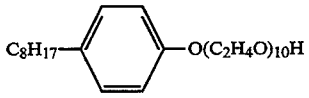

-continued $B_1$-6

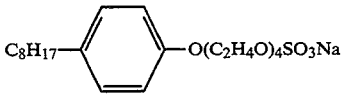

$B_1$-7

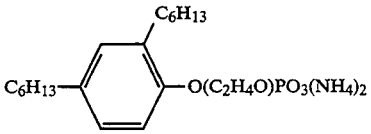

$B_1$-8

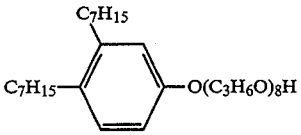

$B_1$-9

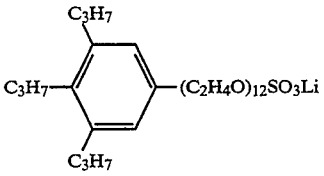

$B_1$-10

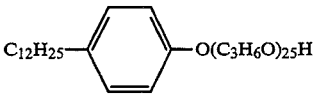

$B_1$-11

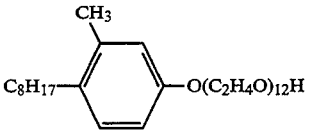

$B_2$-12

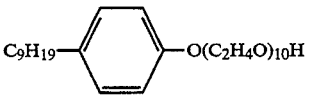

(Example Compounds represented by Formula [B2])

$B_2$-1

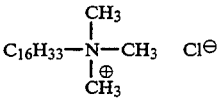

$B_2$-2

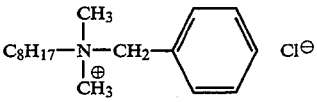

$B_2$-3

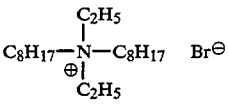

$B_2$-4

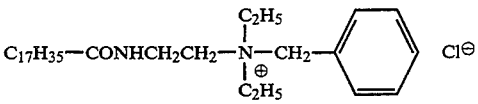

$B_2$-5

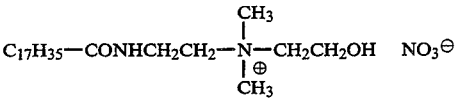

-continued

B2-6

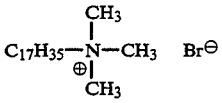

B2-7

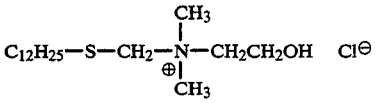

B2-8

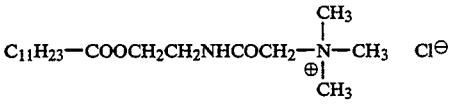

B2-9

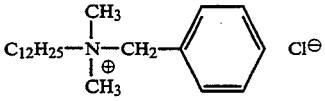

B2-10

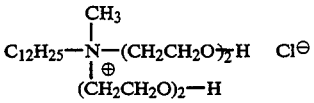

(Water-soluble organic siloxane compounds)

B3-1

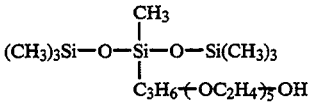

B3-2

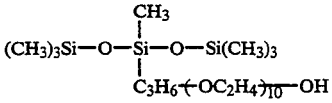

B3-3

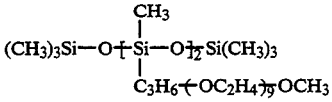

B3-4

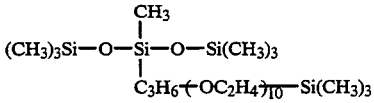

B3-5

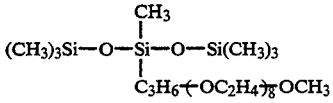

B3-6

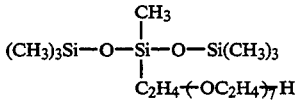

B3-7

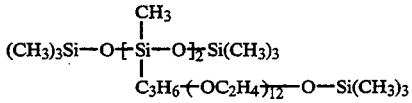

B3-8

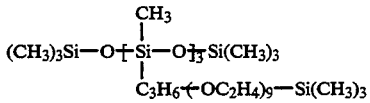

B3-9

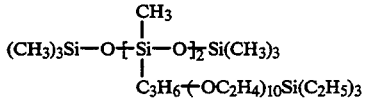

-continued

B3-10

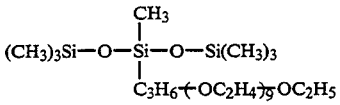

B3-11

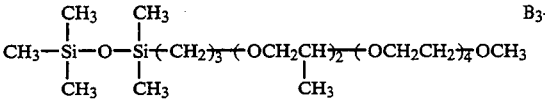

B3-12

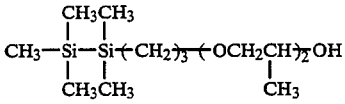

B3-13

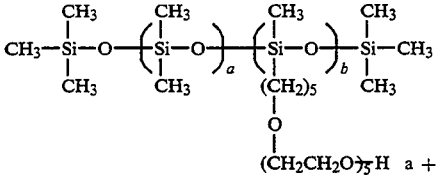

B3-14

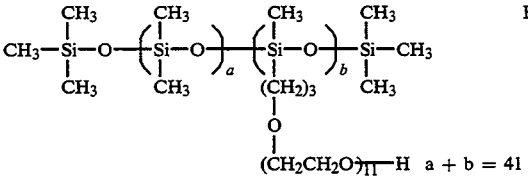

Of the preceding water-soluble organic siloxane compounds, those represented by the following Formula [B4] are more preferably used.

Formula [B4]

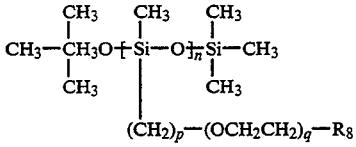

In Formula [B4], $R_8$ represents a hydrogen atom, a hydroxy group, a lower alkyl group, an alkoxyl group,

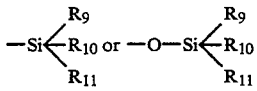

$R_9$, $R_{10}$ and $R_{11}$ independently represent a lower alkyl group (preferably an alkyl group with a carbon number of 1 to 3, such as methyl, ethyl or propyl), whether identical or not. n represents an integer of 1 to 4; p and q independently represent an integer of 1 to 15.

These compounds represented by Formula [B1] or [B2] and water-soluble organic siloxane compounds may be used singly or in combination. They have a better effect when used in amounts of 0.01 to 20 g per liter stabilizer.

For the improved liquid preservability, it is preferable to add an antifungal agent to the stabilizing solution which is used instead of water washing and the stabilizing of the present invention. The antifungal agents which can be preferably used are salicylic acid, sorbic acid, dehydroacetic acid, hydroxybenzoic acid compounds, alkylphenol compounds, thiazole compounds, pyridine compounds, guanidine compounds, carbamate compounds, morpholine compounds, quaternary phosphonium compounds, ammonium compounds, urea compounds, isoxazole compounds, propanolamine compounds, sulfamide derivatives and amino acid compounds.

The preceding hydroxybenzoic acid compounds include hydroxybenzoic acid and their esters, methyl ester, ethyl ester, propyl ester and butyl ester; it is preferable to use n-butyl ester, isobutyl ester or propyl ester of hydroxybenzoic acid, with further preference given to a mixture of these three esters of hydroxybenzoic acids.

The alkylphenol compounds are compounds wherein the phenyl group has a substituent alkyl group with a carbon number of 1 to 6, with preference given to orthophenylphenol and orthocyclohexylphenol.

The thiazole compounds are compounds having a nitrogen atom and a sulfur atom in their 5-membered ring, with preference given to 1,2-benzisothiazolin3-one, 2-methyl-4isothiazolin3-one, 2-octyl-4-isothiazolin3-one, 5chloro-2-methyl-4-isothiazolin-one and 2-(4-thiazolyl)benzimidazole.

The pyridine compounds include 2,6-dimethylpyridine, 2,4,6-trimethylpyridine and sodium 2-pyridinethiol-1-oxide, with preference given to sodium 2-pyridinethiol-1-oxide.

The guanidine compounds include cyclohexidine, polyhexamethylenebiguanidine hydrochloride and dodecylguanidine hydrochloride, with preference given to dodecylguanidine and its salt.

The carbamate compounds include methyl-1-(butylcarbamoyl)-2-benzimidazole carbamate and methylimidazole carbamate.

The morpholine compounds include 4-(2-nitrobutyl)-morpholine and 4-(3-nitrobutyl)morpholine.

The quaternary phosphonium compounds include tetraalkylphosphonium salts and tetraalkoxyphosphonium salts, with preference given to tetraalkylphosphonium salts, specifically tributyl tetradecylphosphonium chloride and triphenyl nitrophenylphosphonium chloride.

The quaternary ammonium compounds include benzalkonium salts, benzetonium salts, tetraalkylammonium salts and alkylpyridinium salts, more specifically dodecyldimethylbenzylammonium chloride, dodecyldimethylammonium chloride and laurylpyridinium chloride.

The urea compounds include N-(3,4-dichlorophenyl)-N'-(4-chlorophenyl)urea and N-(3-trifluoromethyl-4-chlorophenyl)-N'-(4-chlorophenyl-)urea.

The isoxazole compounds include 3-hydroxy-5-methylisoxazole.

The propanolamine compounds include n-propanols and isopropanols, specifically DL-2-benzylamino-1-propanol, 3-diethylamino-1-propanol, 2-dimethylamino-2-methyl-1propanol, 3-amino-1-propanol, isopropanolamine, diisopropanolamine and N,N-dimethyl-isopropanolamine.

The sulfamide derivatives include fluorinated sulfamide, 4-chloro-3,5-dinitrobenzenesulfamide, sulfanylamide, acetosulfamine, sulfapyridine, sulfaguanidine, sulfathiazole, sulfadiazine, sulfamerazine, sulfamethazine, sulfaisoxazole, homosulfamine, sulfisomidine, sulfaguanidine, sulfamethizole, sulfapyradine, phthalisosulfathiazole and succinylsulfathiazole.

The amino acid compounds include N-lauryl-$\beta$-alanine.

Of the preceding antifungal agents, pyridine compounds, guanidine compounds and quaternary ammonium compounds are preferably used for the present invention.

Alternatively, it is possible to use, as the stabilizing solution which is used instead of water washing and the stabilizing, tap water, to which the preceding antifungal agent or a halide-releasing compound is added after treatment with an ion-exchange resin, an absorbent, activated charcol or the like.

These antifungal agents are used in amounts of 0.002 to 50 g per liter stabilizing solution which is used instead of water washing and the stabilizing, preferably 0.005 to 10 g/l.

For enhancement of the effect of the present invention, it is preferable that the pH of the stabilizing solution which is used instead of water washing and the stabilizing fall in the range of from 2.0 to 10.0, more preferably from 3.0 to 9.5, and still more preferably from 4.0 to 9.0.

The pH value in this range leads to the enhancement of the effects of the invention.

Any generally known alkali agent or acid agent can be used as pH regulator to be contained in the stabilizing solution which is used .instead of water washing and the stabilizing of the present invention.

When a photosensitive material is treated in a bleach-fixer before the treatment with the stabilizing solution which is used instead of water washing and the stabilizing, it is preferable, for the achievement of the objects of the present invention, to add a chelating agent with a chelate stabilizing constant to iron ions of not less than 8 to the stabilizing solution which is used instead of water washing and the stabilizing.

The "chelate stabilizing constant" as referred to herein means the constant generally known from, for example, L. G. Sillen and A. E. Martell: "Stability Constants of Metal-ion Complexes", The Chemical Society, London (1964), and S. Charberek and A. E. Martell: "Organic Sequestering Agents", Wiley (1959).

Examples of the chelating agent with a chelate stabilizing constant to iron ions of not less than 8, which are preferably employed in the stabilizing solution, include organic carboxylic acid chelating agents, organic sulfuric acid chelating agents, inorganic sulfuric acid chelating agents and polyhydroxy compounds. The iron ion as mentioned above means a ferric ion (FeIII).

Specific examples of the chelating agent with a chelate stabilizing constant to ferric ions of not less than 8 include those listed below, but are not limited thereto; ethylenediamine diorthohydroxyphenylacetic acid, diaminopropane tetraacetic acid, nitrilotriacetic acid, hydroxyethylenediamine triacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacaetic acid, glycoletherdiaminetetraacetic acid, ethylenediaminetetrakismethylenephosphonic acid, nitrilotrimethylenephosphonic acid, 1-hydroxyethylidene-1,1-diphosphonic acid, 1,1-diphosphonoethane-2-carboxylic acid, 2-phophonobutane-1,2,4-tricarboxylic acid, 1-hydroxy-1-1-phophonopropane-1,2,3-tricarboxylic acid, catechol-3,5-diphosphonic acid, sodium pyrophosphate, sodium tetrapolyphosphate, and sodium hexametaphosphate. Of them, preferable are organic phosphonic acids and inorganic condensed phosphoric acids. Especially preferable is 1-hydroxyethylidene-1,1-diphosphonic acid.

The preceding chelating agents are employed preferably in an amount of 0.01 to 100 g, more preferably 0.05 to 50 g, thereby significantly improving the whiteness of unexposed portions and the preservability of an image after processing.

The replenishing amount of the stabilizing solution which is used instead of water washing and the stabilizing added to the stabilizing bath is 2 to 30 times, preferably 3 to 20 times the amount transferred by a silver halide photosensitive material from the previous bath.

If the replenishing amount is less than 2 times the amount transferred from the previous bath, the backside of a phosensitive material is seriously stained. With the replenishing amount larger than 30 times the amount transferred from the previous bath, the effects of the present invention, especially the image storage effect, cannot be produced sufficiently.

As stated above, in emboding the present invention, it is especially preferable to subject a photosensitive material to treatment with the stabilizing solution which is used instead of water washing and the stabilizing immediately after treatment with a solution capable of fixing. The effects of the invention are seriously impaired by placing a rinsing tank in front of the tank for the stabilizing solution which is used instead of water washing and the stabilizing.

Stabilizing temperature is normally between 15° and 60° C., preferably between 20° and 45° C. Also, processing time is preferably minimized from the viewpoint of rapid processing; it is normally 20 seconds to 10 minutes, ideally 1 to 3 minutes. In the case of stabilization using a tank with a number of chambers, it is preferable that processing time increase with the order of chamber arrangement, with special preference given to serial processing in which processing time is increased by 20 to 50% in comparison with the previous chamber.

In the stabilizing process of the present invention, it is preferable to supply the stabilizing solution which is used instead of water washing and the stabilizing to the bath which follows and then overflow it from the previous bath in the case of a multichamber counter current system. It is of course possible to achieve processing with a single-chamber tank.

There are various methods of adding the preceding compounds, including the method in which they are added in the form of concentrate solutions to the stabilizing tank and the method in which the preceding compounds and other additives are added to the stabilizing solution which is used instead of water washing and the stabilizing to be supplied to the stabilizing tank and this solution is used as supplier for the replenisher for stabilizing solution which is used instead of water washing and the stabilizing; any method of addition can be used.

Aromatic primary amine color developing agents to be used in the present invention includes those widely employed in various color photographic processes. These color developing agents include aminophenol type and p-phenylenediamine type derivatives of an aromatic primary amine. These compounds are generally employed in a salt form (e.g., hydrochloride, sulfate), which are more stable than the free state, and normally in an amount of about 0.1 to 30 g, preferably about 1 to 15 g, per liter color developer.

Useful primary amine-based color developing agent is an N,N'-dialkyl-p-phenylenediamine-based compound, in which an alkyl group and a phenyl group may be substituted. Examples of especially useful compounds are N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene sulfate, N-ethyl-N- -methanesulfonamidoethyl-3-methyl-4-aminoaniline sulfate, N-ethyl-N- -hydroxyethylaminoaniline sulfate, 4-amino-3-methyl-N,N'-diethylaniline sulfate, 4-amino-N-(2-methoxyethyl)-N-ethyl-3-methylaniline-p-toluene sulfonate, or the like.

A color developer to be used in the present invention may further contain, in addition to the preceding aromatic primary amine color developing agent, various conventional additives, examples of which include alkaline agents such as sodium hydroxide, sodium carbonate and potasium carbonate, alkali metal sulfite, alkali metal hydrogen sulfite, alkali metal thiocyanate, alkali metal halides, benzil alcohol, a water softener and thickener. A color developer normally has a pH value of not less than 7, most generally 10 to 13.

The processing method of the present invention is preferably applicable to negative photosensitive materials for picture taking and color paper; it is especially preferable to apply it to negative photosensitive materials for picture taking.

For enhancement of the desired effect of the present invention, it is preferable to use in the photosensitive material a magenta coupler represented by the following Formula [M-1] or [M-XI] and a cyan coupler represented by the following Formula [C-1] or [CU].

Formula [M-I]

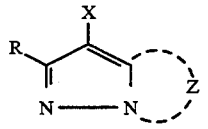

wherein Z represents a group of nonmetallic atoms necessary for the formation of a nitrogen-containing heterocyclic ring; the ring formed by Z may have a substituent.

X represents a hydrogen atom or a group capable of splitting off by reaction with an oxidation product of the color developing agent.

R represents a hydrogen atom or a substituent.

The substituent represented by R is not subject to particular limitation. The typical examples thereof include alkyl, aryl, anilino, acylamino, sulfonamido, alkylthio, arylthio, alkenyl and cycloalkyl groups. The examples also include halogen atoms, cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic thio groups, as well as spiro compound residues and bridged hydrocarbon compounds.

The alkyl group represented by R preferably has a carbon number of 1 to 32 and may be normal or branched. The aryl group represented by R is preferably a phenyl group.

The acylamino group represented by R includes alkylcarbonylamino groups and arylcarbonylamino groups.

The sulfonamido group represented by R includes alkylsulfonylamino groups and arylsulfonylamino groups.

The alkyl moiety and aryl moiety in the alkylthio group and arylthio group represented by R include the preceding alkyl groups and aryl groups represented by R.

The alkenyl group represented by R preferably has a carbon number of 2 to 32; the cycloalkyl group represented by R preferably has a carbon number of 3 to 12, more preferably 5 to 7; the alkenyl group may be normal or branched.

The cycloalkenyl group represented by R preferably has a carbon number of 3 to 12, more preferably 5 to 7.

The examples of the sulfonyl group represented by R include alkylsulfonyl groups and arylsulfonyl groups; the examples of the sulfinyl group include alkylsulfinyl groups and arylsulfinyl groups; the examples of the phosphonyl group include alkylphosphonyl groups, alkoxyphosphonyl groups, aryloxyphosphonyl groups and arylphosphonyl groups; the examples of the acyl group include alkylcarbonyl groups and arylcarbonyl groups; the examples of the carbamoyl group include alkylcarbamoyl groups and arylcarbamoyl groups; the examples of the sulfamoyl group include alkylsulfamoyl groups and arylsulfamoyl groups; the examples of the acyloxy group include alkylcarbonyloxy groups and arylcarbonyloxy groups; the examples of the carbamoyloxy group include alkylcarbamoyloxy groups and arylcarbamoyloxy groups; the examples of the ureido group include alkylureido groups and arylureido groups; the examples of the sulfamoylamino group include alkylsulfamoylamino groups and arylsulfamoylamino groups; the heterocyclic group is preferably a 5- to 7-membered one, such as 2-furyl group, 2-thienyl group, 2-pyrimidinyl group and 2-benzothiazolyl group; the heterocyclic oxy group preferably has a 5- to 7-membered heterocyclic ring, including 3,4,5,6-tetrahydropyranyl-2-oxy group and 1-phenyltetrazol-5-oxy group; the heterocyclic thio group is preferably a 5- to 7-membered heterocyclic thio group, including 2-pyridylthio group, 2-benzothiazolylthio group and 2,4-diphenoxy-1,3,5-triazole-6-thio group; the examples of the siloxy group include trimethylsiloxy group, triethylsiloxy group and dimethylbutylsiloxy group; the examples of the imido group include succinimido group, 3-heptadecylsuccinimido group, phthalimido group and glutarimido group; the examples of the spiro compound residue include spiro[3.3]heptan-1-yl; and the examples of the bridged hydrocarbon compound residue include bicyclo[2.2.1]heptan-1-yl, tricyclo[3.3.1.1$^{37}$]decan-1-yl and 7,7-dimethyl-bicylo[2.2.1]heptan-1-yl.

The examples of the group capable of splitting off by reaction with an oxidation product of the color developing agent represented by X include halogen atoms (e.g. chlorine atom, bromine atom, fluorine atom) and groups such as alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythiocarbonylthio, acylamino, sulfonamido, N-atom-bound nitrogen-containing heterocyclic ring, alkyloxycarbonylamino, aryloxycarbonylamino, carboxyl,

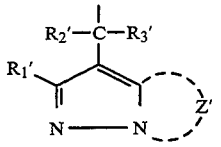

($R_1'$ has the same definition as R above; Z has the same definition as Z above; $R_2'$ and $R_3'$ independently represent a hydrogen atom, an aryl group, an alkyl group or a heterocyclic group), with preference given to halogen atoms, particularly a chlorine atom.

The examples of the nitrogen-containing heterocyclic ring formed by Z or Z' include pyrazole ring, imidazole ring, triazole ring and tetrazole ring. The examples of the substituent which these rings may have include those mentioned for R above.

The compounds represented by Formula [M-I] are more specifically represented by the following Formulas [M-II] through [M-VII].

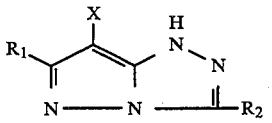

Formula [M-II]

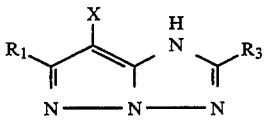

Formula [M-III]

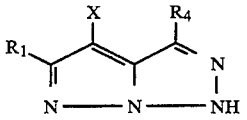

Formula [M-IV]

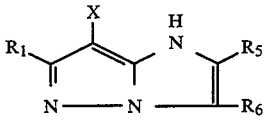

Formula [M-V]

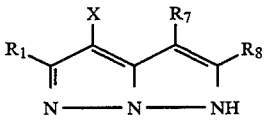

Formula [M-VI]

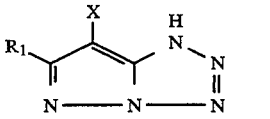

Formula [M-VII]

In the preceding Formulas [M-II] through [M-VII], R1 through R8 and X have the same definitions as R and X above.

Of the compounds represented by Formula [M-I], those represented by the following Formula [M-VIII] are preferable.

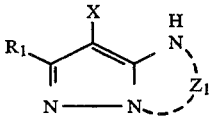

Formula [M-VIII]

wherein $R_1$, X and Z1 have the same definitions as R, X and Z in Formula [M-I].

Of the magenta couplers represented by the preceding Formulas [M-II] through [M-VII], those represented by Formula [M-II] are especially preferable.

For the substituents R and $R_1$ on the preceding heterocyclic ring, those represented by the following Formula [M-IX] are most preferable.

Formula [M-IX]

$$R9—CH_2—$$

wherein $R_9$ has the same definition as R above.

$R_9$ is preferably a hydrogen atom or an alkyl group.

For the substituent which may be contained in the ring formed by Z in Formula [M-I] and in the ring formed by Z1 in Formula [M-VIII], and R2 through R8 in Formulas [M-II] through [M-VI], those represented by the following Formula [M-X] are preferable.

Formula [M-X]

$$—R^1—SO_2—R^2$$

Wherein $R_1$ represents an alkylene group; R2 represents an alkyl group, a cycloalkyl group or an aryl group.

The alkylene group represented by $R_1$ preferably has a carbon number of 2 or more in the direct chain moiety, more preferably 3 to 6, whether normal or branched.

The cycloalkyl group represented by R2 is preferably a 5- or 6-membered one.

Typical examples of compounds represented by Formula [M-I] are given below.

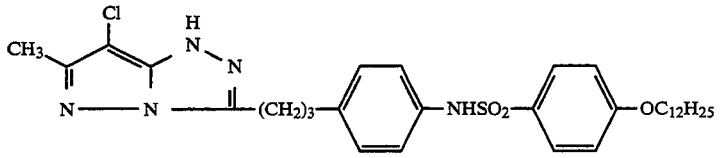

(M1-1)

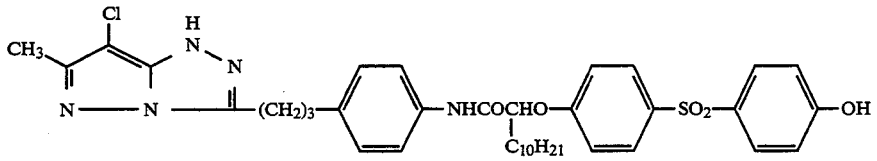

(M1-2)

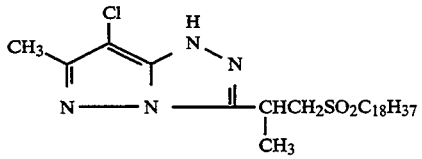

(M1-3)

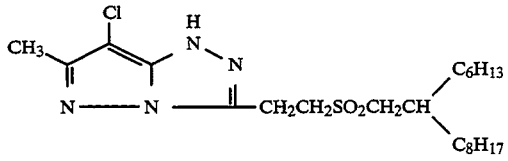

(M1-4)

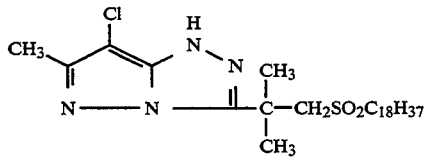

(M1-5)

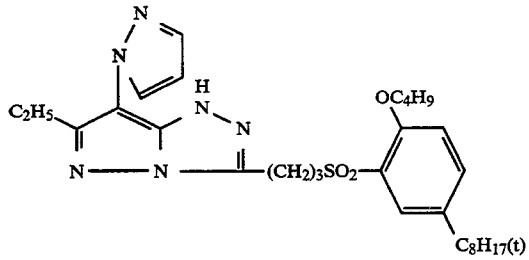

(M1-6)

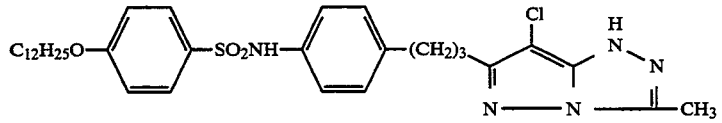

(M1-7)

-continued
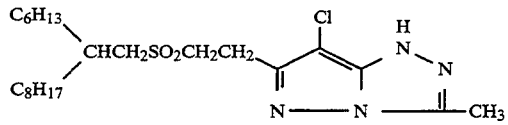
(M1-8)
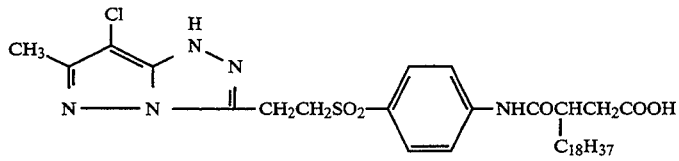
(M1-10)
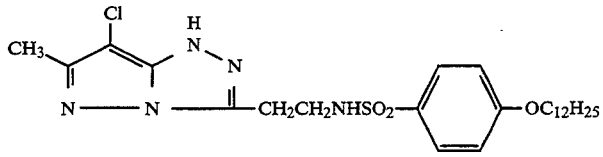
(M1-11)
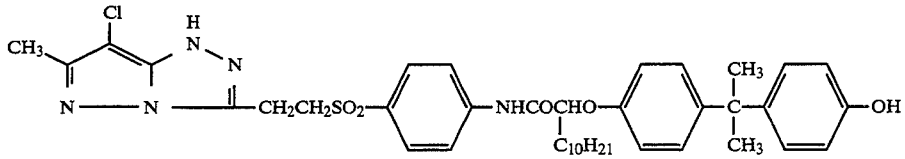
(M1-12)
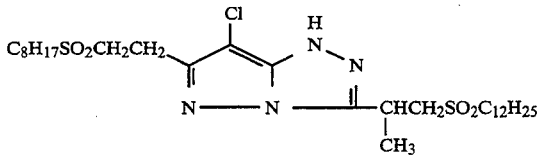
(M1-13)
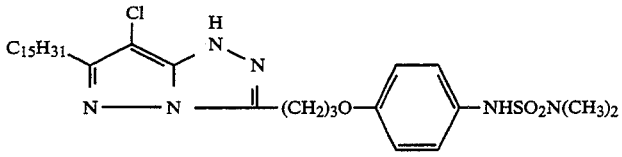
(M1-14)
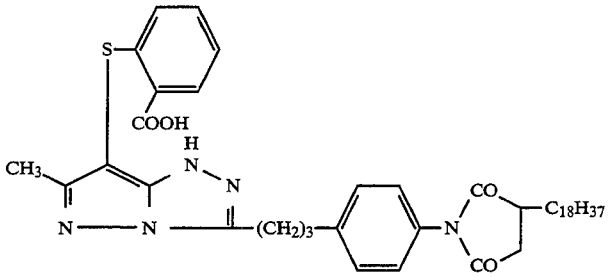
(M1-15)
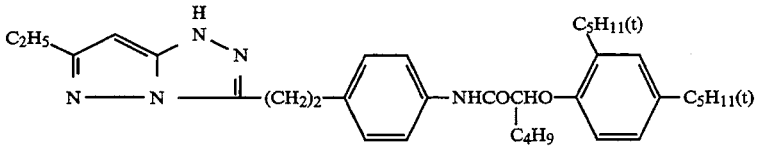
(M1-16)
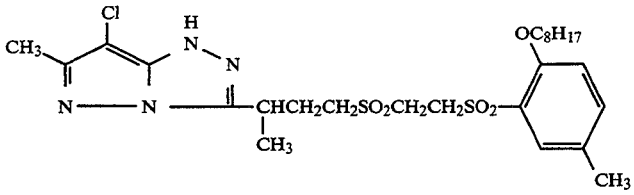

-continued
(M1-17)
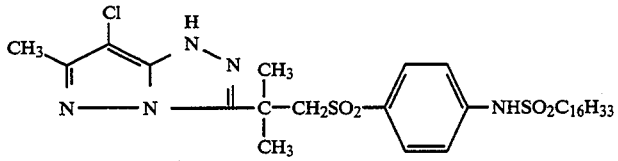
(M1-18)
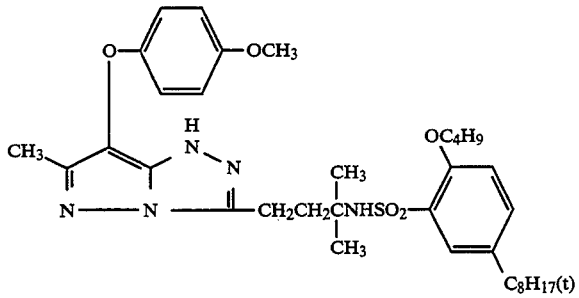
(M1-19)
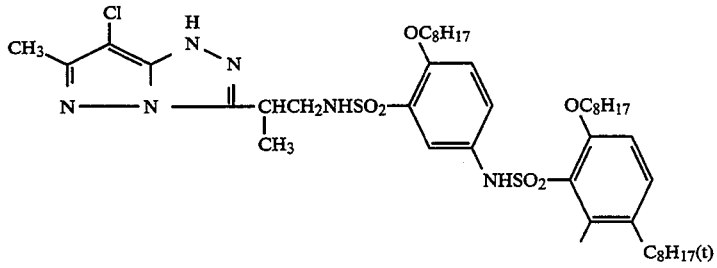
(M1-20)
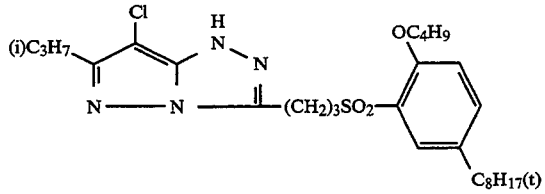
(M1-21)
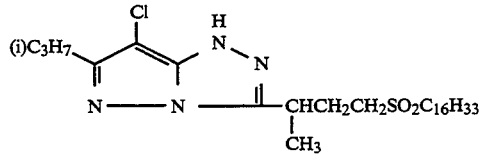
(M1-22)
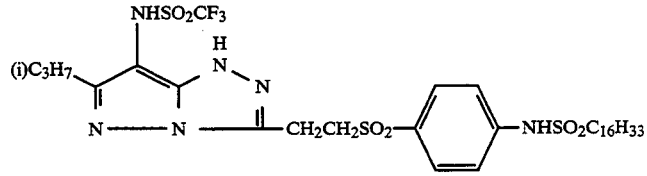
(M1-23)
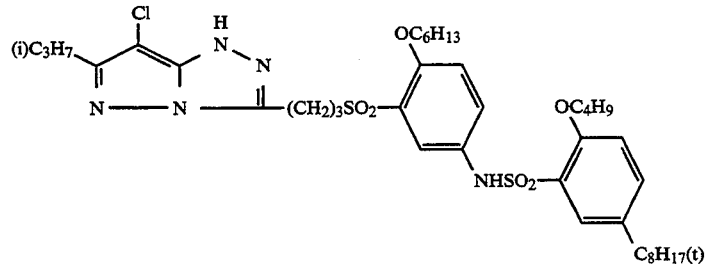

-continued
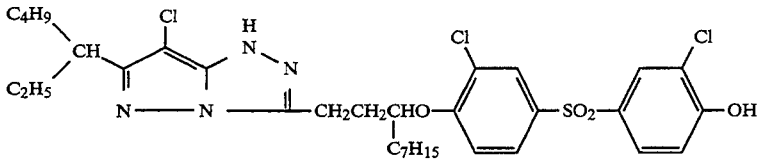
($M_1$-24)
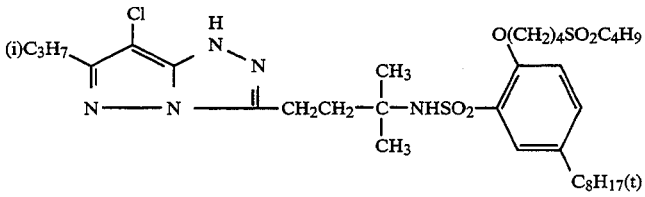
($M_1$-25)
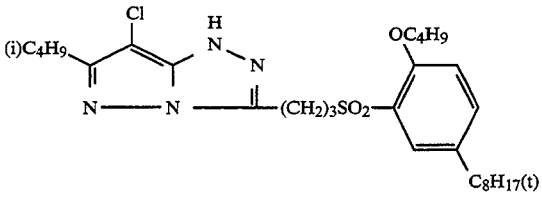
($M_1$-26)
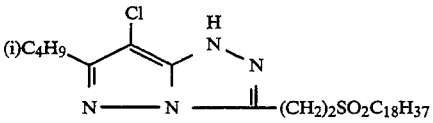
($M_1$-27)
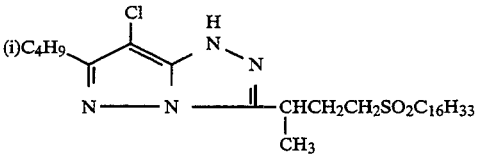
($M_1$-28)
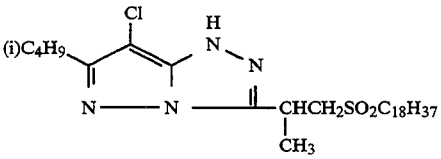
($M_1$-29)
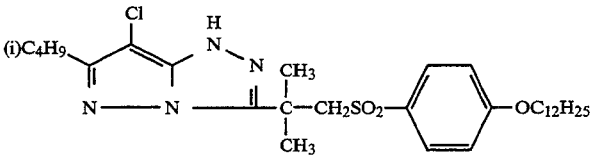
($M_1$-30)
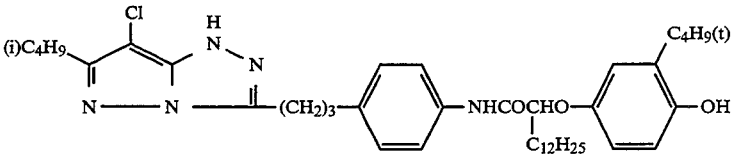
($M_1$-31)
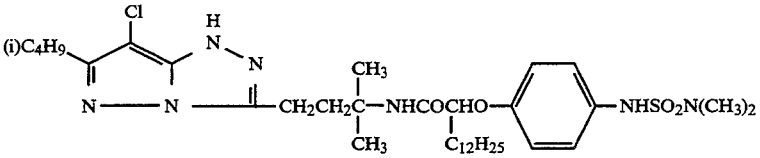
($M_1$-32)

-continued
(M1-33)
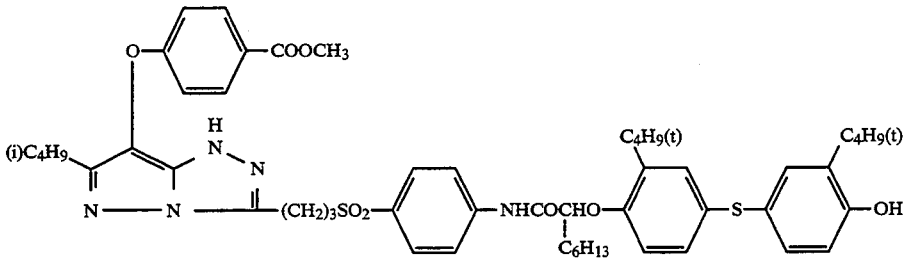
(M1-34)
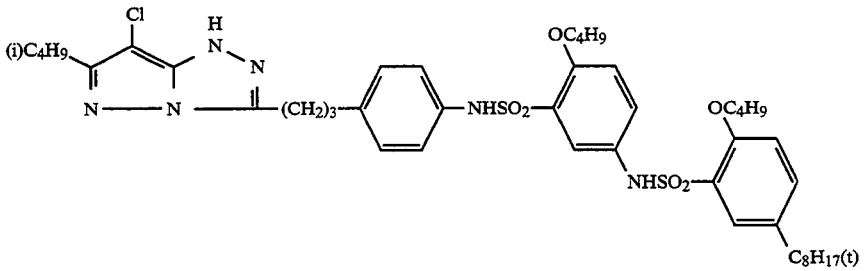
(M1-35)
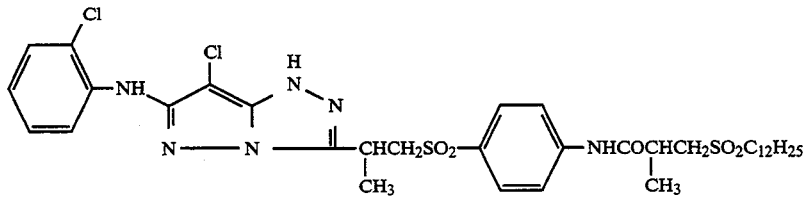
(M1-36)
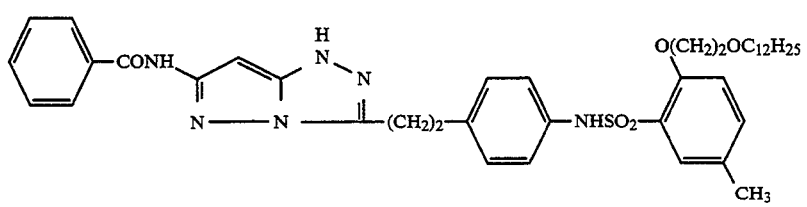
(M1-37)
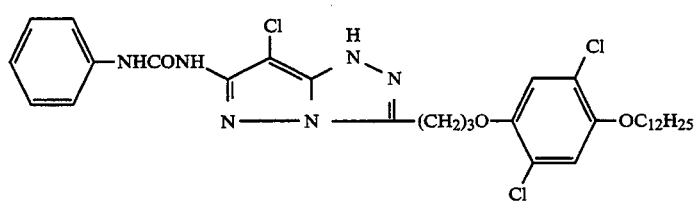
(M1-38)
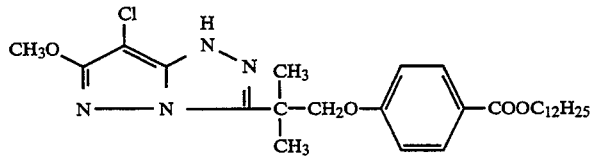
(M1-39)
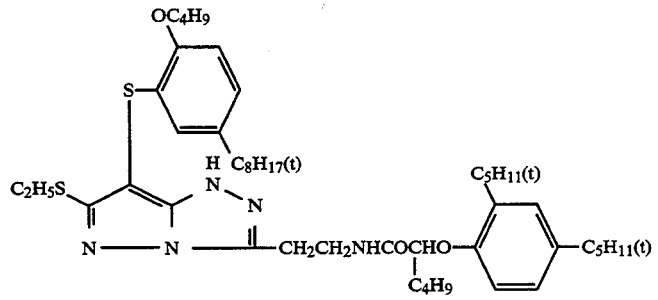

-continued
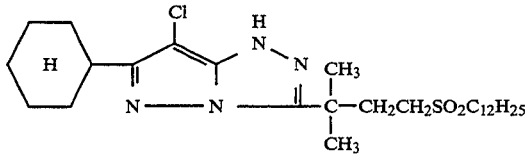
(M1-40)
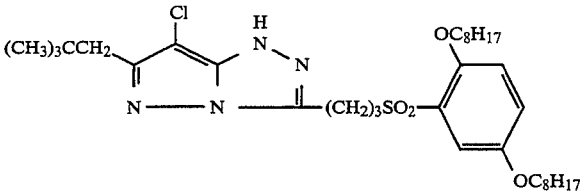
(M1-41)
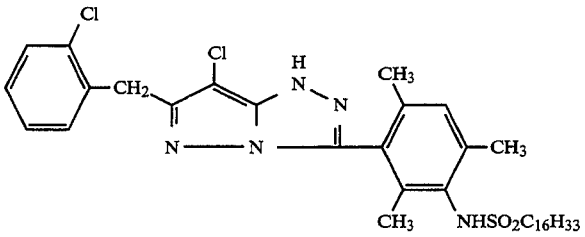
(M1-42)
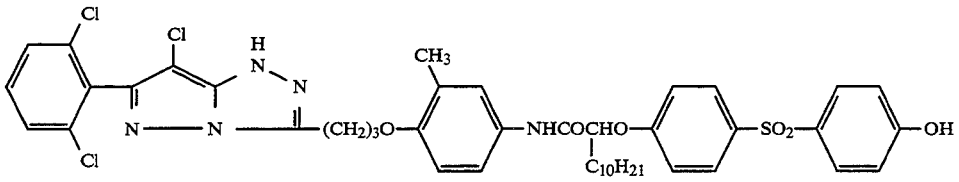
(M1-43)
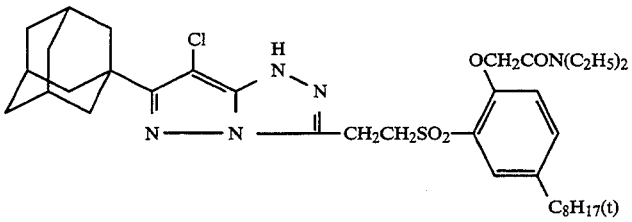
(M1-44)
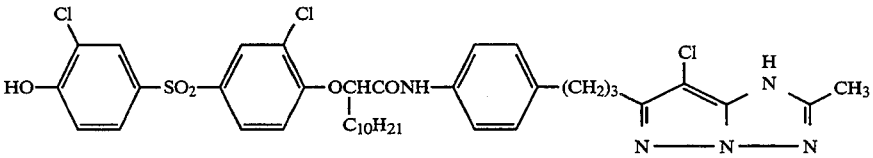
(M1-45)
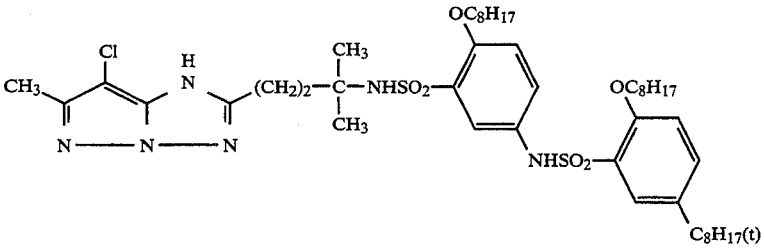
(M1-46)
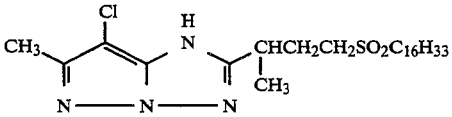
(M1-47)

-continued
(M1-48)
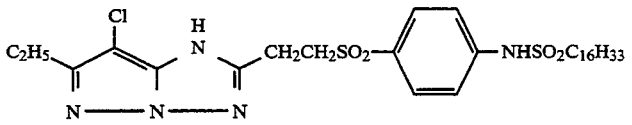
(M1-49)
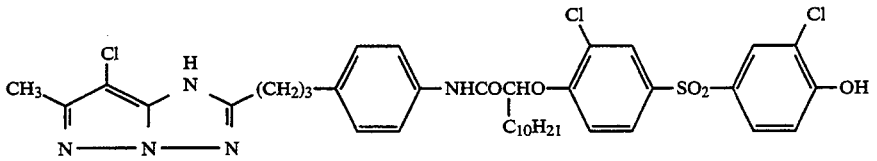
(M1-50)
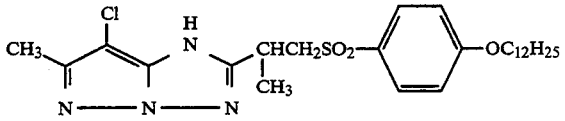
(M1-51)
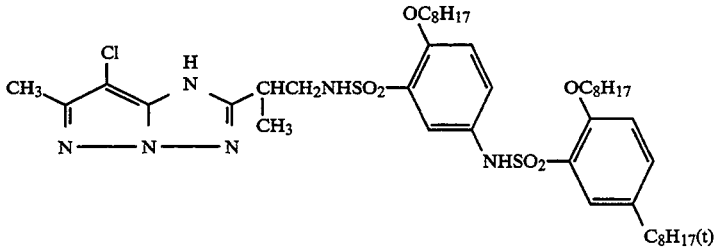
(M1-52)
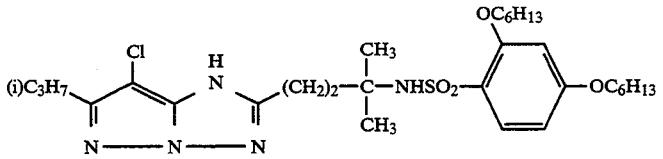
(M1-53)
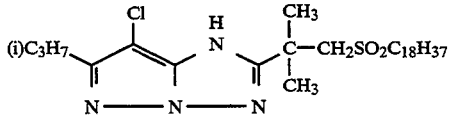
(M1-54)
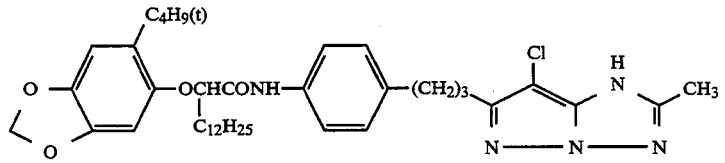
(M1-55)
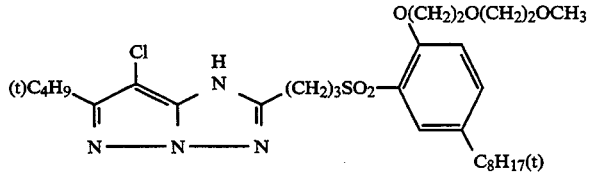
(M1-56)
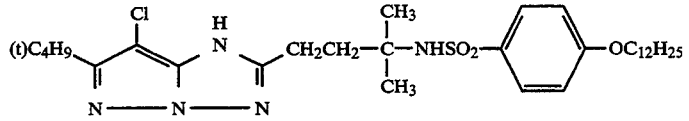
(M1-57)
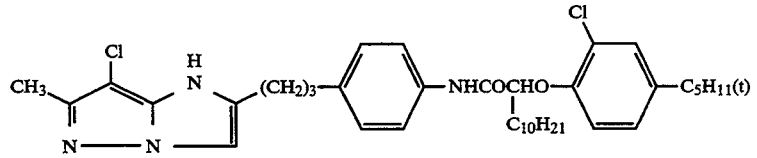

-continued (M1-58)

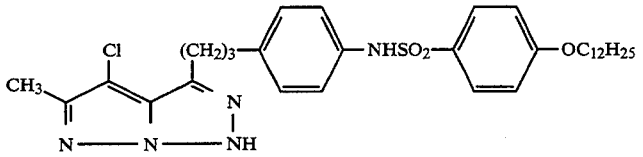

(M1-59)

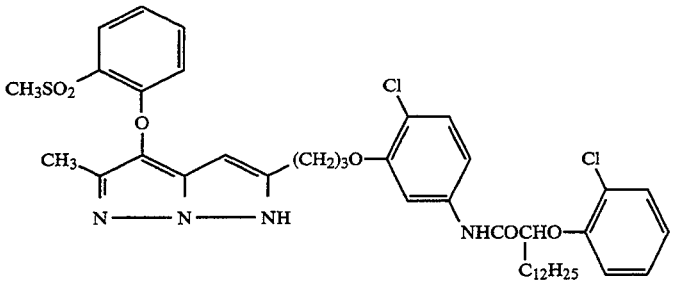

(M1-60)

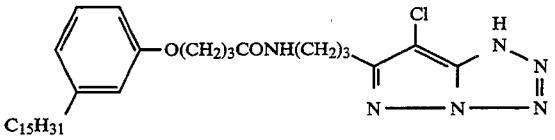

(M1-61)

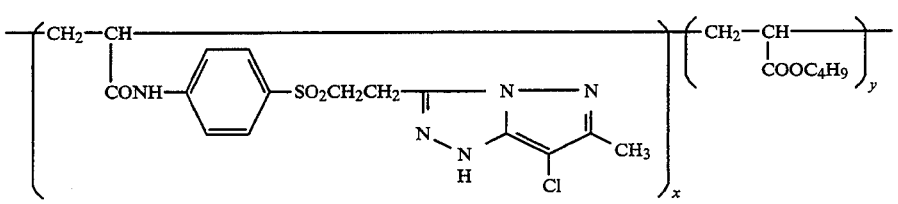

x:y = 50:50

(M1-62)

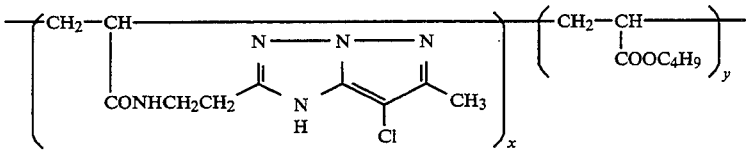

x:y = 50:50

The specific examples of the compounds represented by Formula [M-I ] include Compound Nos. 1-4, 6, 8-17, 19-43, 45-59, 61-104, 106-121, 123-162, and 164-223 among the compounds described in pp. 66–122 of the specification for Japanese Patent Application No. 9791/1986.

The preceding couplers can be synthesized in consultation with the Journal of the Chemical Society, Perkin I (1977), 2047–2052, U.S. Pat. No. 3,725,067, Japanese Patent Publication Open to Public Inspection Nos.99437/1984, 42045/1983, 162548/1984, 171956/1984, 33552/1985, 43659/1985, 172982/1985 and 190779/1985.

Formula [XI]

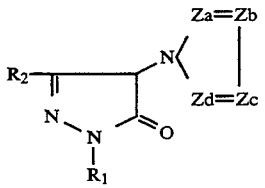

wherein $R_1$ represents an aromatic group, an aliphatic group or a heterocyclic group; R2 represents a substituent; Za, Zb, Zc and Zd independently represents a methine group, a substitued methine group, or —N=.

In Formula [XI], $R_1$ represents a normal or branched alkyl group having a carbon number of 1 to 32, preferably 1 to 22 (e.g. methyl group, isopropyl group, tert-butyl group, hexyl group, dodecyl group), an alkenyl group (e.g. allyl group), a cycloalkyl group (e.g. cyclopentyl group, cyclohexyl group, norbornyl group), an aralkyl group (e.g. benzyl group, β-phenylethyl group), or a cycloalkenyl group (e.g. cyclopentenyl group, cyclohexenyl group); these groups may be substituted by a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, or another group.

When $R_1$ represents an aryl group (e.g. phenyl group, α- or β-naphthyl group), the aryl group may have one or more substituents. The examples of the substituents include an alkyl group, an alkenyl group, a cycloalkyl group, an aralkyl group, a cycloalkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, an ureido group, an urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group and a mercapto group.

More preferable for $R_1$ is a phenyl group wherein at least one of the groups located at the ortho position are substituted by an alkyl group, an alkoxy group, a halogen atom, or another group, which is valuable because it causes less coloring of the couplers remaining in film layers due to light or heat.

Moreover, $R_1$ may represent a heterocyclic group (e.g. 5- or 6-membered heterocyclic ring and condensed ring containing at least one hetero atom selected from a nitrogen atom, an oxygen atom and a sulfur atom, such as pyridyl group, quinolyl group, furyl group, benzothiazolyl group, oxazolyl group, imidazolyl group, naphtoxazolyl group), a heterocyclic group substituted by a substituent mentioned as to the preceding aryl group, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group.

In the formula, $R_2$ represents any one of a hydrogen atom, a normal or branched alkyl group with a carbon number of 1 to 32, preferably 1 to 22, an alkenyl group, a cycloalkyl group, an aralkyl group, a cycloalkenyl group (these groups may have a substituent mentioned for $R_1$ above), an aryl group and a heterocyclic group (these groups may have a substituent mentioned for $R_1$ above), an alkoxycarbonyl group (e.g. methoxycarbonyl group, ethoxycarbonyl group, stearyloxycarbonyl group), an aryloxycarbonyl group (e.g. phenoxycarbonyl group, naphthoxycarbonyl group), an aralkyloxycarbonyl group (e.g. benzyloxycarbonyl group), an alkoxy group (e.g. methoxy group, ethoxy group, heptadecyloxy group), an aryloxy group (e.g. phenoxy group, tolyloxy group), an alkylthio group (e.g. ethylthio group, dodecylthio group), an arylthio group (e.g. phenylthio group, α-naphthylthio group), a carboxy group, an acylamino group (e-g- acetylamino group, 3-[(2,4-di-tert-aminophenoxy)acetamido]benzamido group), a diacylamino group, an N-alkylacylamino group (e.g. N-methylpropionamido group), an N-arylacylamino group (e.g. N-phenylacetamido group), a ureido group (e.g. ureido group, N-arylureido group, N-alkylureido group), a thioureido group (e.g. thioureido group, N-alkylthioureido group), an urethane group, a thiourethane group, an arylamino group (e.g. phenylamino group, N-methylanilino group, diphenylamino group, N-acetylanilino group, 2-chloro-5-tetradecanamidoanilino group), an alkylamino group (e.g. n-butylamino group, methylamino group, cyclohexylamino group), a cycloamino group (e.g. piperidino group, pyrrolidino group), a heterocyclic amino group (e.g. 4-pyridylamino group, 2-benzoxazolylamino group), an alkylcarbonyl group (e.g. methylcarbonyl group), an arylcarbonyl group (e.g. phenylcarbonyl group), a sulfonamido group (e.g. alkylsulfonamido group, arylsulfonamido group), a carbamoyl group (e.g. ethylcarbamoyl group, dimethylcarbamoyl group, N-methylphenylcarbamoyl group, N-phenylcarbamoyl group), a sulfamoyl group (e.g. N-alkylsulfamoyl group, N,N-dialkylsulfamoyl group, N-arylsulfamoyl group, N-alkyl-N-arylsulfamoyl group, N,N-diarylsulfamoyl group), an acyloxy group (e.g. benzoyloxy group), a sulfonyloxy group (e.g. benzenesulfonyloxy group), a cyano group, a hydroxy group, a mercapto group, a halogen atom, a nitro group, and a sulfo group.

With regard to Formula [XI], it is especially preferable that R2 is an anilino group, an acylamino group or an arylureido group and $R_1$ is an aryl group wherein at least one of the groups at the ortho position are substituted by a chlorine atom.

When Za, Zb, Zc and Zd in Formula [XI] represent a substituted methine group, the substituent is selected out of the substituents mentioned for R2 above.

The nitrogen-containing ring formed by Za, Zb, Zc and Zd may further form a condensation ring (e.g. condensation ring comprising a 5- or 6-membered ring containing two adjoining groups out of Za, Zb, Zc and Zd, preferably a hydrocarbon ring such as a cyclohexene ring, a cyclopentene ring, a benzene ring or a naphthalene ring, or a heterocyclic ring such as a pyridine ring, a pyrimidine ring, a dihydrofuran ring, or a dihydrothiophene ring, which may have the same substituent mentioned for R2 above. Za through Zd may be identical or not (except for benzotriazolyl-1 and benzotriazolyl-2). The couplers especially preferable for the present invention are those represented by Formula [I] wherein:

(1) Za, Zb, Zc and Zd in

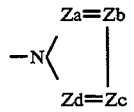

represent a monocyclic nitrogen-containing aromatic heterocyclic 5-membered ring comprising members selected from a methine group, a substituted methine group and —N=, or

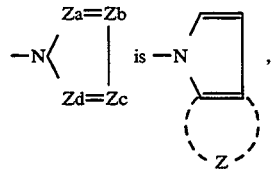

-continued

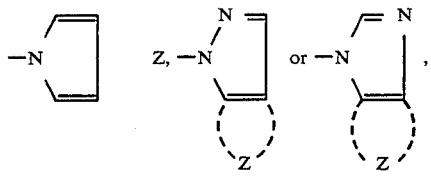

wherein Z represents a group of nonmetallic atoms constituting a 5- or 6-membered ring. Here, the substituted methine group is identical with that in the case of Formula [I ], and

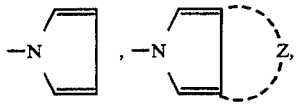

Z

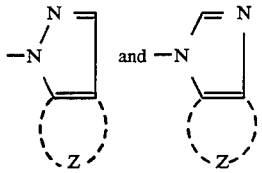

have the same substituent as that for the substituted methine group. The 5- or 6-membered condensation ring moiety formed by Z is identical with that in the case of Formula [I].

The examples of preferable nitrogen-containing heterocyclic groups represented by

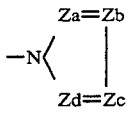

include 1-imidazolyl, 2-methyl-1-imidazolyl, 2-methylthio-1-imidazolyl, 2-ethylthio-l-imidazolyl, 2,4-dimethyl-1-imidazolyl, 4-methyl-1-imidazolyl, 4-nitro-1-imidazolyl, 4-chloro-1-imidazolyl, 4-phenyl-1-imidazolyl, 4-acetyl-1-imidazolyl, 4-tetradecanamido-1-imidazolyl, 1-pyrrolyl, 3,4-dichloro-1-pyrrolyl, 2-isoindolyl, 1-indolyl, 1-pyrazolyl, 1-benzimidazolyl, 5-bromo-1-benzimidazolyl, 5-octadecanamido-1-benzimidazolyl, 2-methyl-1-benzimidazolyl, 5-methyl-1-benzimidazolyl, 7-purinyl, 2-indazolyl, 1,2,4-4-triazolyl, 1,2,3-1-triazolyl and 1-tetrazolyl groups.

The compound represented by Formula [XI] may link to the main chain of a polymer at $R_1$, R2 or the

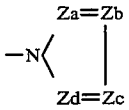

moiety, like the compounds described in, for example, Japanese Patent Publication Open to Public Inspection Nos. 94752/1982 and 224352/1983 and Japanese Patent Application No.145332/1983.

Some specific examples of preferable compounds represented by Formula [XI] are given below, but the present invention is not by any means limited by these examples.

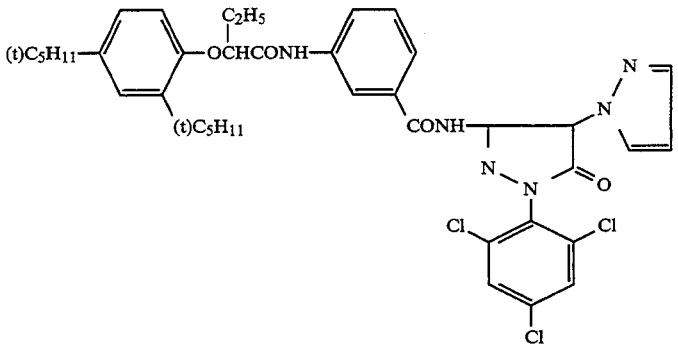

($M_2$-1)

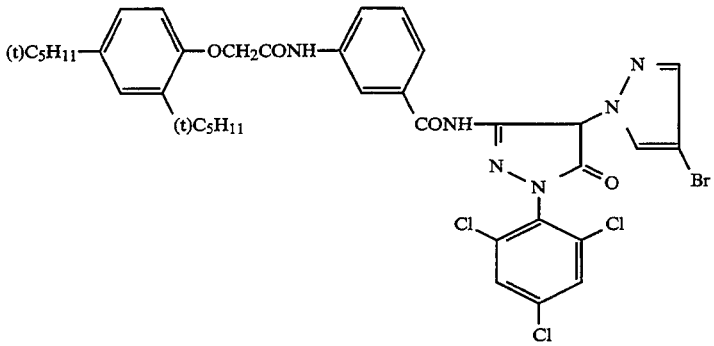

($M_2$-2)

-continued
(M2-3)
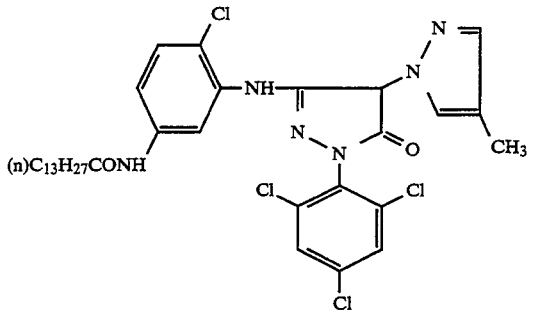
(M2-4)
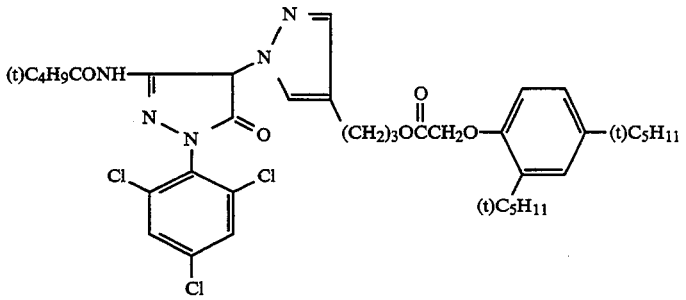
(M2-5)
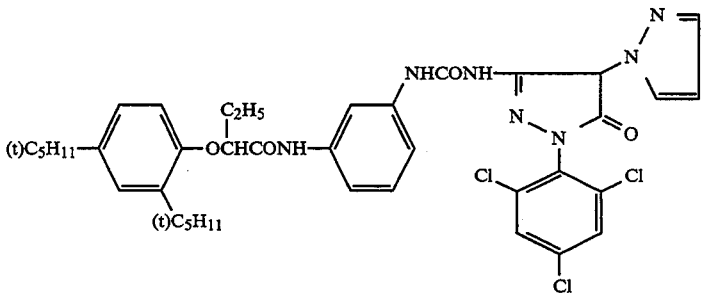
(M2-6)
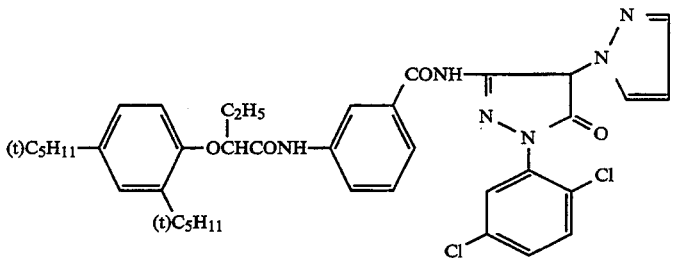
(M2-7)
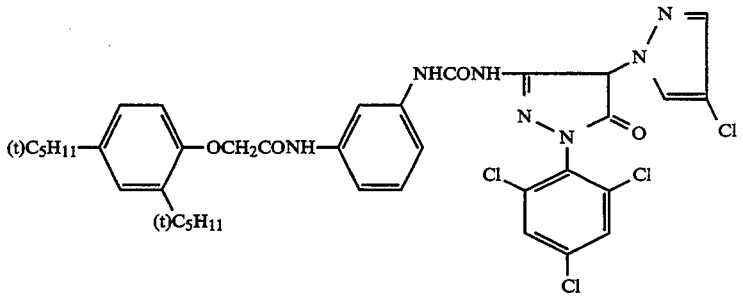

-continued
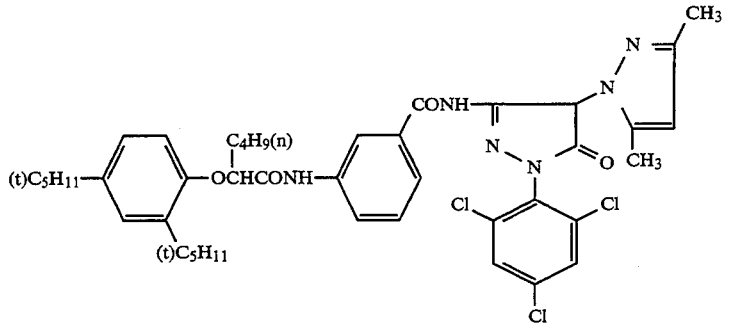
($M_2$-8)
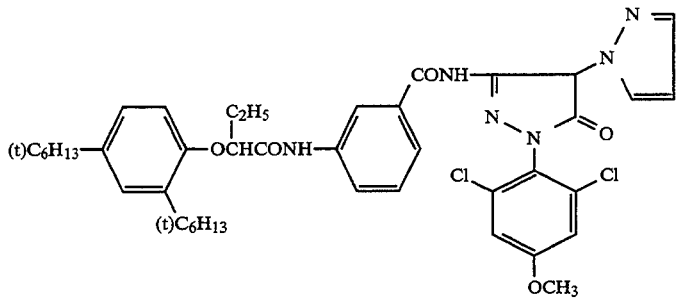
($M_2$-9)
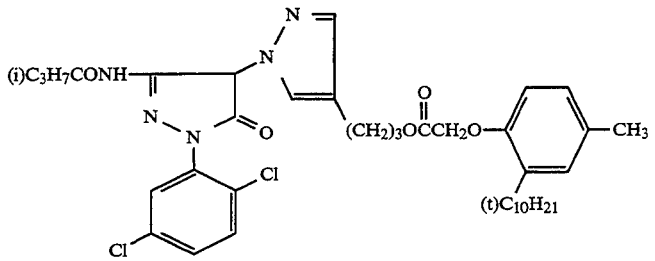
($M_2$-10)
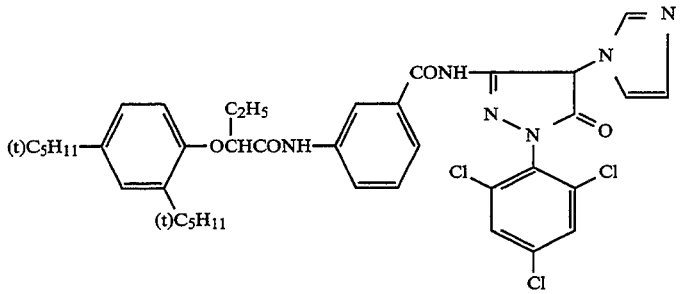
($M_2$-11)
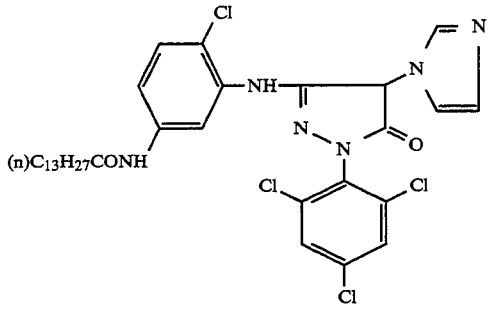
($M_2$-12)

-continued
(M2-13)
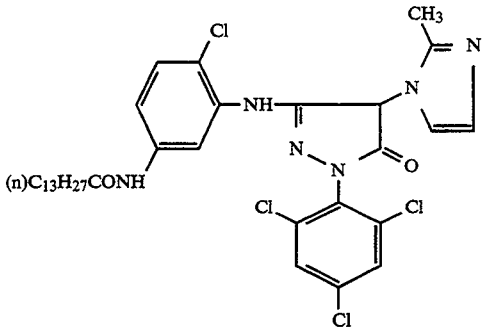
(M2-14)
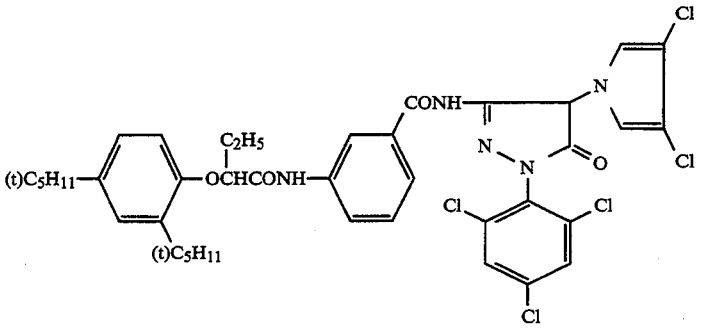
(M2-15)
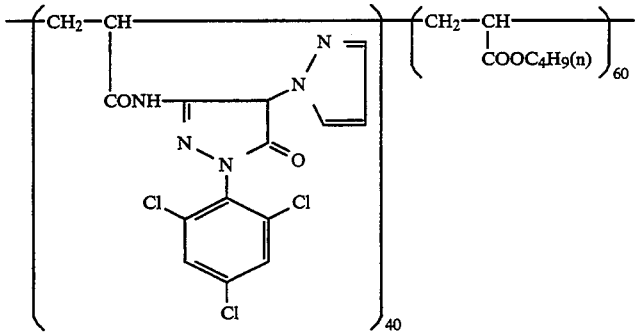
(M2-16)
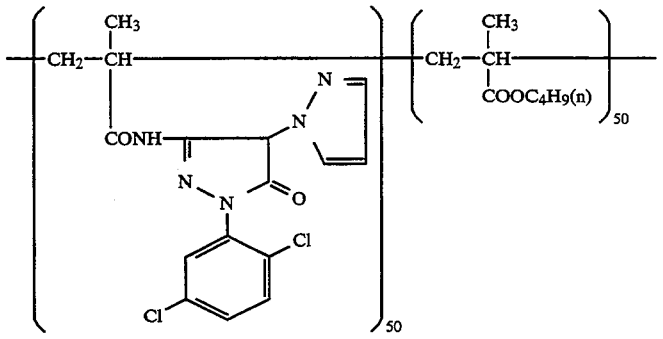
(M2-17)
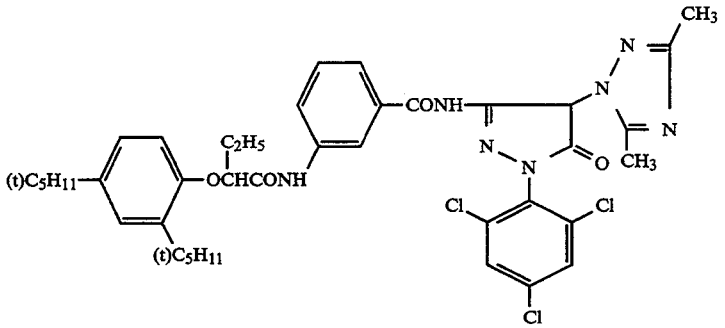

-continued
(M2-18)
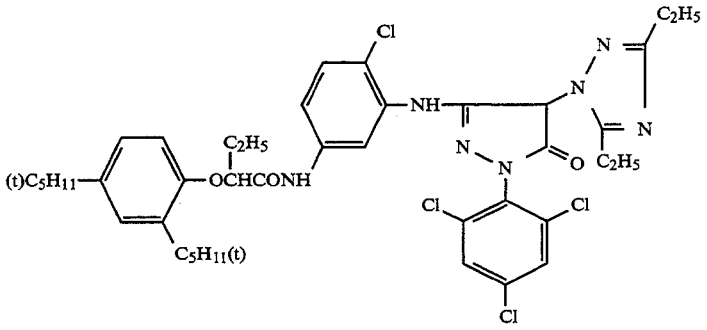
(M2-19)
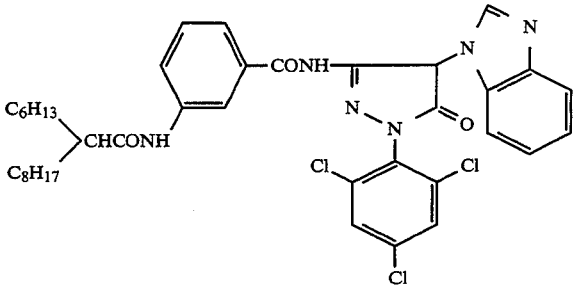
(M2-20)
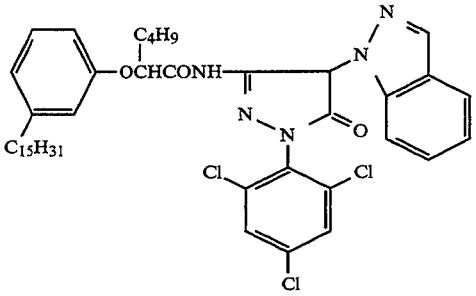
(M2-21)
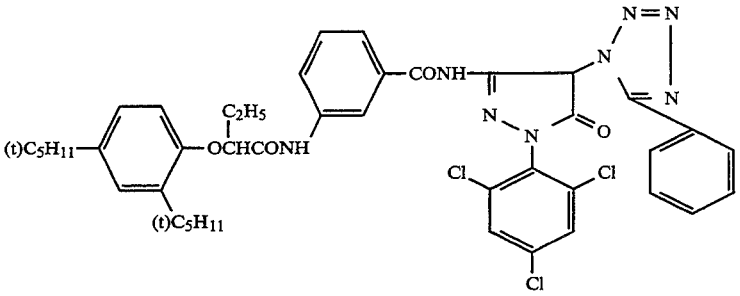
(M2-22)
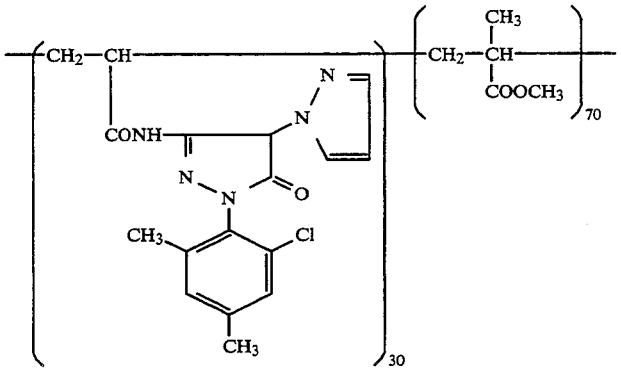

-continued
(M2-23)
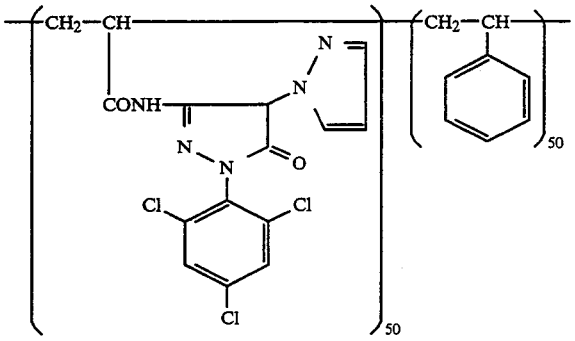
(M2-24)
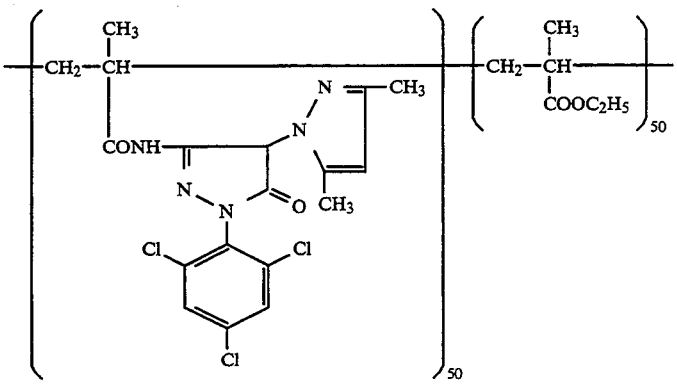
(M2-25)
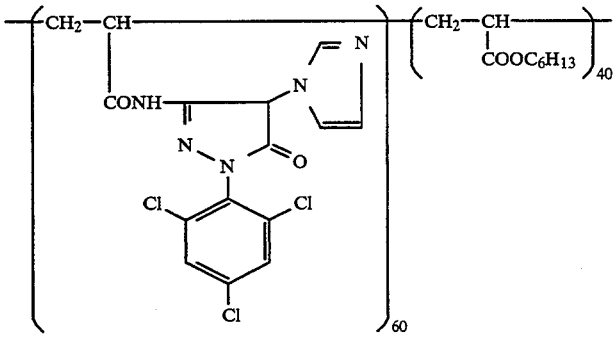
(M2-26)
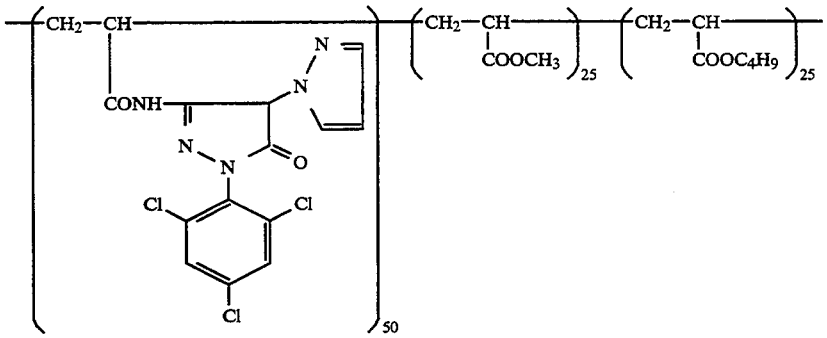

-continued
(M2-27)
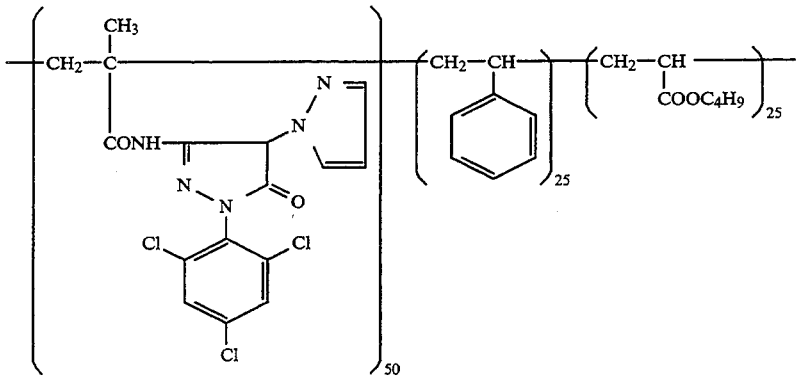
(M2-28)
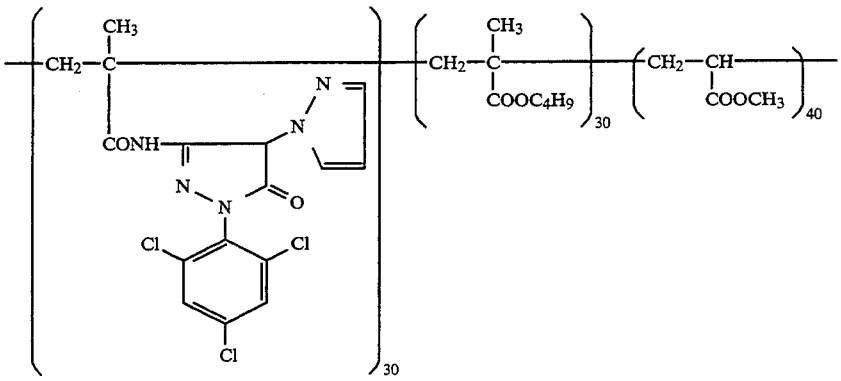
(M2-29)
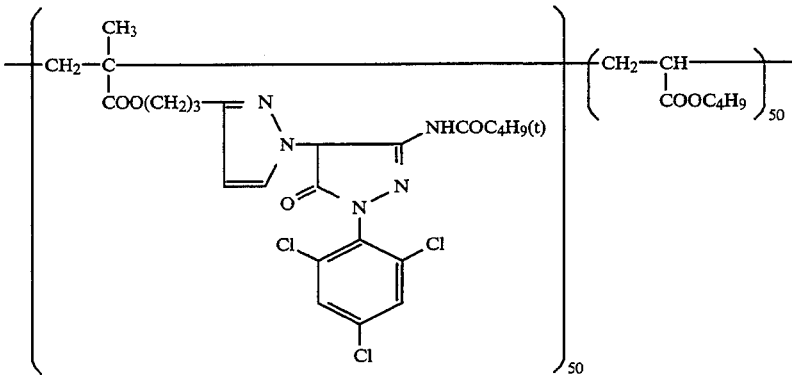
(M2-30)
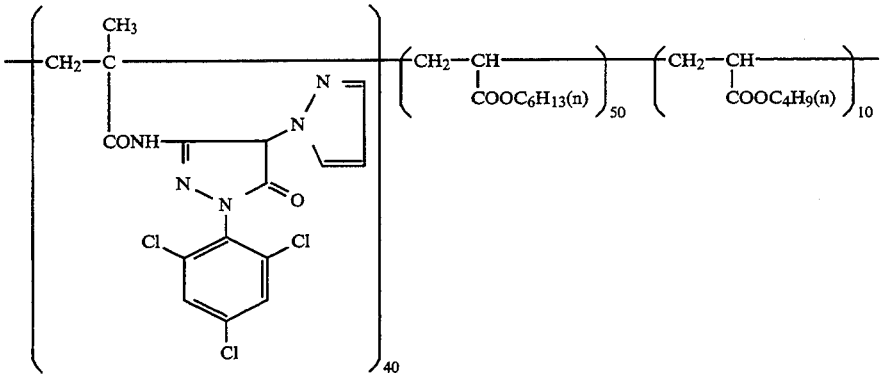

-continued
(M2-31)
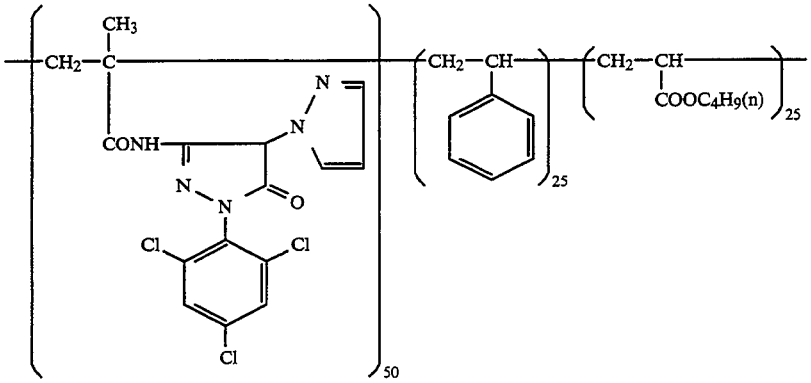
(M2-32)
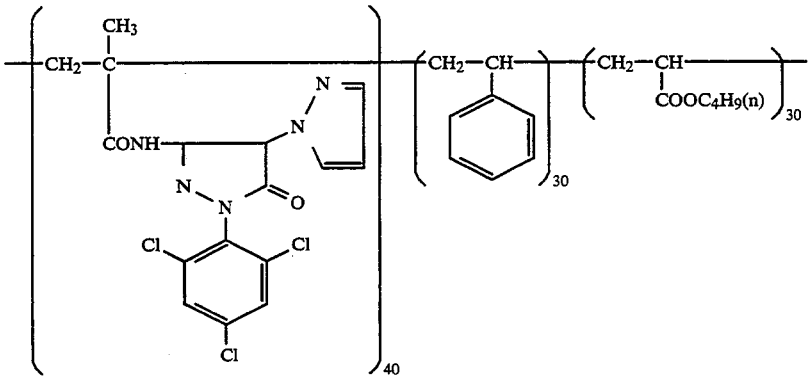
(M2-33)
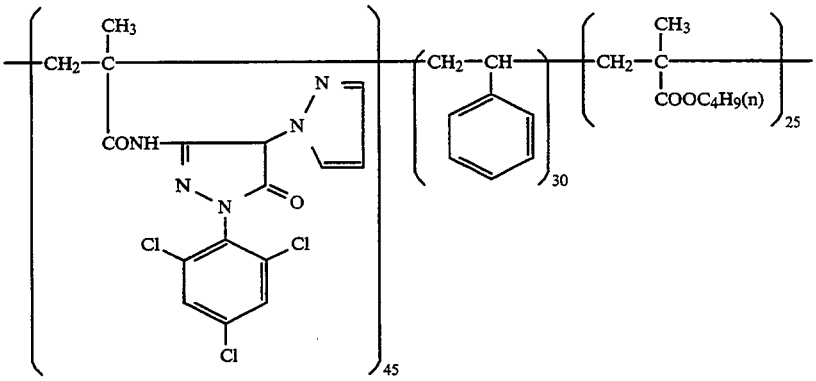
(M2-34)
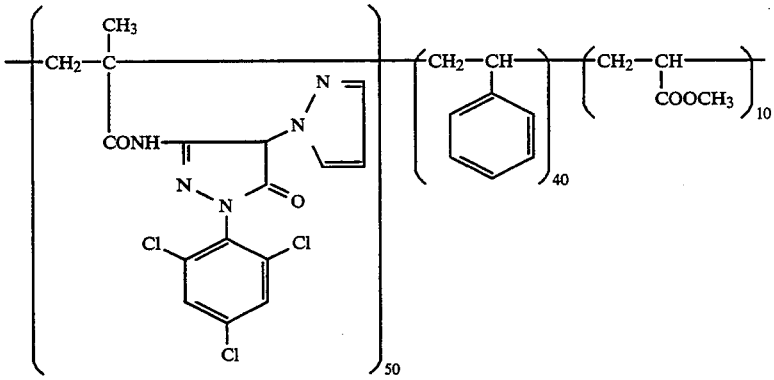

-continued (M2-35)

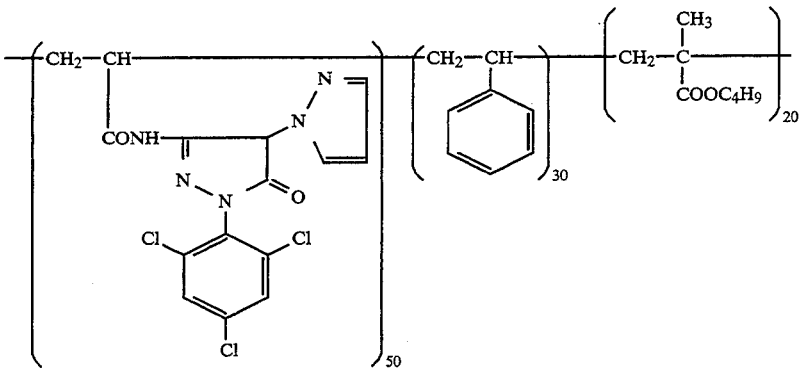

(M2-36)

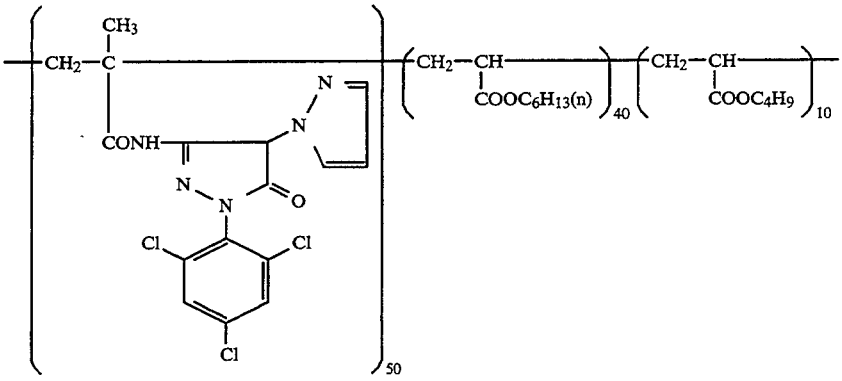

(The subscripts attached to (M2-22) through (M2-36) represent % ratios by weight.)

These compounds can be synthesized by the methods described in, for example, Japanese Patent Publication Open to Public Inspection Nos.20826/1976, 118034/1980, 38043/1981, 38044/1981, 40825/1981 and 95752/1982.

The couplers of Formula [M-1] and [M-XI] can be used in amounts of $1\times10^{-3}$mol to 1 mol per liter silver halide, preferable $1\times10^{-2}$ mol to $8\times10^{-1}$ mol/l.

The couplers of Formula [M-1] and [M-XI] can be used in combination with other types of magenta couplers.

Formula [C-1]

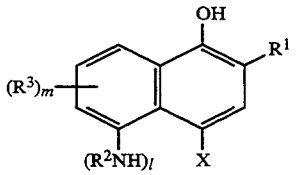

wherein $R_1$ represents —$CONR^4R^5$, —$NHCOR^4$, —$NHCOOR^6$, —$NHSO_2R^6$, —$NHCONR^4R^5$ or —$NHSO_2NR^4R^5$; $R^2$ and $R^3$ independently represent a hydrogen atom or a substituent; X represents a group capable of splitting off by reaction with an oxidation product of aromatic primary amine-based developing agent; 1 represents 0 or 1; m represents an integer of 0 to 3. $R^4$ and $R^5$ independently represent a hydrogen atom, an aromatic group, an aliphatic group, or a heterocyclic group; R6 represents an aromatic group, an aliphatic group or a heterocyclic group. When m is 2 or 3, the R3 units may be identical or not, and may bind with each other to form a ring. Also, $R^4$ and $R^5$, $R^2$ and $R^3$, and R2 and X independently combine together to form a ring. Note that when 1 is 0, m represents 0 and $R^1$ represents —$CONHR^7$. $R^7$represents an aromatic group. The groups represented by $R^2$ through $R^7$ above include those having a substituent.

The compounds represented by Formula [C-1] are described in detail below.

$R^6$ is preferably an aliphatic group with a carbon number of 1 to 30, an aromatic group with a carbon number of 6 to 30, or a heterocyclic group with a carbon number of 1 to 30. $R^4$ and $R^5$ are each preferably a hydrogen atom or one of the groups mentioned for R6.

$R^2$ is preferably a-hydrogen atom bound directly or via CO or $SO_2$ to NH, an aliphatic group with a carbon number of 1 to 30, an aromatic group with a carbon number of 6 to 30, a heterocyclic group with a carbon number of 1 to 30, —$OR^8$,

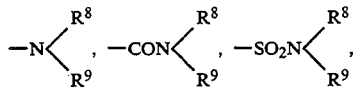

—$CO_2R^{10}$, —$SO_2R^{10}$—$PO(OR^{10})_2$, —$PO(R^{10})_2$ or —$SO_2OR^{10}$ ($R^8$, $R^9$ and $R^{10}$ independently have the same definition as $R^4$, $R^5$ and $R^6$ above; $R^8$ and $R^9$ may combine with each other to form a heterocycle). The substituents represented by $R^2$ include those having a substituent. $R^7$ is preferably an aromatic group with a carbon number of 6 to 30. The typical examples of the substituent for R7 include a halogen atom, a hydroxyl group, an amino group, a carboxyl group, a sulfo group, a cyano group, an aromatic group, a heterocyclic group, a carbonamido group, a sulfonamido group, a carbamoyl group, a sulfamoyl group, an ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, an imido group, an aliphatic group and an aliphatic oxycarbonyl group. When $R^7$ is substituted by a number of substituents, the substituents may bind with each other to form a ring, such as a dioxymethylene group.

The typical examples of the group for $R^3$ include a halogen atom, a hydroxyl group, an amino group, a carboxyl group, a sulfo group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group and an imido group. It is preferable that the number of carbon atoms contained in $R^3$ be 0 to 30. When m is 2, the examples of the cyclic group for $R^3$ include a dioxymethylene group.

When 1 is 1, $—CONR^4R^5$ is especially preferable for $R^1$; m is preferably 0; $R^2$ is especially preferably $—COR^8$, $—COOR^{10}$, $—SO_2R^{10}$, $—CONR^8R^9$ or $—SO_2NR^8R^9$ in direct bond to NH, more preferably $—COOR^{10}$, $—COR^8$ or $—SO_2R^{10}$ in direct bond to NH, and ideally $—COOR^{10}$.

Those which form a dimer or a higher polymer via $R_1$ through $R^3$ and X are also included in Formula [C-I].

When 1=m=0, X preferably contains no development inhibiting moiety.

Specific examples of the couplers represented by Formula [C-I] are given in, for example, Japanese Patent Publication Open to Public Inspection Nos. 237448/1985, 153640/1986, 145557/1986, 85242/1987, 15529/1973, 117422/1975, 18315/1977, 90932/1977, 52423/1978, 48237/1979, 66129/1979, 32071/1980, 65957/1980, 105226/1980, 1938/1981, 12643/1981, 27147/1981, 126832/1981 and 95346/1983 and U.S. Pat. No. 3,488,193. These couplers can be synthesized by the methods described in these references.

The coupler represented by Formula [C-I] can be used in combination with other cyan couplers. In this case, it is preferable that the ratio of the coupler represented by Formula [C-I] be not less than 10 mol%.

Typical examples of the coupler represented by Formula [C-I] are given below.

C-I-1

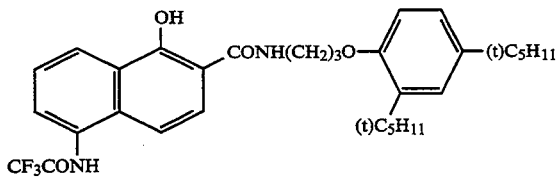

C-I-2

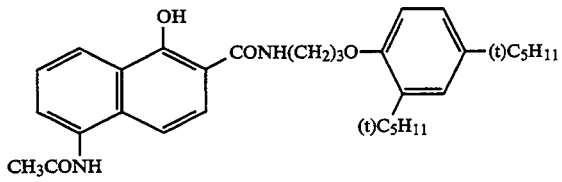

C-I-3

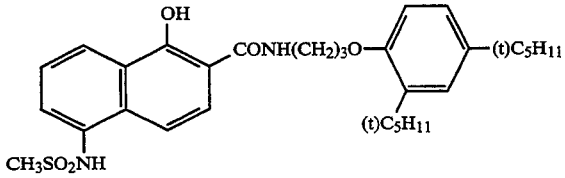

C-I-4

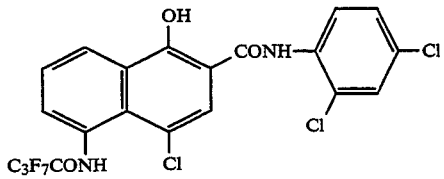

C-I-5

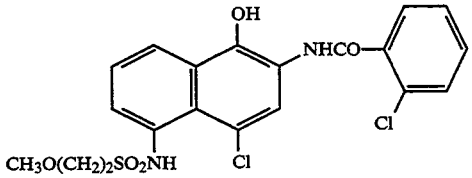

-continued
C-I-6
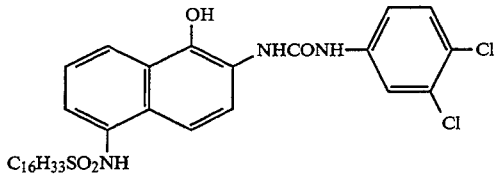
C-I-7
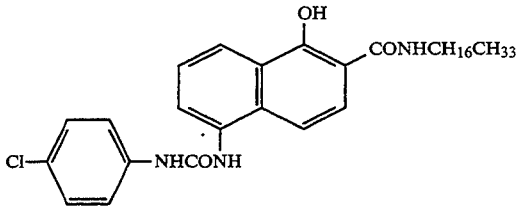
C-I-8
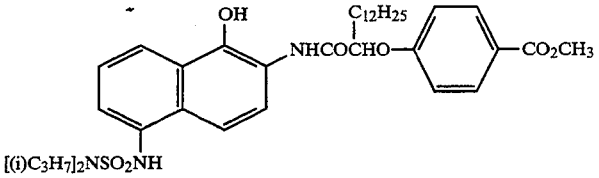
C-I-9
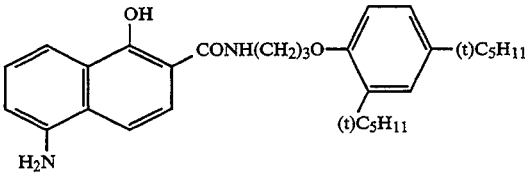
C-I-10
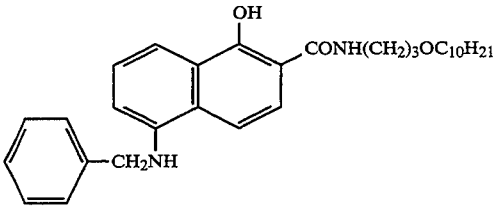
C-I-11
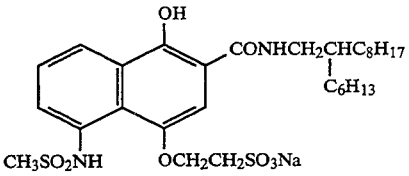
C-I-12
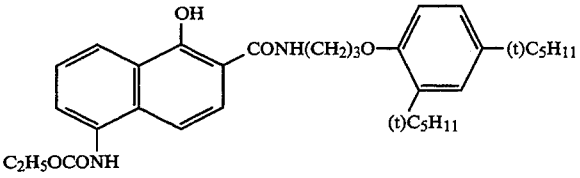
C-I-13
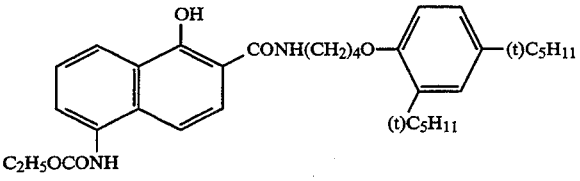

-continued
C-I-14
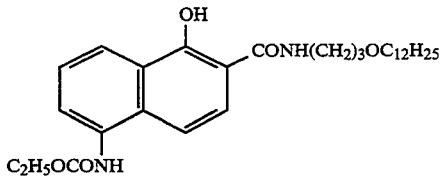
C-I-15
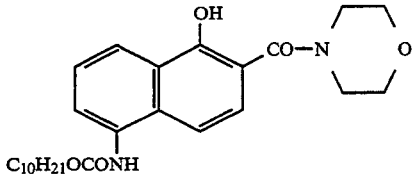
C-I-16
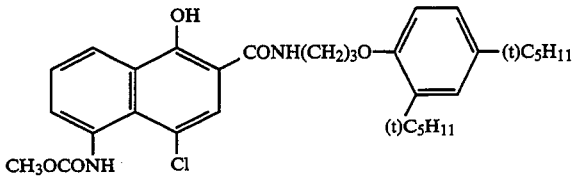
C-I-17
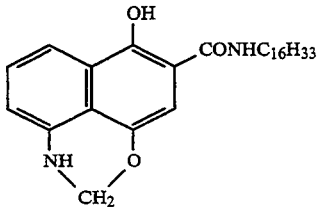
C-I-18
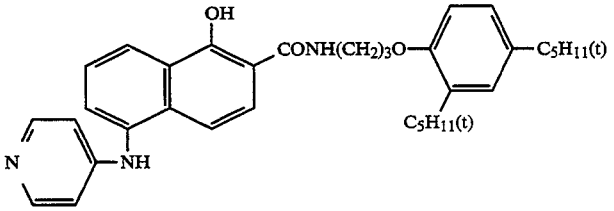
C-I-19
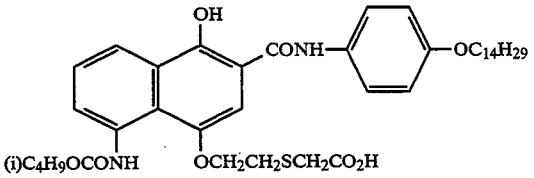
C-I-20
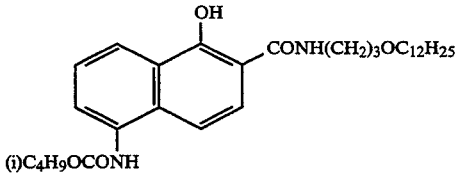
C-I-21
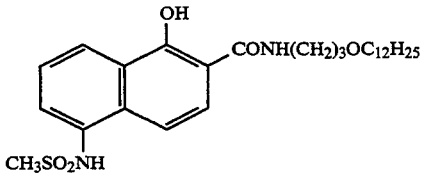

-continued
C-I-22
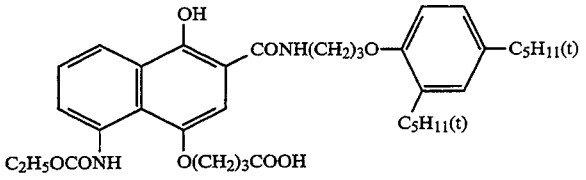
C-I-23
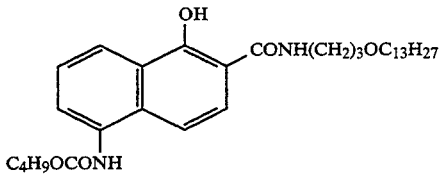
C-I-24
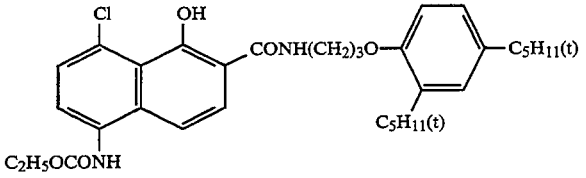
C-I-25
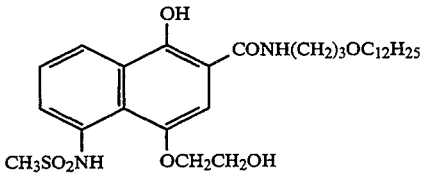
C-I-26
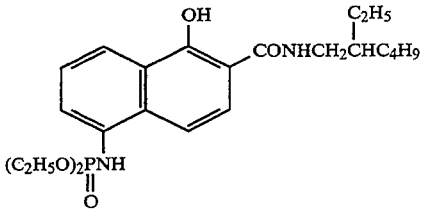
C-I-27
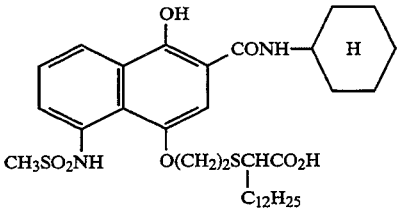
C-I-28
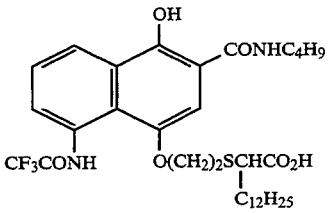
C-I-29
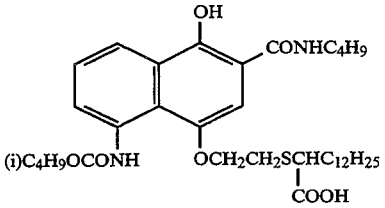

-continued
C-I-30
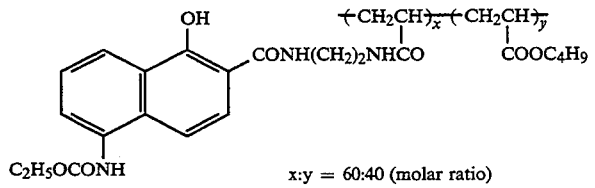
x:y = 60:40 (molar ratio)
C-I-31
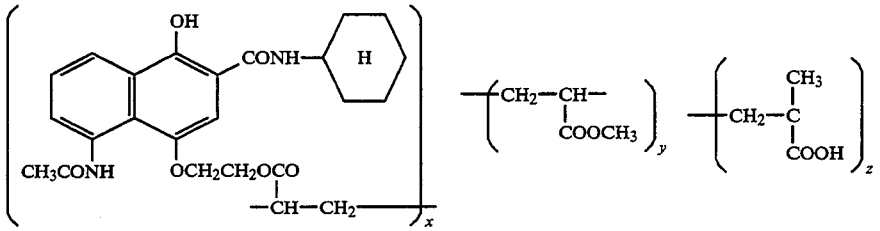
x:y:z = 5:4:1 (wt. ratio)
C-I-32
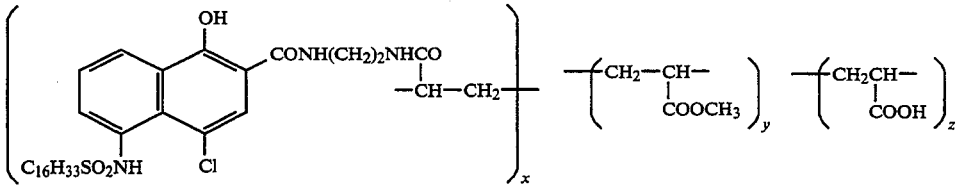
x:y:z = 67:26:7 (wt. ratio)
C-I-33
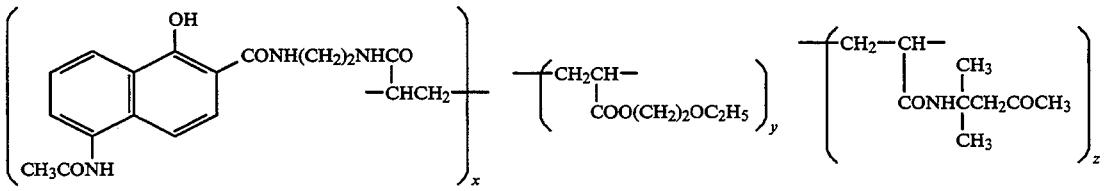
x:y:z = 2:1:1 (wt. ratio)
C-I-34
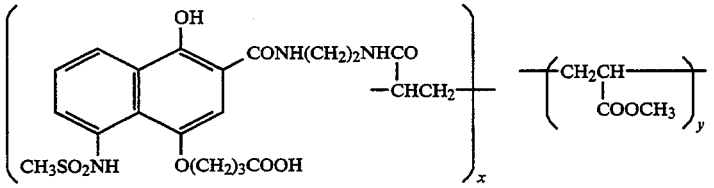
x:y = 1:4 (wt. ratio)
C-I-35
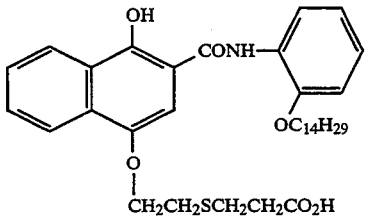
C-I-36
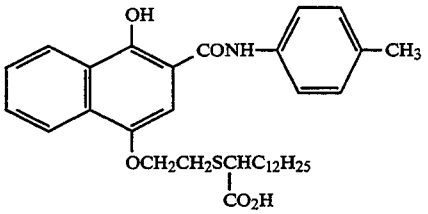

-continued
C-I-37
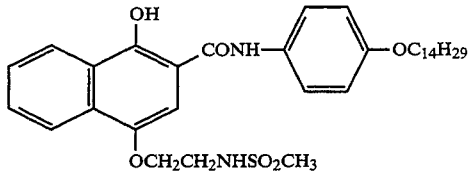
C-I-38
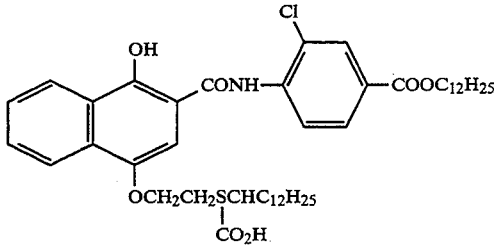
C-I-39
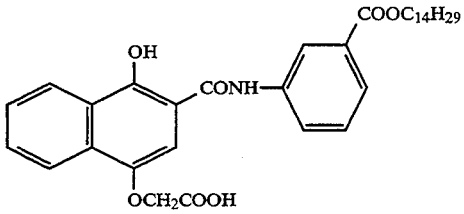
C-I-40
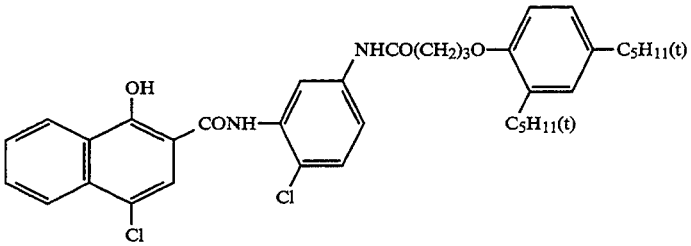
C-I-41
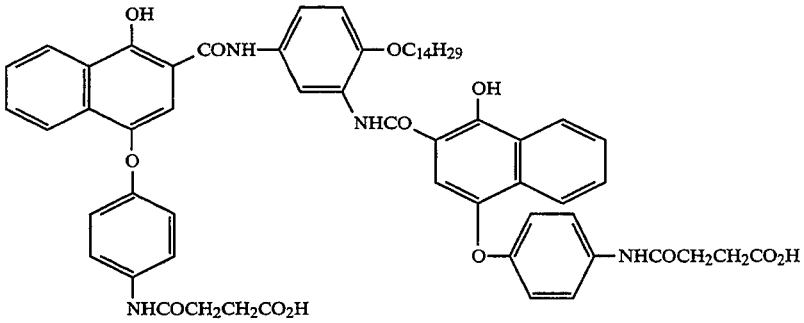
C-I-42
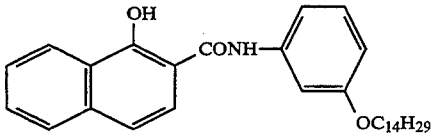
C-I-43
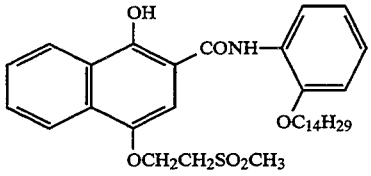

-continued
C-I-44
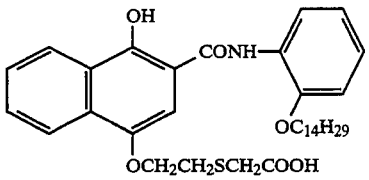
C-I-45
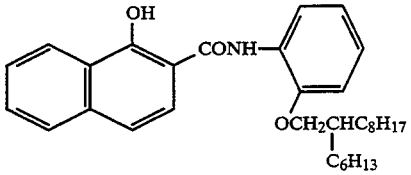
C-I-46
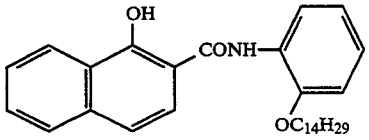
C-I-47
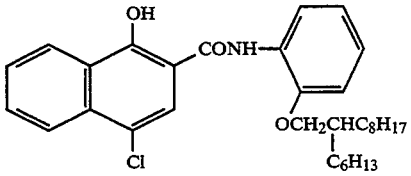
C-I-48
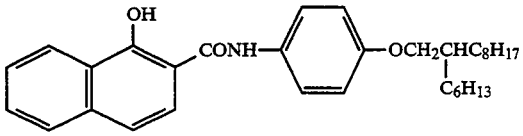
C-I-49
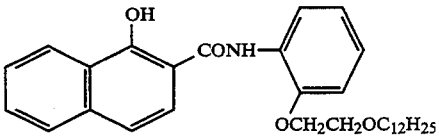
C-I-50
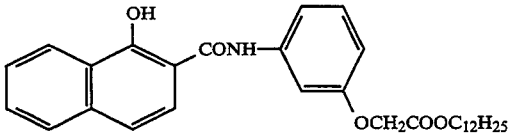
C-I-51
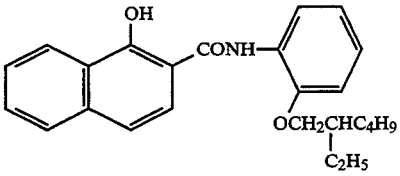
C-I-52
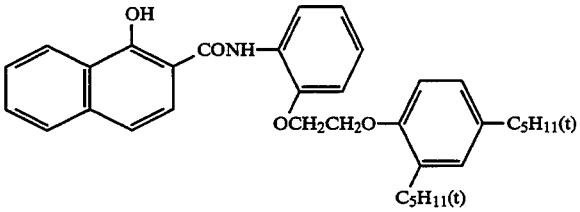

-continued
C-I-53
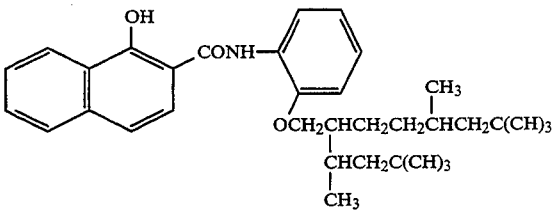
C-I-54
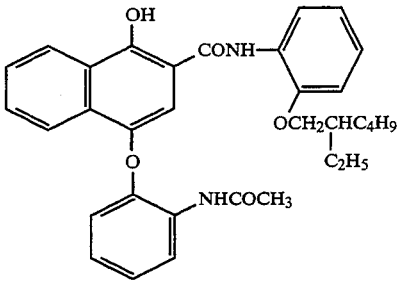
C-I-55
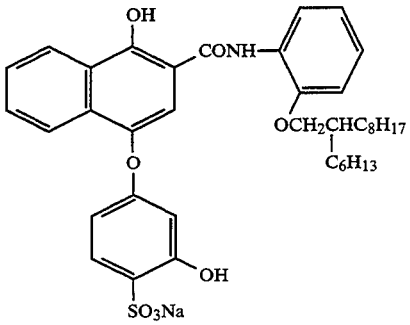
C-I-56
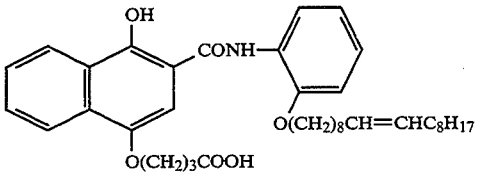
C-I-57
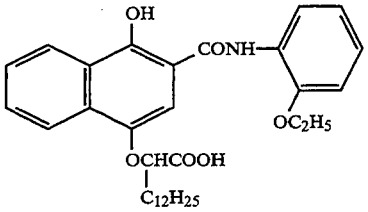
C-I-58
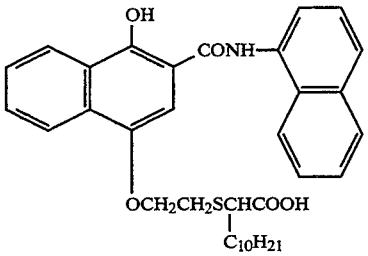

-continued
C-I-59
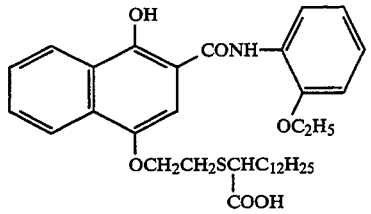
C-I-60
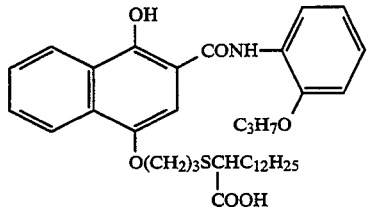
C-I-61
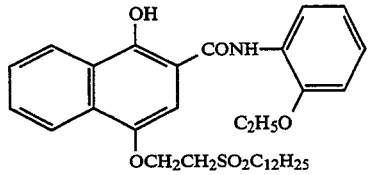
C-I-62
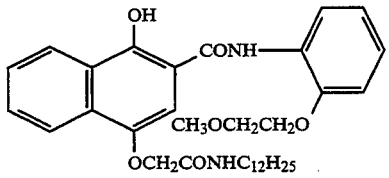
C-I-63
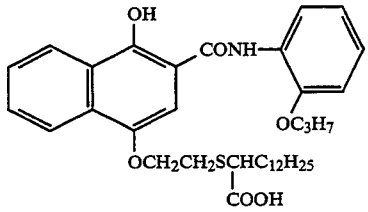
C-I-64
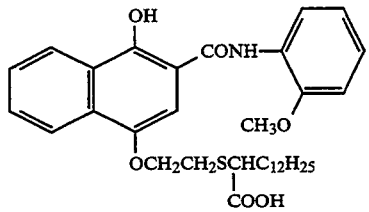
C-I-65
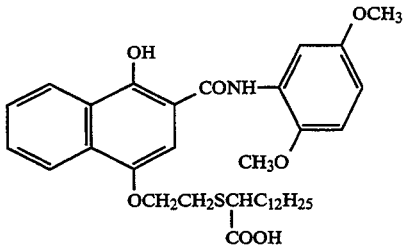

-continued

C-I-66

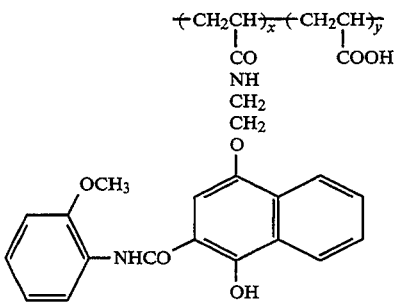

x:y = 50:50 (molar ratio)

C-I-67

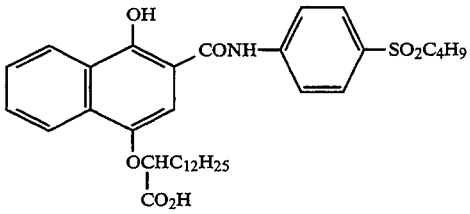

C-I-68

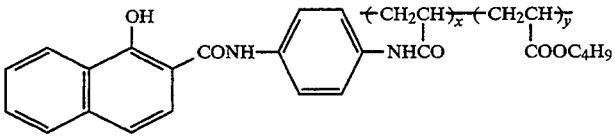

x:y = 50:50 (molar ratio)

Formula [CU]

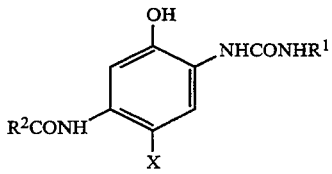

wherein X represents a hydrogen atom or a group capable of splitting off by coupling with an oxidation product of an aromatic primary amine-based color developing agent. $R^1$ represents an aryl group or a heterocyclic group; $R^2$ represents an aryl group or an aliphatic group; the groups represented by $R^1$ or $R^2$ include those having a substituent; $R^1$ and $R^2$ may form a dimer or a higher polymer; $R^1$ and $R^2$, singly or in cooperation, possess a sufficient shape and size to provide the coupler represented by Formula [CU] and the dye formed thereby with diffusion resistance.

The examples of the aryl group represented by $R^1$ or $R^2$ include a phenyl group and a naphthyl group.

The examples of the substituent for the group represented by $R^1$ or $R^2$ include a halogen atom, a nitro group, a cyano group, an alkyl group, an aryl group, an amino group, a hydroxy group, an acyl group, an alkoxycarbonyl group, an aryloxycarbonyl group, an alkylsulfonyl group, an arylsulfonyl group, an alkoxysulfonyl group, an aryloxysulfonyl group, a carbamoyl group, a sulfamoyl group, an acyloxy group, a carbonamido group and a sulfonamido group. It is preferable that the number of the substituents be 1 to 5; when it is 2 or more, the substituents may be identical or not.

The preferable substituents for $R^1$ include a halogen atom an alkylfulfonyl group and cyano group.

$R^2$ is preferably represented by the following formula [CU-II].

Formula [CU-II]

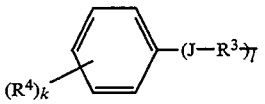

wherein J represents an oxygen atom or a sulfur atom; k represents an integer of 0 to 4; 1 represents 0 or 1; when k is 2 or more, the $R^4$ units may be identical or not. $R^3$ represents an alkylene .group; $R^4$ represents a substituent. The examples of the substituent represented by $R^4$ include an alkyl group, an aryl group, an alkoxy group, an aryloxy group, a hydroxy group, an acyloxy group, an alkylcarbonyloxy group, an arylcarbonyloxy group, a carboxy group, an alkoxycarbonyl group, an aryloxycarbonyl group, an alkylthio group, an acyl group, an acylamino group, a sulfonamido group, a carbamoyl group and a sulfamoyl group.

The examples of the leaving group represented by X include an aryloxy group wherein a halogen atom, an oxygen atom or a nitrogen atom is bound directly to the coupling position, a carbamoyloxy group, a carbamoylmethoxy group, an acyloxy group, a sulfonamido group and a succinimido group. More specific examples are given in, for example, U.S. Pat. Nos. 3,476,563 and 3,749,735, Japanese Patent Publication Open to Public Inspection No. 37425/1972, Japanese Patent Examined Publication No. 36894/1973, Japanese Patent Publication Open to Public Inspection Nos. 10135/1975, 117422/1975, 130441/1975, 108841/1976, 120334/1975, 18315/1977 and 105226/1978.

The phenol-based cyan coupler having an ureido group at the 2-position may be used in combination with other cyan couplers. In this case, it is preferable that the ratio thereof be not less than 10 mol%.

Specific examples of phenol-based couplers having a ureido group at the 2-position are given below, but the present invention is not by any means limited by these examples.

CU-1

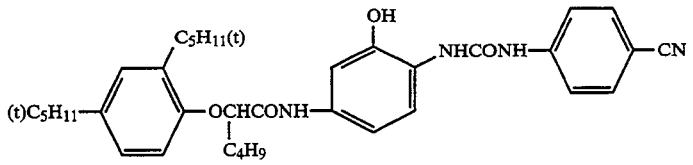

CU-2

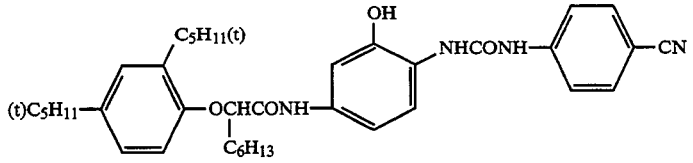

CU-3

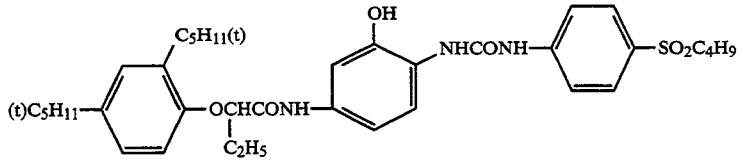

CU-4

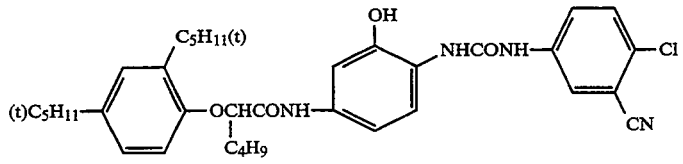

CU-5

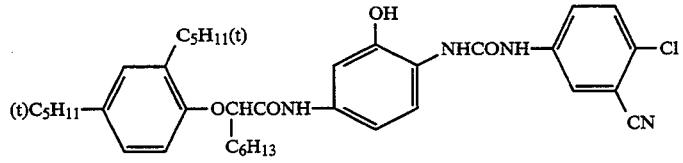

CU-6

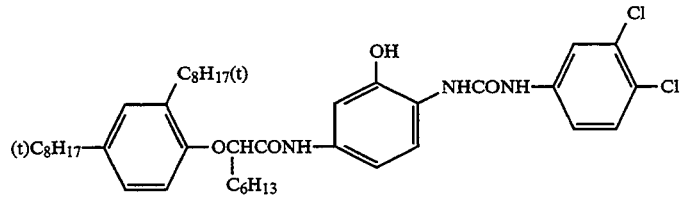

CU-7

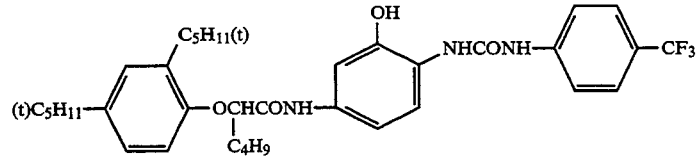

CU-8

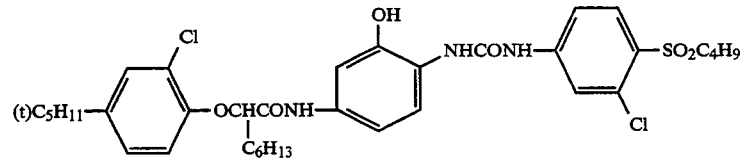

-continued
CU-9
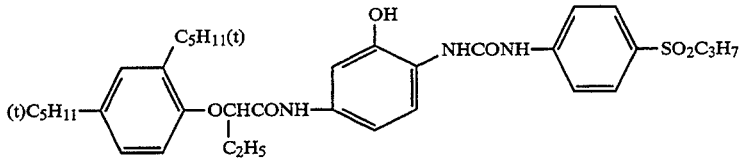
CU-10
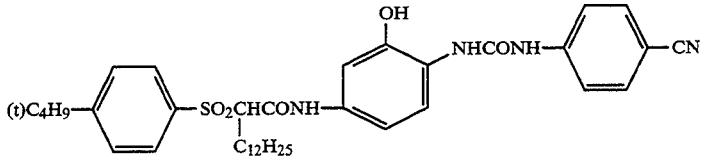
CU-11
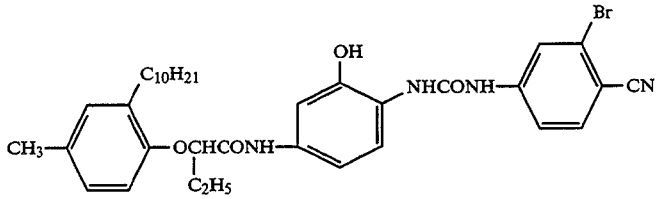
CU-12
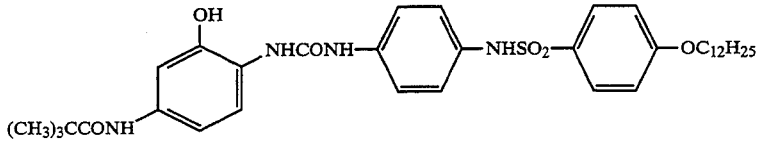
CU-13
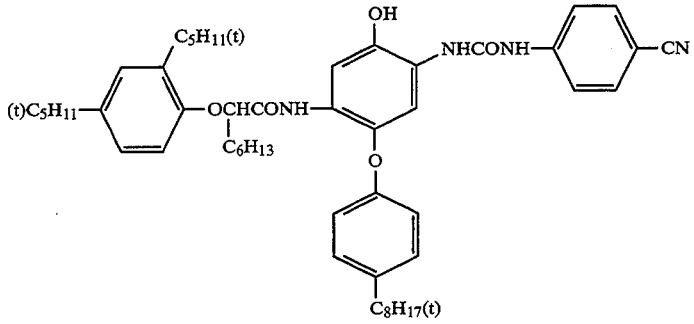
CU-14
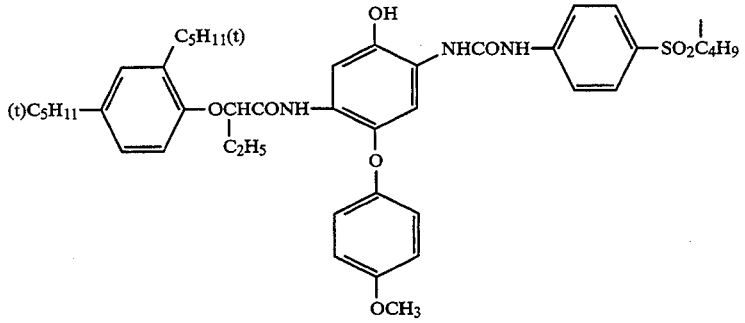
CU-15
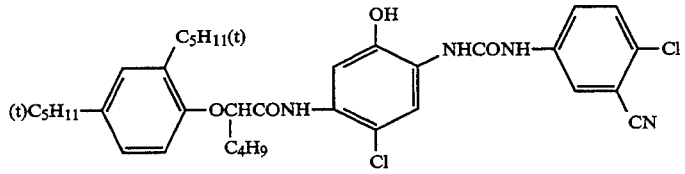

-continued
CU-16
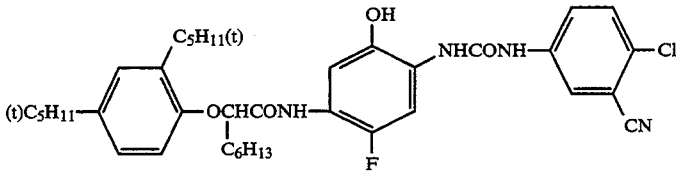
CU-17
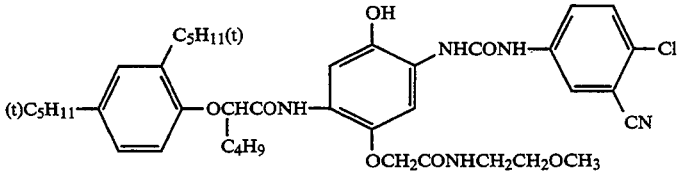
CU-18
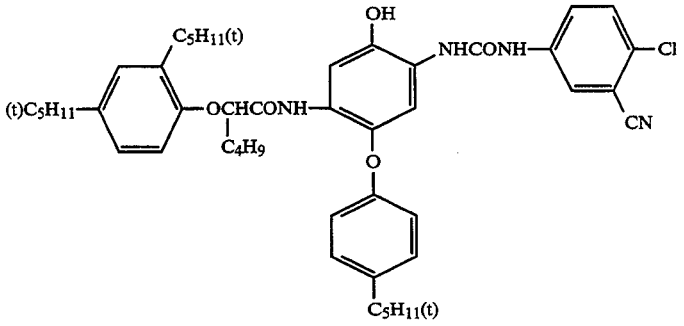
CU-19
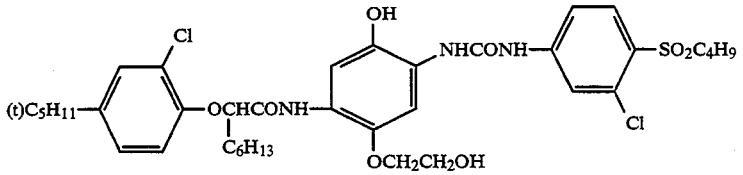
CU-20
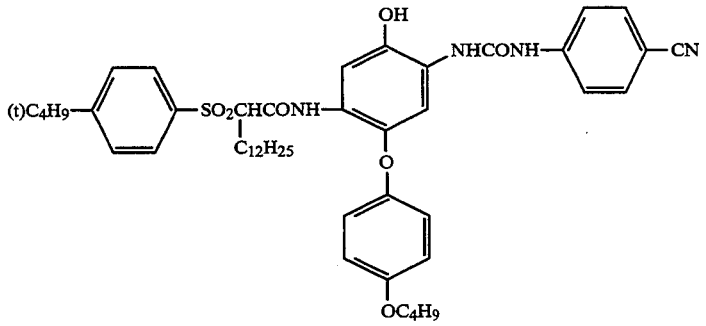
CU-21
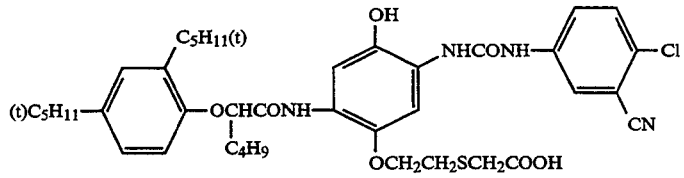

-continued
CU-22
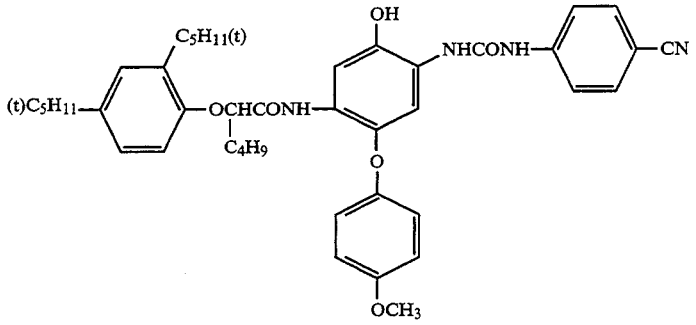
CU-23
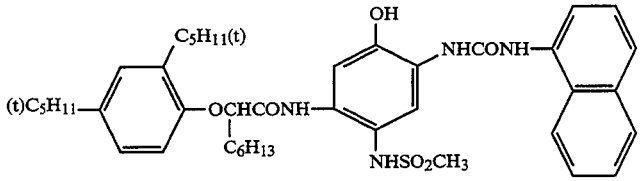
CU-24
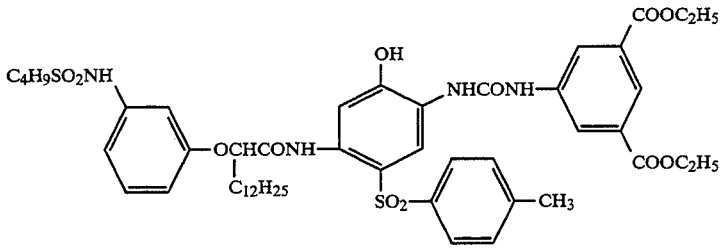
CU-25
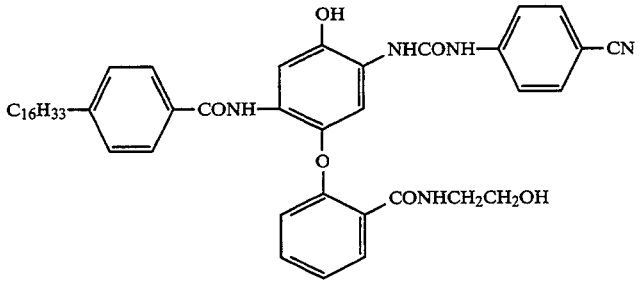
CU-26
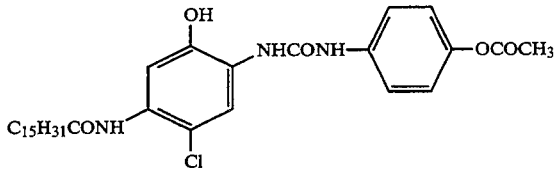
CU-27
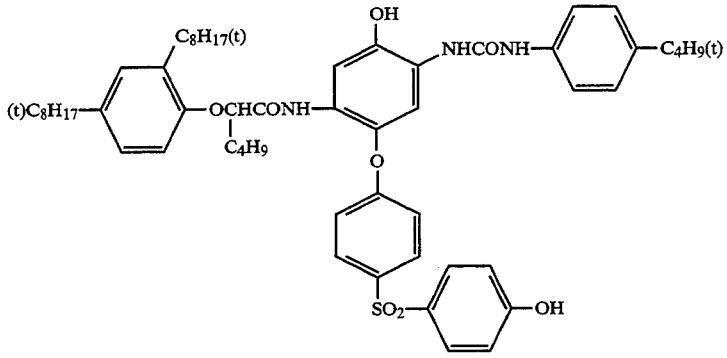

-continued
CU-28
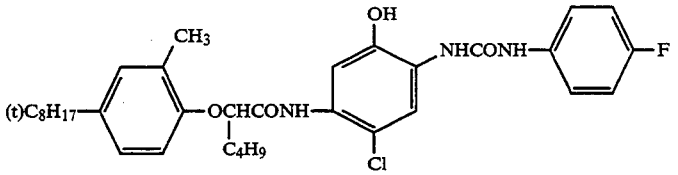
CU-29
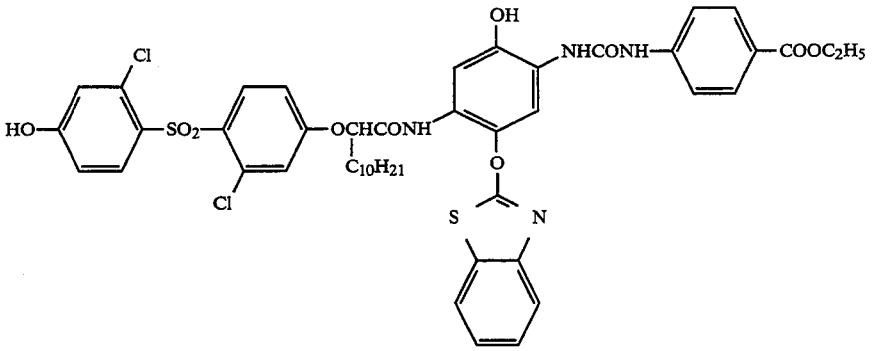
CU-30
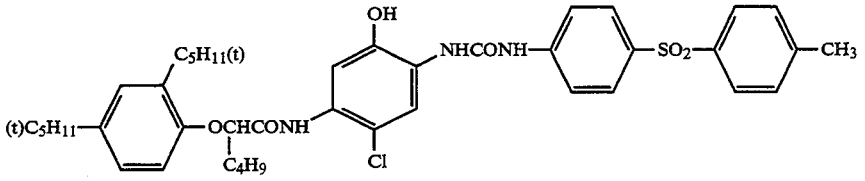
CU-31
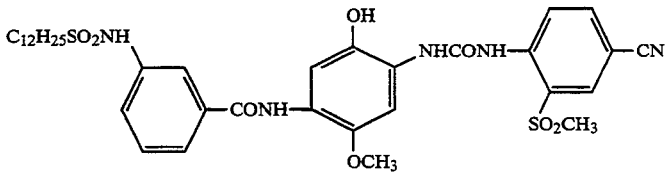
CU-32
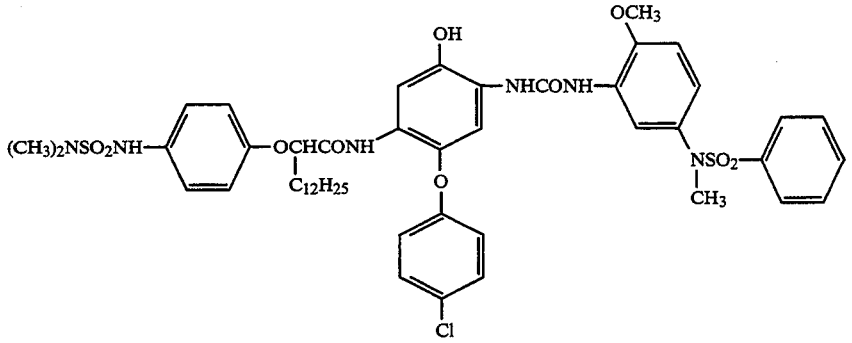
CU-33
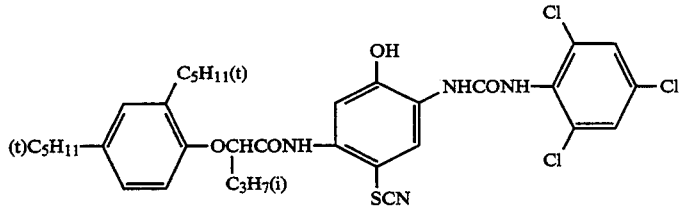

-continued
CU-34
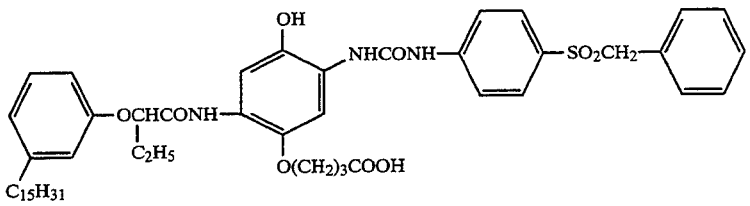
CU-35
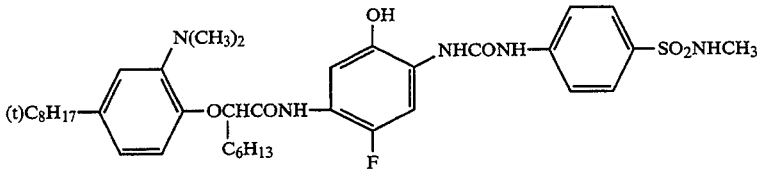
CU-36
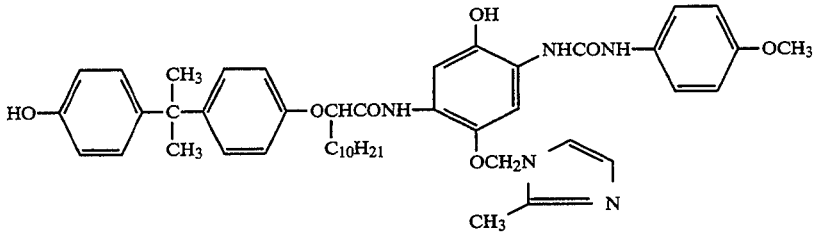
CU-37
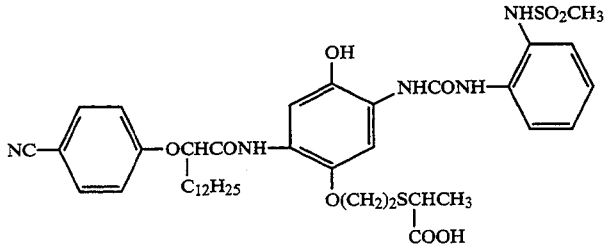
CU-38
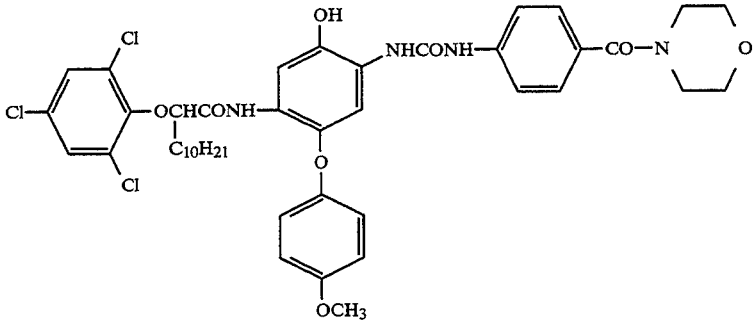
CU-39
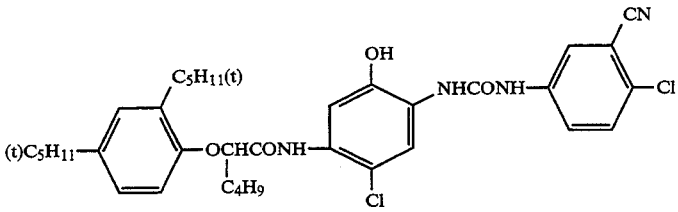
CU-40
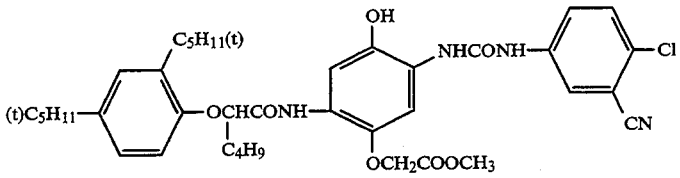

-continued

CU-41

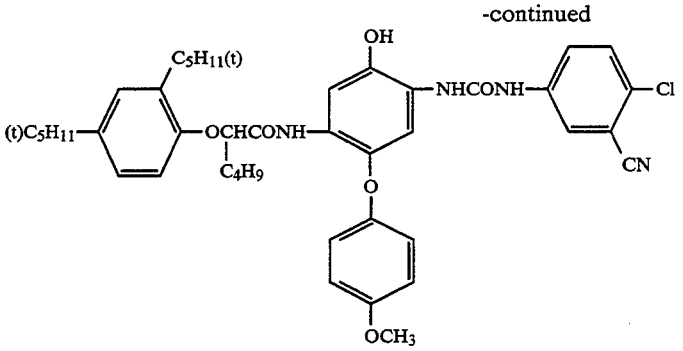

CU-42

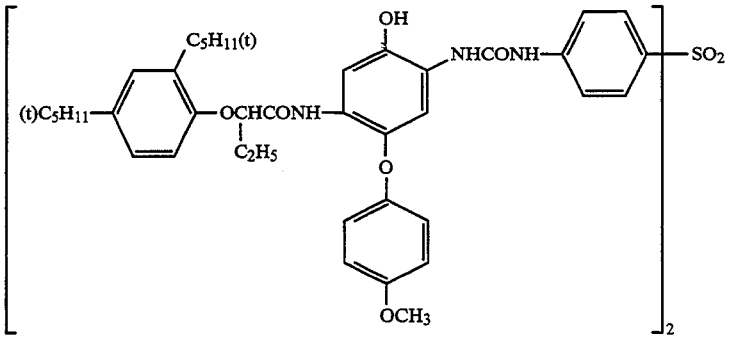

CU-43

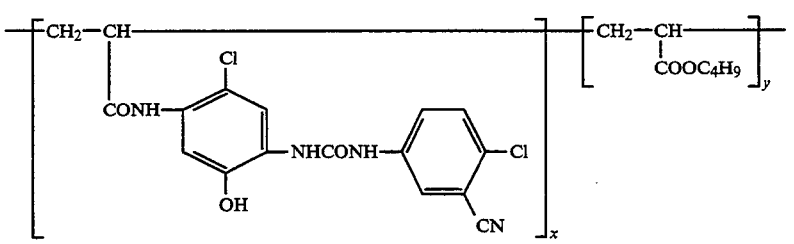

x:y = 50:50 (wt. ratio)

CU-44

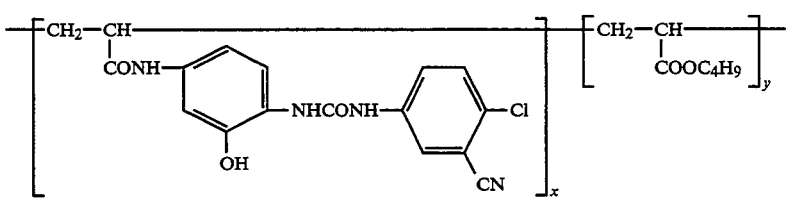

x:y = 50:50 (wt. ratio)

The other examples of phenol-based couplers having a ureido group include those described in, for example, Japanese Patent Publication Open to Public Inspection Nos. 65134/1981 , 204543/1982, 204544/1982, 204545/1982, 33249/1983, 33253/1983, 98731/1983, 118643/1983, 179838/1983, 187928/1973, 65844/1984, 71051/1984, 86048/1984, 105644/1984, 111643/1984, 111644/1984, 131939/1984, 165058/1984, 177558/1984, 180559/1984, 198455/1984, 35731/1985, 37557/1985, 49335/1985, 49336/1985, 50533/1985, 91355/1985, 107649/1985, 107650/1985 and 2757/1986.

Conventional acylacetoanilide-based couplers are preferably used as the yellow dye-forming coupler. Of them, benzoylacetoanilide-based and pyvaloylacetoanilide-based compounds are useful. The specific examples of the usable yellow dye-forming coupler are described in British Patent No. 1,077,874, Japanese Patent Examined Publication No. 40757/1970, Japanese Patent Publication Open to Public Inspection Nos. 1031/1972, 26133/1972, 94432/1973, 87650/1975, 3631/1976, 115219/1977, 99433/1979, 133329/1979, 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155, and 4,401,752.

The addition amount of the preceding cyan couplers is normally preferably $1.0\times10^{-3}$ mol to 1.0 mol per liter silver halide, more preferably $5.0\times10^{-3}$ mol to $8.0\times10^{-1}$ mol/l.

In the photosensitive material of the present invention, it is preferable that at least one silver halide layer have a silver iodide content of not less than 0.5 mol%, more preferably 1 to 15 mol%, and still more preferably 1.5 to 10 mol%.

In the processing method for the silver halide color photographic photosensitive material of the present invention, the lower limit of the sum of dry thicknesses of all hydrophilic colloid layers of the silver halide color photographic photosensitive material (hereinafter referred to as the film thickness of emulsion layer) is limited by the silver halide emulsions, couplers, oil agents, additives and other substances contained therein. It is preferable that the film thickness of emulsion surface be 5 to 18 μm, more preferably 10 to 16 μm. Also, the distance between the outside surface of the uppermost emulsion layer and the lower end of the emulsion layer nearest the support is preferably not more than 14 μm, and the distance between the outside surface of the uppermost emulsion layer and the lower end of the emulsion layer whose color sensitivity differs from that of the emulsion layer nearest the support and which is located next nearest the support is preferably not more than 10 μm.

To reduce the film thickness of the color photosensitive material of the present invention, it is possible to use a method in which the weight of the hydrophilic colloidal substance, a binder, is reduced. Hydrophilic colloids are added to retain fine oily coupler drops etc. in solution in silver halide and high boiling point solvent, to prevent increase in fogging due to mechanical stresses, to prevent color turbidity due to interlayer diffusion of an oxidation product of the developing agent, and for other purposes; weight reduction is acceptable, as long as these purposes are not hampered.

Film thickness reduction can also be achieved by another method, which uses couplers with high coloring performance.

The other methods of film thickness reduction include the method in which the weight of high boiling point solvent is reduced and the method in which the interlayer between layers with different color sensitivities is thinned by the addition of a scavenger for the oxidation product of the developing agent to the interlayer.

In the processing method for the silver halide color photographic photosensitive material of the present invention, the total amount of silver halide contained in the photosensitive silver halide emulsions in all emulsion layers of the silver halide color photographic photosensitive material is preferably not more than 6.5 $g/m^2$, more preferably 2.5 to 6.0 $g/m^2$, still more preferably 3.0 to 5.5 $g/m^2$, and ideally 3.5g to 5.0 $g/m^2$.

In the processing method for the silver halide color photographic photosensitive material of the present invention, the total swollen film thickness in development of all hydrophilic protective colloidal layers formed on the emulsion layer side on the support of the silver halide color photographic photosensitive material is preferably 180% to 350% of the dry film thickness, more preferably 200 to 300%.

The method of adjusting this swollen film thickness is obvious to those skilled in the art, and can be achieved by choosing an appropriate amount and type of hardener, for instance.

The examples of hardeners include aldehyde-based ones, aziridine-based ones (e.g. those described in PB Report 19,921, U.S. Pat. Nos.2,950,197, 2,964,404, 2,983,311 and 3,271,175, Japanese Patent Examined Publication No. 40898/1971, and Japanese Patent Publication Open to Public Inspection No. 91315/1975), isoxazole-based ones (e.g. those described in U.S. Pat. No. 331,609), epoxy-based ones (e.g. those described in U.S. Pat. No. 3,047,394, West German Patent No. 1,085,663, British Patent No. 1,033,518 and Japanese Patent Examined Publication No. 35495/1973), vinylsulfone-based ones (e.g. those described in PB Report 19,920, West German Patent Nos. 1,100,942, 2,337,412, 2,545,722, 2,635,518, 2,742,308 and 2,749,260, British Patent No.1,251,091, Japanese Patent Application Nos. 54236/1970 and 110996/1973, and U.S. Pat. Nos. 3,539,644 and 3,490,911), acryloyl-based ones (e.g. those described in Japanese Patent Application No. 27949/1973, U.S. Pat. No. 3,640,720), carbodiimide-based ones (e.g. those described in US Patent Nos. 2,938,892, 4,043,818 and 4,061,499, Japanese Patent Examined Publication No. 38715/1971, Japanese Patent Application No. 15095/1974), triazine-based ones (e.g. those described in West German Patent Nos.2,410,973 and 2,553,915, U.S. Pat. No. 3,325,287, Japanese Patent Publication Open to Public Inspection No.12722/1977), polymer type ones (e.g. those described in British Patent No.822,061, U.S. Pat. Nos. 3,623,878, 3,396,029 and 3,226,234, Japanese Patent Examined Publication Nos.18578/1972, 18579/1972 and 48896/1972), maleimide-based ones, acetylene-based ones, methanesulfonate-based ones, (N-methylol-based ones); these hardeners may be used singly or in combination.

The examples of valuable combined art include the combinations described in West German Patent Nos. 2,447,587, 2,505,746 and 2,514,245, U.S. Pat. Nos. 4,047,957, 3,832,181 and 3,840,370, Japanese Patent Publication Open to Public Inspection Nos. 43319/1973, 63062/1975 and 127329/1977, and Japanese Patent Examined Publication No. 32364/1973.

The preceding all hydrophilic protective colloidal layers include the preceding silver halide emulsion layers comprising at least one of each of blue-, green-, and red-sensitive layers, as well as protective layers, antihalation layers, yellow filter layers, interlayers and other layers formed as needed.

The preferable layer structures of the silver halide color photographic photosensitive material of the present invention include the structure in which a colloidal silver antihalation layer (interlayer), a red-sensitive layer (interlayer), a green-sensitive layer (interlayer), a colloidal silver yellow filter layer, a blue-sensitive layer (interlayer), and a protective layer are applied in this order from the support, and the structure in which a colloidal silver antihalation layer (interlayer), a red-sensitive layer (interlayer), a green-sensitive layer (interlayer), a blue-sensitive layer (interlayer), a red-sensitive layer (interlayer), a green-sensitive layer (colloidal silver yellow filter layer), a blue-sensitive layer (interlayer), and a protective layer are applied in this order from the support.

The layers in parentheses may be omitted. It is preferable that the preceding red-, green- and blue- sensitive layers be each divided into a low sensitivity layer and a high sensitivity layer. Mention may also be made of the layer structure in which at least one of red-, green- and blue-sensitive layers is divided into three separate layers, as described in Japanese Patent Examined Publication No. 15495/1974, the layer structure in which the layers are divided into a high sensitivity emulsion layer unit and a low sensitivity emulsion layer unit, as described in Japanese Patent Publication Open to Public Inspection No. 49027/1976, and the layer structures described in West German OLS Patent Nos. 2,622,922, 2,622,923, 2,622,924, 2,704,826 and 2,704,797.

To the present invention also applicable are the layer structures described in Japanese Patent Publication Open to Public Inspection Nos. 177551/1982, 177552/1984 and 180555/1984.

These silver halide emulsions may be chemically sensitized with active gelatin; sulfur sensitizers such as allylthiocarbamide, thiourea and cystine; selenium sensitizers; reduction sensitizers such as stannous salts, thiourea dioxide and polyamine; precious metal sensitizers such as gold sensitizers, specifically potassium aurithiocyanate, potassium chloroaurate, 2-aurothio-3-methylbenzothiazolium chloride; and sensitizers with watersoluble group such as of ruthenium, palladium, platinum, rhodium and iridium, specifically ammonium chloropalladate, potassium chloroplatinate and sodium chloropalladate (some of these substances act as sensitizers or as antifogging agents etc., depending on their amount); these substances may be used singly or in appropriate combination (e.g. combinations of a gold sensitizer and a sulfur sensitizer, combinations of a gold sensitizer and a selenium sensitizer).

The silver halide emulsion of the present invention may chemically ripened by the addition of a sulfur-containing compound and may contain at least one hydroxytetrazaindene and at least one nitrogen-containing heterocyclic compound with a mercapto group, as added before, during or after chemical ripening The silver halide for the present invention may be optically sensitized by the addition of an appropriate sensitizing dye at ratios of $5\times10^{-8}$ to $3\times10^{-3}$ mol per mol silver halide to provide sensitivity in the desired photosensitivity wavelength range.

Various sensitizing dyes can be used, and they can be used singly or in combination.

The examples of sensitizing dyes which serve well for the present invention include the following:

The examples of sensitizing dyes used in blue-sensitive silver halide emulsion include those described in, for example, West German Patent No.929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588, and Japanese Patent Examined Publication Nos. 14030/1969 and 24844/1977. The typical examples of sensitizing dyes used in green-sensitive silver halide emulsion include the cyanine dyes, melocyanine dyes and complex melocyanine dyes described in, for example, U.S. Pat. Nos.1,939,201, 2,072,908, 2,739,149 and 2,945,763, and British Patent No.505,979. The typical examples of sensitizing dyes used in red-sensitive silver halide emulsion include the cyanine dyes, melocyanine dyes and complex melocyanine dyes described in, for example, U.S. Pat. Nos. 2,269,234, 2,270,378, 2,442,710, 2,454,629 and 2,776,280. Furthermore, the cyanine dyes, melocyanine dyes and complex cyanine dyes described in, for example, U.S. Pat. Nos. 2,213,995, 2,493,748 and 2,519,001, and West German Patent No. 929,080 can also be advantageously used in green- or red-sensitive silver halide emulsion.

These sensitizing dyes may be used singly or in combination.

The photographic structural layer of the silver halide color photographic photosensitive material of the present invention can contain a dye which is soluble in water or which is discolored by a color developer (AI dye). The examples of the the AI dye include oxonol dyes, hemioxonol dyes, melocyanine dyes and azo dyes. Oxonol dyes, hemioxonol dyes and melocyanine dyes are especially valuable.

The examples of usable AI dyes include those described in British Patent Nos. 584,609 and 1,277,429, Japanese Patent Publication Open to Public Inspection Nos. 85130/1973, 99620/1974, 114420/1974, 129537/1974, 108115/1977, 25845/1984, 111640/1984 and 111641/1984, U.S. Pat. Nos. 2,274,782, 2,533,472, 2,956,079, 3,125,448, 3,148,187, 3,177,078, 3,247,127, 3,260,601, 3,540,887, 3,575,704, 3,653,905, 3,718,472 and 4,070,352.

These AI dyes are preferably used in amounts of $2\times10^{-3}$ to $5\times10^{-1}$ mol per mol silver in emulsion layer.

DIR compounds can be used in the photosensitive material of the present invention.

The typical DIR compounds include the DIR compounds wherein a group capable of forming a compound with development inhibitory action when splitting off from the active point is introduced into the active point of the coupler, such as those described in, for example, British Patent No. 935,454 and U.S. Pat. Nos. 3,227,554, 4,095,984 and 4,149,886.

The preceding DIR couplers are characterized by dye formation in the coupler nucleus while releasing a development inhibitor in coupling reaction with an oxidation product of color developing agent. The present invention also involves the compounds which release a development inhibitor but which do not form a dye in coupling reaction with an oxidation product of color developing agent, as described in U.S. Pat. Nos. 3,652,345, 3,928,041, 3,958,993, 3,961,959 and 4,052,213, and Japanese Patent Publication Open to Public Inspection Nos. 110529/1978, 13333/1979 and 161237/1980.

It is also possible to use for the present invention so called timing DIR compounds, compounds whose nucleus forms a colorless compound in reaction with an oxidation product of color developing agent and whose timing group, when splitting off, releases a development inhibitor by intramolecular nucleophilic substitution or elimination reaction, as described in Japanese Patent Publication Open to Public Inspection Nos. 145135/1979, 114946/1981 and 154234/1982.

Also usable are the timing DIR compounds having a coupler nucleus which forms a completely diffusible dye in reaction with an oxidation product of color developing agent and to which a timing group as described above is bound.

It is preferable that the amount of the DIR compound contained in the photosensitive material be $1\times10^{-4}$ mol to $10\times10^{-1}$ mol per mol silver.

In addition to DIR compounds, compounds which release a development inhibitor during development can also be used for the present invention. The examples of such compounds include those described in, for example, U.S. Pat. Nos. 3,297,445 and 3,379,529, West German OLS Patent No. 2,417,914, and Japanese Patent Publication Open to Public Inspection Nos. 15271/1977, 9116/1978, 123838/1984 and 27038/1984.

The silver halide color photographic photosensitive material for the present invention may contain various other photographic additives. The examples of other usable additives include the antifogging agents, stabilizers, ultraviolet absorbents, anti-color-stain agents, fluorescent whitening agents, color image fading inhibitors, antistatic agents, hardeners, surfactants, plasticizers and wetting agents described in, for example, Research Disclosure No. 17643.

The hydrophilic colloids used to prepare an emulsion for the silver halide color photographic photosensitive material for the present invention include gelatin, derivative gelatin, gelatin-polymer graft polymers, proteins such as albumin and casein, cellulose derivatives such as hydroxyethylcellulose and carboxymethylcellulose, starch derivatives, synthetic hydrophilic polymers comprising a mono- or copolymer such as polyvinyl alcohol, polyvinyl imidazole or polyacrylamide.

The examples of the support for the silver halide color photographic photosensitive material for the present invention include baryta paper, polyethylene-coated paper, polypropylene synthetic paper, transparent supports having a reflex layer or used in combination with a reflector, such as glass plates, cellulose acetate, cellulose nitrates or polyester films of polyethylene terephthalate, polyamide films, polycarbonate films and polystyrene films, as well as ordinary transparent supports.

These supports are selected as appropriate according to the purpose of the use of the photosensitive material.

EXAMPLES

The present invention is hereinafter described in more detail by means of the following examples, but the present invention is not by any means limited by these examples.

EXAMPLE 1

In all examples given below, the addition amount of any component in the silver halide photographic photosensitive material is expressed in g per $m^2$ unless otherwise stated.

The amounts of silver halide and colloidal silver are expressed as converted to silver amount.

On a triacetyl cellulose film were formed layers with the following compositions in this order from the support to prepare a multilayer color photographic photosensitive material sample.

| | |
|---|---|
| Layer 1: Antihalation layer | |
| Black colloidal silver | 0.19 |
| Ultraviolet absorbent (UV-1) | 0.20 |
| Colored coupler (CC-1) | 0.05 |
| Colored coupler (CM-2) | 0.06 |
| High boiling point solvent (Oil-1) | 0.21 |
| Gelatin | 1.5 |
| Layer 2: Interlayer | |
| Ultraviolet absorbent (UV-1) | 0.01 |
| High boiling point solvent (Oil-1) | 0.01 |
| Gelatin | 1.2 |
| Layer 3: | |
| Low sensitivity red-sensitive emulsion layer | |
| Silver iodobromide emulsion (Em-1) | 0.9 |
| Silver iodobromide emulsion (Em-2) | 0.6 |
| Sensitizing dye (S-1) | $2.2 \times 10^{-4}$ (mol/mol silver) |
| Sensitizing dye (S-2) | $2.5 \times 10^{-4}$ (mol/mol silver) |
| Sensitizing dye (S-3) | $0.5 \times 10^{-4}$ (mol/mol silver) |
| Cyan coupler (CU-40) | 1.3 |
| Cyan coupler (C'-1) | 0.3 |
| Colored cyan coupler (CC-1) | 0.05 |
| DIR compound (D-1) | 0.002 |
| High boiling point solvent (Oil-1) | 0.5 |
| Gelatin | 1.2 |
| Layer 4: | |
| High sensitivity red-sensitive emulsion layer | |
| Silver iodobromide emulsion (Em-3) | 1.9 |

-continued

| | |
|---|---|
| Sensitizing dye (S-1) | $2.2 \times 10^{-4}$ (mol/mol silver) |
| Sensitizing dye (S-2) | $2.0 \times 10^{-4}$ (mol/mol silver) |
| Sensitizing dye (S-3) | $0.1 \times 10^{-4}$ (mol/mol silver) |
| Cyan coupler (CU-4) | 0.20 |
| Cyan coupler (C'-1) | 0.03 |
| Cyan coupler (C-1-20) | 1.15 |
| Colored cyan coupler (CC-1) | 0.016 |
| DIR compound (D-2) | 0.05 |
| High boiling point solvent (Oil-1) | 0.5 |
| Gelatin | 1.3 |
| Layer 5: Interlayer | |
| Gelatin | 0.5 |
| Layer 6: | |
| Low sensitivity green-sensitive emulsion layer | |
| Silver iodobromide emulsion (Em-1) | 1.1 |
| Sensitizing dye (S-4) | $5 \times 10^{-4}$ (mol/mol silver) |
| Sensitizing dye (S-5) | $2 \times 10^{-4}$ (mol/mol silver) |
| Magenta coupler (M1-4) | 0.48 |
| Colored magenta coupler (CM-1) | 0.05 |
| DIR compound (D-3) | 0.015 |
| DIR compound (D-4) | 0.020 |
| High boiling point solvent (Oil-2) | 0.5 |
| Gelatin | 1.0 |
| Layer 7: Interlayer | |
| Gelatin | 0.9 |
| High boiling point solvent (Oil-1) | 0.2 |
| Layer 8: | |
| High sensitivity green-sensitive emulsion layer | |
| Silver iodobromide emulsion (Em-3) | 1.8 |
| Sensitizing dye (S-6) | $1.5 \times 10^{-4}$ (mol/mol silver) |
| Sensitizing dye (S-7) | $2.5 \times 10^{-4}$ (mol/mol silver) |
| Sensitizing dye (S-8) | $0.7 \times 10^{-4}$ (mol/mol silver) |
| Magenta coupler (M'-1) | 0.08 |
| Magenta coupler (M'-2) | 0.18 |
| Colored magenta coupler (CM-2) | 0.05 |
| DIR compound (D-3) | 0.01 |
| High boiling point solvent (Oil-3) | 0.5 |
| Gelatin | 1.3 |
| Layer 9: Yellow filter layer | |
| Yellow colloidal silver | 0.12 |
| Anti-color-stain agent (SC-1) | 0.1 |
| High boiling point solvent (Oil-3) | 0.1 |
| Gelatin | 0.8 |
| Layer 10: | |
| Low sensitivity blue-sensitive emulsion layer | |
| Silver iodobromide emulsion (Em-1) | 0.30 |
| Silver iodobromide emulsion (Em-2) | 0.25 |
| Sensitizing dye (S-10) | $7 \times 10^{-4}$ (mol/mol silver) |
| Yellow coupler (Y-1) | 0.6 |
| Yellow coupler (Y-2) | 0.2 |
| DIR compound (D-2) | 0.01 |
| High boiling point solvent (Oil-3) | 0.16 |
| Gelatin | 1.2 |
| Layer 11: | |
| High sensitivity blue-sensitive emulsion layer | |
| Silver iodobromide emulsion (Em-4) | 0.48 |
| Silver iodobromide emulsion (Em-1) | 0.22 |
| Sensitizing dye (S-9) | $1.3 \times 10^{-4}$ (mol/mol silver) |
| Sensitizing dye (S-10) | $3 \times 10^{-4}$ (mol/mol silver) |
| Yellow coupler (Y-1) | 0.38 |
| Yellow coupler (Y-2) | 0.12 |
| High boiling point solvent (Oil-3) | 0.07 |
| Gelatin | 1.2 |
| Layer 12: 1st protective layer | |
| Microgranular silver iodobromide emulsion (average grain size 0.08 μm, AgI 2.5 mol %) | 0.40 |
| Ultraviolet absorbent (UV-1) | 0.10 |
| Ultraviolet absorbent (UV-2) | 0.05 |

-continued

| | |
|---|---|
| High boiling point solvent (Oil-1) | 0.1 |
| High boiling point solvent (Oil-4) | 0.1 |
| Formalin scavenger (HS-1) | 0.5 |
| Formalin scavenger (HS-2) | 0.2 |
| Gelatin | 1.2 |
| Layer 13: 2nd protective layer | |
| Surfactant (Su-1) | 0.005 |
| Alkali-soluble matting agent (average grain size 2 μm) | 0.10 |
| Cyan dye (AIC-1) | 0.01 |
| Magenta dye (AIM-1) | 0.01 |
| Wax (WAX-1) | 0.04 |
| Gelatin | 0.7 |

In addition to these components, coating aid Su-2, dispersion aid Su-3, hardeners H-1 and H-2, preservative DI-1, stabilizer Stab-1 and antifogging agents AF-1 and AF-2 were added to each layer.

Em-1: Monodispersible emulsion with a lower surface silver iodide content, an average grain size of 0.46 μm and an average silver iodide content of 7.0 mol%.

Em-2: Monodispersible emulsion with a uniform composition, an average grain size of 0.32 μm and an average silver iodide content of 2.5 mol%.

Em-3: Monodispersible emulsion with a lower surface silver iodide content, an average grain size of 0.78 μm and an average silver iodide content of 6.0 mol%.

Em-4: Monodispersible emulsion with a lower surface silver iodide content, an average grain size of 0.95 μm and an average silver iodide content of 7.5 mol%.

Em-1, Em-2, Em-3 and Em-4 are silver iodobromide emulsions which have a multilayer structure and which mainly comprise octagonal grains, prepared in accordance with Japanese Patent Publication Open to Public Inspection Nos. 138538/1985 and 245151/1986.

Em-1 through Em-4 all have an average grain size/thickness ratio of 1.0, and their grain distribution width was 14%, 10%, 12% and 12%, respectively.

S-1

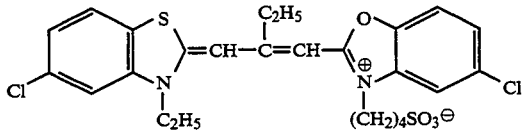

S-2

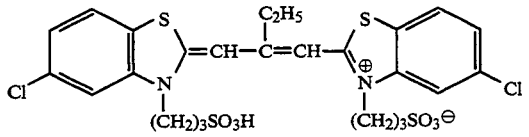

S-3

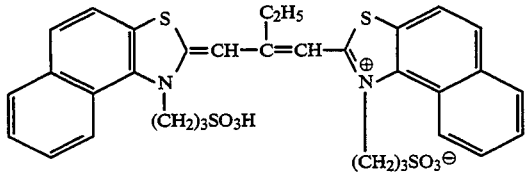

S-4

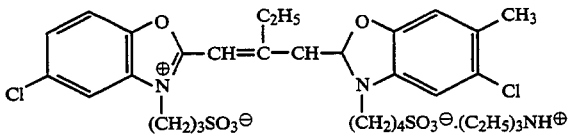

S-5

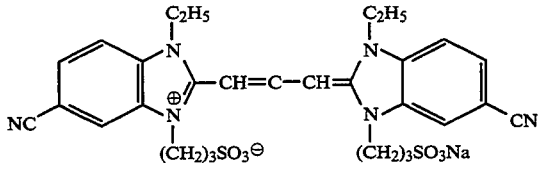

S-6

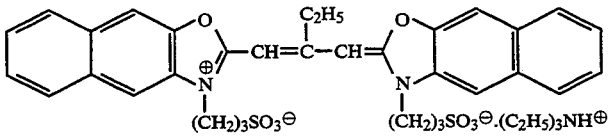

-continued
S-7
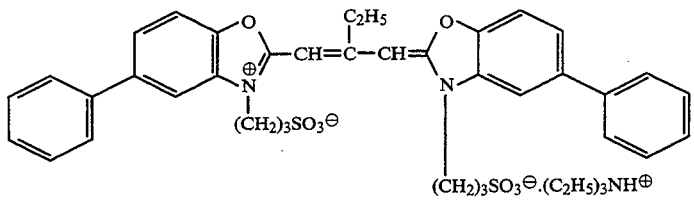
S-8
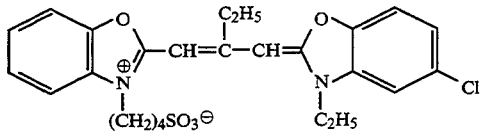
S-9
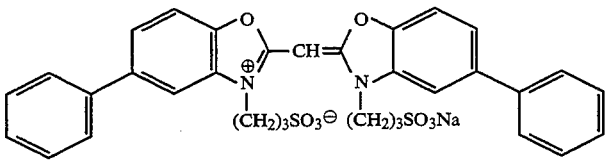
S-10
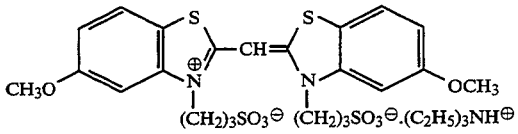
C'-1
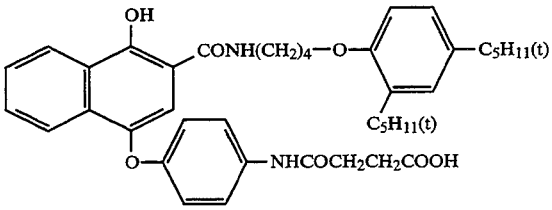
M'-1
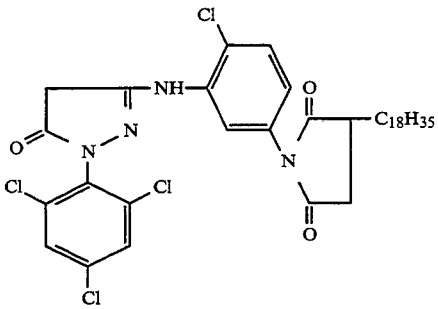
M'-2
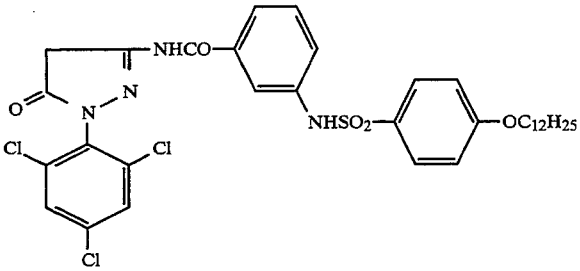

-continued
Y-1
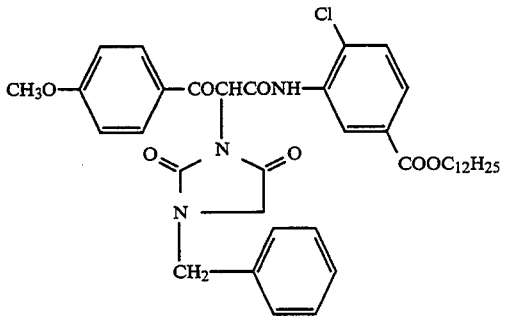
Y-2
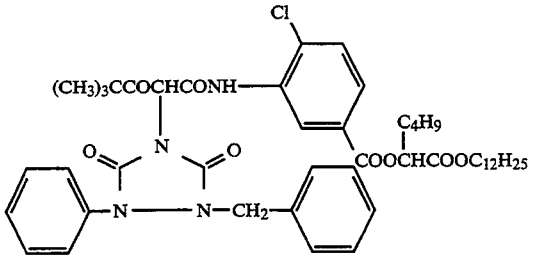
CC-1
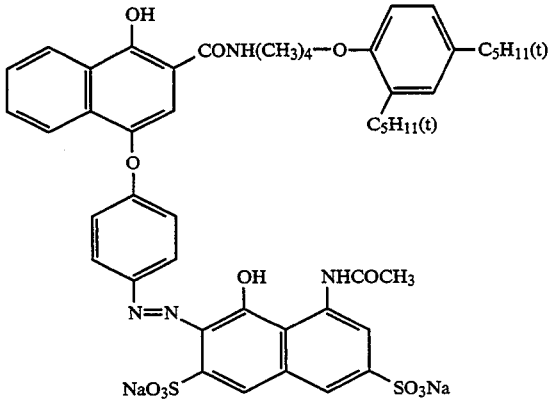
CM-1
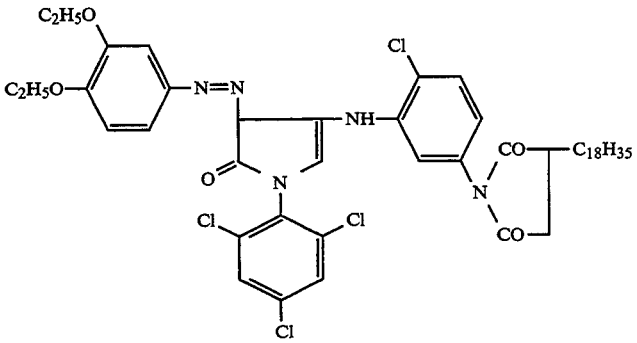
CM-2
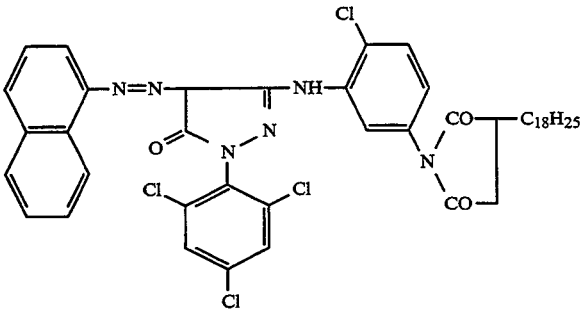

-continued
D-1
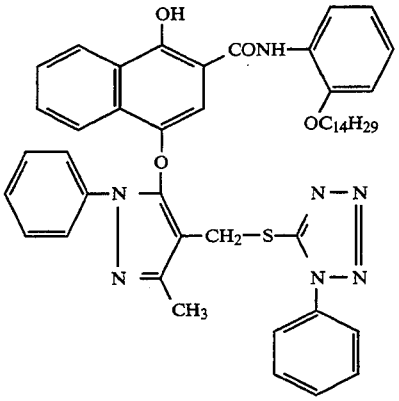
D-2
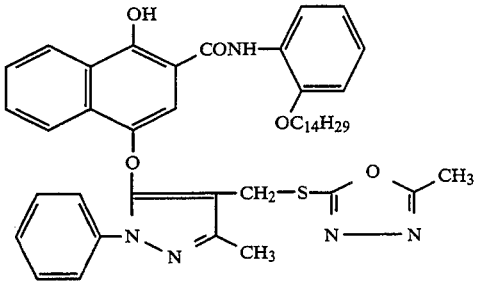
D-3
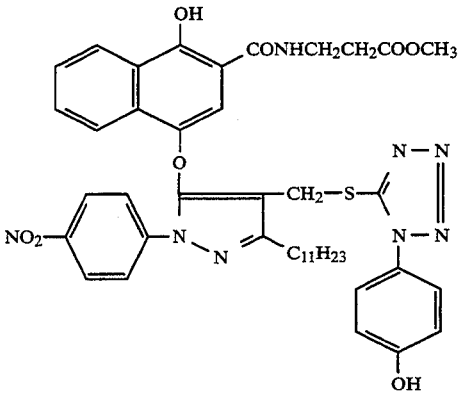
D-4
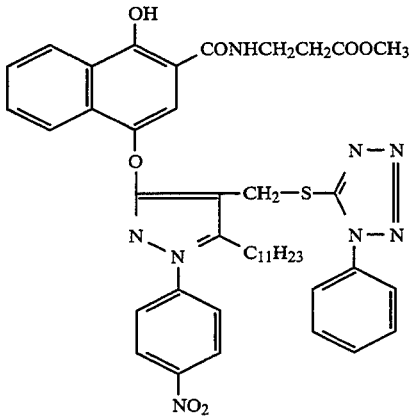
UV-1
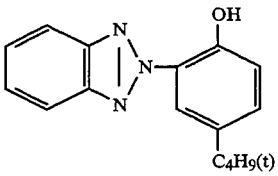
UV-2
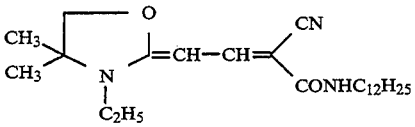
HS-1
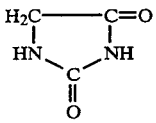
HS-2
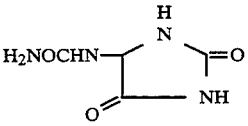
H-1
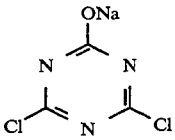
H-2
$[(CH_2{=}CHSO_2CH_2)_3CCH_2SO_2(CH_2)_2]_2N(CH_2)_2SO_3K$
Su-1
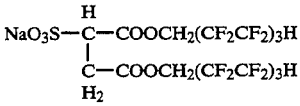
Su-2
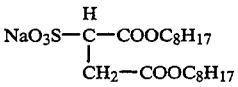
Su-3
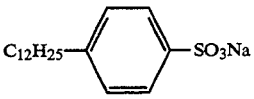
WAX-1
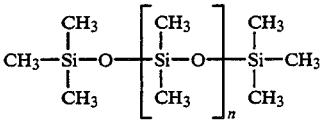

-continued
Sc-1
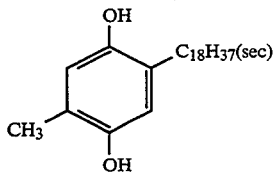
AIC-1
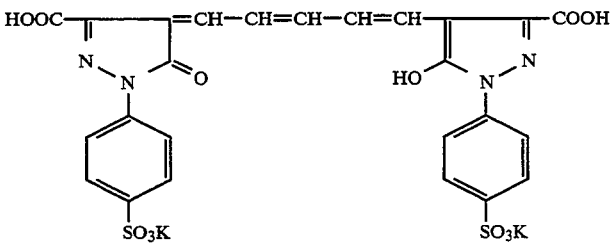
AIM-1
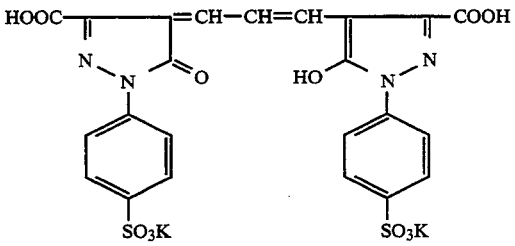
Stab-1
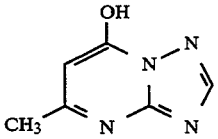
AF-1
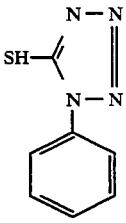
AF-2
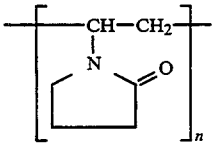
DI-1
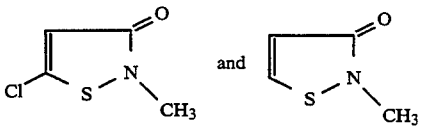
Oil-1
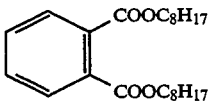
Oil-2
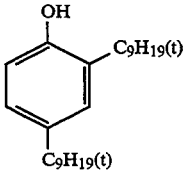
Oil-3
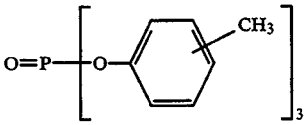
Oil-4
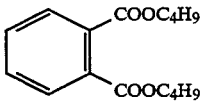
The photosensitive material samples thus prepared were exposed to white light through an optical wedge and then processed under the following conditions.
For processing, running was conducted until the replenisher had been supplied in an amount three times the capacity of the stabilization tank.

| Processss | Processing time | Processing temperature | Amount or replenishment |
|---|---|---|---|
| Color development | 3 min. 15 sec. | 38° C. | 775 ml |
| Bleaching | 45 sec. | 38° C. | 155 ml |
| Fixation | 1 min. 45 sec. | 38° C. | 500 ml |
| Stabilization | 90 sec. | 38° C. | 775 ml |
| Drying | 1 min. | 40~70° C. | — |

(Figures for the amount of replenishment are values per $m^2$ photosensitive material.)

Note that stabilization was conducted using a 3-chamber counter current system wherein the replenisher was supplied to the final stabilizing chamber and the overflow entered the previous chamber.

A part (275 ml/$m^2$) of the overflow from the stabilizing tank following the fixation tank was flew into the stabilizing tank.

The composition of the color developer used is as follows:

| | |
|---|---|
| Potassium carbonate | 30 g |
| Sodium hydrogen carbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-amino-3-methyl-N-ethyl-N-(β-hydroxyethyl)aniline sulfate | 4.6 g |
| Diethylenetriamine pentaacetate | 3.0 g |
| Potassium hydroxide | 1.3 g |

Water was added to make a total quantity of 1 liter and potassium hydroxide or 20% sulfuric acid was added to adjust the solution to pH 10.01.

The composition of the color developer replenisher used is as follows:

| | |
|---|---|
| Potassium carbonate | 40 g |
| Sodium hydrogen carbonate | 3 g |
| Potassium sulfite | 7 g |
| Sodium bromide | 0.5 g |
| Hydroxylamine sulfate | 3.2 g |
| 4-amino-3-methyl-N-ethyl-N-(β-hydroxyethyl)aniline sulfate | 6.0 g |
| Diethylenetriamine pentaacetate | 3.0 g |
| Potassium hydroxide | 2 g |

Water was added to make a total quantity of 1 liter and potassium hydroxide or 20% sulfuric acid was added to adjust the solution to pH 10.12.

The composition of the bleacher used is as follows:

| | |
|---|---|
| Ferric complex salt of organic acid (described in Table 1) | 0.35 mol |
| Disodium ethylenediaminetetraacetate | 2 g |
| Ammonium bromide | 150 g |
| Glacial acetic acid | 40 ml |
| Ammonium nitrate | 40 g |

Water was added to make a total quantity of 1 liter and aqueous ammonia or glacial acetic acid was added to adjust the solution to pH 4.5.

The composition of the bleacher replenisher used is as follows:

| | |
|---|---|
| Ferric complex salt of organic acid (described in Table 1) | 0.40 mol |
| Disodium ethylenediaminetetraacetate | 2 g |
| Ammonium bromide | 170 g |
| Ammonium nitrate | 50 g |
| Glacial acetic acid | 61 ml |

Water was added to make a total quantity of 1 liter and aqueous ammonia or glacial acetic acid was added to adjust the solution to pH 3.5, and appropriate adjustment was made so that the pH of bleaching tank solution is kept constant.

The composition of the fixer and fixer replenisher used is as follows:

| | |
|---|---|
| Ammonium thiosulfate | 100 g |
| Ammonium thiocyanate | 150 g |
| Anhydrous sodium bisulfite | 20 g |
| Sodium metabisulfite | 4.0 g |
| Disodium ethylenediaminetetraacetate | 1.0 g |

Water was added to make a total quantity of 700 ml and glacial acetic acid and aqueous ammonia were used to adjust the solution to pH 6.5.

The composition of the stabilizer and stabilizer replenisher used is as follows:

| | |
|---|---|
| 5-chloro-2-methyl-4-isothiazolin-3-one | 0.05 g |
| 2-methyl-4-isothiazolin-3-one | 0.02 g |
| 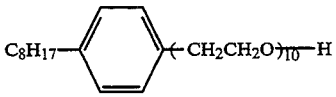 | 2.0 ml |
| Hexamethylenetetramine (Example Compound (1)) | 0.5 g |
| Potassium sulfite (50% solution) | 2.0 ml |
| Formaldehyde (35% solution) | $1.2 \times 10^{-3}$ mol |

Water was added to make a total quantity of 1 liter and potassium hydroxide and 50% sulfuric acid were added to adjust the solution to pH 7.0.

The processed samples were stored in a constant temperature constant humidity chamber maintained at a temperature of 65° C. and a relative humidity of 60% for 14 days, and then subjected to densitometry to measure the representative characteristics, i.e., the blue density (transmission) in the unexposed portion and the maximum density portion using an optical densitometer (PDA-65, produced by Konica Corporation). The differences in blue density (transmission) from untreated samples were determined.

The results are shown in Table 1.

In the table, EDTA Fe means ferric ammonium ethylenediaminetetraacetate; NTA Fe means ferric ammonium nitrilotriacetate; and DTPA Fe means ferric ammonium diethylenetriaminepentacetic acid (A-1)Fe, (A-4)Fe etc. respectively mean the ferric ammonium salts of (A-1), (A-4) etc.

TABLE 1

| Experiment number | Ferric complex salt of organic acid | Unexposed portion blue density difference (transmission) | Maximum density portion blue density difference |
|---|---|---|---|
| 1-1 (inventive) | (A-1).Fe | 0.02 | *0.03 |
| 1-2 | (A-4).Fe | 0.03 | *0.04 |

TABLE 1-continued

| Experiment number | Ferric complex salt of organic acid | Unexposed portion blue density difference (transmission) | Maximum density portion blue density difference |
|---|---|---|---|
| (inventive) 1-3 | (A-10).Fe | 0.04 | *0.05 |
| (inventive) 1-4 | (A-9).Fe | 0.03 | *0.04 |
| (inventive) 1-5 | (B-1).Fe | 0.02 | *0.04 |
| (inventive) 1-6 | DTPA.Fe | 0.07 | 0.04 |
| (inventive) 1-7 | EDTA.Fe | 0.12 | *0.07 |
| (comparative) 1-8 (comparative) | NTA.Fe | 0.10 | *0.07 |

As is evident from Table 1, the occurrence of yellow stain and the density increase in the maximum density portion during storage of the processed photosensitive material was suppressed by the use of a bleacher containing a ferric complex salt of organic acid of the present invention.

EXAMPLE 2

Running processing -was conducted using the processing solutions and processing procedures used in Example 1. Running was continued until the stabilizer replenisher were supplied in an amount three times the capacity of the stabilizing tank. The amount of precipitation produced in the stabilizing bath after running processing was confirmed. The same conditions as in Example I were used except that the formaldehyde concentration in the stabilizing bath was changed as shown in Table 2.

The results are shown in Table 2.

TABLE 2

| Experiment number | Ferric complex salt of organic acid | HCHO concentration (mol/l) | Unexposed portion blue density difference (transmission) | Maximum density portion blue density difference | Precipitation in stabilizing bath |
|---|---|---|---|---|---|
| 2-1 (comparative) | (A-1).Fe | $5.0 \times 10^{-2}$ | 0.03 | 0.02 | x |
| 2-2 (comparative) | (A-1).Fe | $3.0 \times 10^{-2}$ | 0.02 | 0.02 | x |
| 2-3 (inventive) | (A-1).Fe | $1.0 \times 10^{-2}$ | 0.03 | 0.02 | Δ |
| 2-4 (inventive) | (A-1).Fe | $5.0 \times 10^{-3}$ | 0.02 | 0.03 | Δ |
| 2-5 (inventive) | (A-1).Fe | $2.0 \times 10^{-3}$ | 0.03 | 0.03 | □ |
| 2-6 (inventive) | (A-1).Fe | $1.0 \times 10^{-3}$ | 0.03 | 0.03 | ○ |
| 2-7 (inventive) | (A-1).Fe | 0 | 0.04 | 0.03 | ⊙ |
| 2-8 (comparative) | (B-1).Fe | $5.0 \times 10^{-2}$ | 0.02 | 0.03 | x |
| 2-9 (comparative) | (B-1).Fe | $3.0 \times 10^{-2}$ | 0.02 | 0.03 | x |
| 2-10 (inventive) | (B-1).Fe | $1.0 \times 10^{-2}$ | 0.02 | 0.03 | Δ |
| 2-11 (inventive) | (B-1).Fe | $5.0 \times 10^{-3}$ | 0.03 | 0.04 | Δ |
| 2-12 (inventive) | (B-1).Fe | $2.0 \times 10^{-3}$ | 0.03 | 0.04 | □ |
| 2-13 (inventive) | (B-1).Fe | $1.0 \times 10^{-3}$ | 0.02 | 0.04 | ○ |
| 2-14 (inventive) | (B-1).Fe | 0 | 0.03 | 0.04 | ⊙ |
| 2-15 (comparative) | EDTA.Fe | $5.0 \times 10^{-2}$ | 0.09 | 0.04 | x |
| 2-16 (comparative) | EDTA.Fe | $3.0 \times 10^{-2}$ | 0.10 | 0.04 | x |
| 2-17 (comparative) | EDTA.Fe | $1.0 \times 10^{-2}$ | 0.10 | 0.05 | Δ |
| 2-18 (comparative) | EDTA.Fe | $5.0 \times 10^{-3}$ | 0.11 | 0.05 | Δ |
| 2-19 (comparative) | EDTA.Fe | $2.0 \times 10^{-3}$ | 0.12 | 0.06 | □ |
| 2-20 (comparative) | EDTA.Fe | $1.0 \times 10^{-3}$ | 0.12 | 0.07 | ○ |
| 2-21 (comparative) | EDTA.Fe | 0 | 0.14 | 0.08 | ⊙ |

⊙ no precipitation
Δ little precipitation
○ slight turbidity
x much precipitation
□ very little precipitation As is evident from Table 2, when a ferric complex salt of organic acid for the present invention was used for processing, the occurrence of yellow stain in the unexposed portion and the density increase in the maximum density portion were suppressed even at low aldehyde concentrations in the stabilizing bath, and precipitation decreased as the formaldehyde concentration decreased.

EXAMPLE 3

The processing solutions used in Example 2 for Experiment Nos. 2-3 to 2-7, 2-10 to 2-14 and 2-17 to 2-21 were stored at 35° C. for a week to confirm the amount of precipitation.

The results are shown in Table 3.

TABLE 3

| Experiment number | Processing solution | Precipitation in stabilizing bath |
|---|---|---|
| 3-1 | 2-3 | Δ |
| 3-2 | 2-4 | Δ |
| 3-3 | 2-5 | Δ |
| 3-4 | 2-6 | □ |
| 3-5 | 2-7 | ○ |
| 3-6 | 2-10 | Δ |
| 3-7 | 2-11 | Δ |
| 3-8 | 2-12 | Δ |
| 3-9 | 2-13 | □ |
| 3-10 | 2-14 | ○ |
| 3-11 | 2-17 | x |
| 3-12 | 2-18 | x |
| 3-13 | 2-19 | x |
| 3-14 | 2-20 | x |
| 3-15 | 2-21 | Δ |

As is evident from the results, the processing solutions of the present invention exhibited improved liquid preservability, while in the case of the comparative procession solution containing EDTA Fe, though the amount of precipitation was small before storage, the liquid preservability was rapidly impaired after storage.

EXAMPLE 4

Evaluation was conducted under the same conditions as in Example 2, except that the stabilizing solution which is used instead of water washing and the stabilizing did not contain formaldehyde and contained compounds shown in Table 4 in place of hexamethylenetetramine (Example compound 1), and that the processing solution for Experiment No. 1-1 was used.

The results are shown in Table 4.

TABLE 4

| Experiment number | Additive (mol/l or g) | Unexposed portion blue density difference (transmission) | Maximum density portion blue density difference | Precipitation in stabilizing bath |
|---|---|---|---|---|
| 4-1 | — | 0.09 | 0.09 | ◎ |
| 4-2 | I-2 $1.0 \times 10^{-2}$ | 0.04 | 0.04 | ◎ |
| 4-3 | I-3 $1.0 \times 10^{-2}$ | 0.04 | 0.04 | ◎ |
| 4-4 | I-14 $1.0 \times 10^{-2}$ | 0.05 | 0.05 | ◎ |
| 4-5 | I-15 $1.0 \times 10^{-2}$ | 0.06 | 0.05 | ◎ |
| 4-6 | I-16 $1.0 \times 10^{-2}$ | 0.06 | 0.06 | ◎ |
| 4-7 | (2) 0.5 g | 0.04 | 0.03 | ◎ |
| 4-8 | (9) 0.5 g | 0.04 | 0.03 | ◎ |
| 4-9 | (13) 0.5 g | 0.04 | 0.04 | ◎ |
| 4-10 | (24) 0.5 g | 0.05 | 0.05 | ◎ |
| 4-11 | I-2/2 = $1.0 \times 10^{-2}$/0.5 g | 0.03 | 0.03 | ◎ |

As is evident from the results, when an aldehyde derivatives or hexamethylenetetramine of the present invention was used, blue density increase in the unexposed portion and the maximum density portion was suppressed at a low level and precipitation in the stabilizing bath was prevented even though no formaline was employed.

EXAMPLE 5

Experiments were made using the same conditions as in Example 2 except that the type and concentration of the ferric complex salt of organic acid in the bleacher were settled as shown in Table 3 and the formaldehyde concentration in the stabilizer was $2.0 \times 10^{-3}$ mol/l.

The results are shown in Table 5.

TABLE 5

| Experiment number | Ferric complex salt of organic acid | Ferric complex salt of organic acid (mol/l) | Unexposed portion blue density difference (transmission) | Precipitation in stabilizing bath |
|---|---|---|---|---|
| 5-1 (inventive) | (A-1).Fe | $3.0 \times 10^{-2}$ | 0.06 | Δ |
| 5-3 (inventive) | (A-1).Fe | $1.0 \times 10^{-1}$ | 0.02 | ○ |
| 5-3 (inventive) | (A-1).Fe | $1.5 \times 10^{-1}$ | 0.02 | ◎ |
| 5-4 (inventive) | (A-1).Fe | $2.0 \times 10^{-1}$ | 0.02 | ◎ |
| 5-5 (inventive) | (A-1).Fe | 1.0 | 0.02 | ◎ |
| 5-6 (inventive) | (A-1).Fe | 2.0 | 0.03 | ◎ |
| 5-7 (inventive) | (A-1).Fe | 4.0 | 0.07 | ◎ |
| 5-8 (inventive) | (B-1).Fe | $3.0 \times 10^{-2}$ | 0.07 | □ |
| 5-9 (inventive) | (B-1).Fe | $1.0 \times 10^{-1}$ | 0.03 | ◎ |
| 5-10 (inventive) | (B-1).Fe | $1.5 \times 10^{-1}$ | 0.02 | ◎ |
| 5-11 (inventive) | (B-1).Fe | $2.0 \times 10^{-1}$ | 0.02 | ◎ |
| 5-13 (inventive) | (B-1).Fe | 1.0 | 0.02 | ◎ |
| 5-13 | (B-1).Fe | 2.0 | 0.03 | ◎ |

TABLE 5-continued

| Experiment number | Ferric complex salt of organic acid | Ferric complex salt of organic acid (mol/l) | Unexposed portion blue density difference (transmission) | Precipitation in stabilizing bath |
|---|---|---|---|---|
| (inventive) 5-14 | (B-1).Fe | 4.0 | 0.07 | ⊙ |
| (inventive) 5-15 | NTA.Fe | $5.0 \times 10^{-2}$ | 0.14 | x |
| (comparative) 5-16 | NTA.Fe | $1.0 \times 10^{-1}$ | 0.11 | x |
| (comparative) 5-17 | NTA.Fe | $1.5 \times 10^{-1}$ | 0.11 | x |
| (comparative) 5-18 | NTA.Fe | $2.0 \times 10^{-1}$ | 0.10 | x |
| (comparative) 5-19 | NTA.Fe | 1.0 | 0.09 | x |
| (comparative) 5-20 | NTA.Fe | 2.0 | 0.10 | Δ |
| (comparative) 521 | NTA.Fe | 4.0 | 0.11 | □ |
| (comparative) | | | | |

As shown in Table 5, the effect of the present invention was enhanced when the concentration of the ferric complex salt of organic acid for the present invention was not less than $1.0 \times 10^{-1}$ mol/l and not more than 2.0 mol/l. Almost similar results were obtained as to the maximum density portion blue density difference.

EXAMPLE 6

The same evaluation as in Example 2 was made under the similar experimental conditions as in Example 4, except that a rinsing tank was provided in front of the tank for the stabilizing bath for nonwater washing treatment used for Experiment Nos. 4-4 and 4-11. The results demonstrated that, unlike the processing method in which a photosensitive material is treated with the stabilizing solution which is used instead of water washing and the stabilizing immediately after fixing, the unexposed portion blue density difference was unfavorably large (0.07). It was confirmed that, in emboding the present invention, it is preferable to treat a photosensitive material after fixation directly in the stabilizing solution which is used instead of water washing and the stabilizing, without using a rinsing tank.

EXAMPLE 7

Photosensitive material samples were prepared in the same manner as in Example I except that the magenta coupler (M1-4) and the cyan coupler (CU-40) in the low sensitivity red-sensitive emulsion layer were changed as shown in the following Table 6. These samples were processed in the same manner as with Experiment No. 1-1 in Example 1 and stored at a temperature of 65° C. and a relative humidity of 60% for 14 days. Then, the magenta and cyan transmission densities in the unexposed portion were determined using an optical densitometer PDA-65 (produced by Konica Corporation) in the same manner as in Example 1. The results are shown in Table 6.

TABLE 6

| Experiment number | Magenta coupler | Unexposed portion magenta density difference (transmission) | Cyan coupler | Unexposed portion cyan density difference (transmission) |
|---|---|---|---|---|
| 6-1 | $M_1$-1 | 0.06 | CU-2 | 0.05 |
| 6-2 | $M_1$-2 | 0.05 | CU-2 | 0.05 |
| 6-3 | $M_1$-9 | 0.05 | CU-2 | 0.05 |
| 6-4 | $M_1$-51 | 0.06 | CU-2 | 0.05 |
| 6-5 | $M_2$-34 | 0.06 | CU-2 | 0.05 |

TABLE 6-continued

| Experiment number | Magenta coupler | Unexposed portion magenta density difference (transmission) | Cyan coupler | Unexposed portion cyan density difference (transmission) |
|---|---|---|---|---|
| 6-6 | F | 0.08 | CU-2 | 0.05 |
| 6-7 | G | 0.09 | CU-2 | 0.05 |
| 6-8 | $M_1$-2 | 0.05 | CU-1 | 0.06 |
| 6-9 | $M_1$-2 | 0.05 | CU-2 | 0.05 |
| 6-10 | $M_1$-2 | 0.05 | CU-3 | 0.07 |
| 6-11 | $M_1$-2 | 0.05 | CU-22 | 0.05 |
| 6-12 | $M_1$-2 | 0.05 | CU-20 | 0.06 |
| 6-13 | $M_1$-2 | 0.05 | i | 0.09 |
| 6-14 | $M_1$-2 | 0.05 | j | 0.10 |

Magenta Coupler F

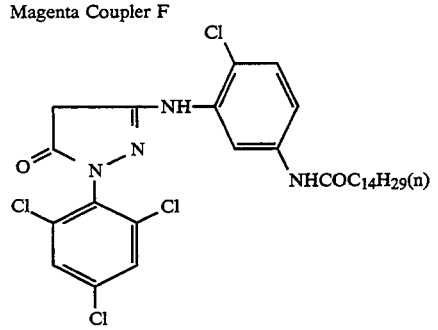

Magenta Coupler G

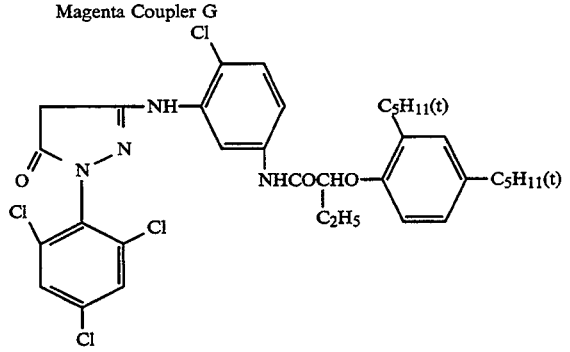

Cyan Coupler i

-continued

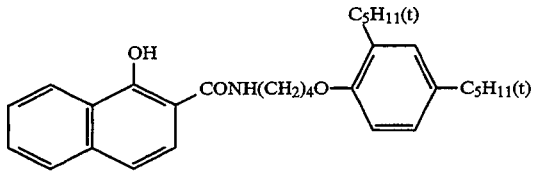

Cyan Coupler j

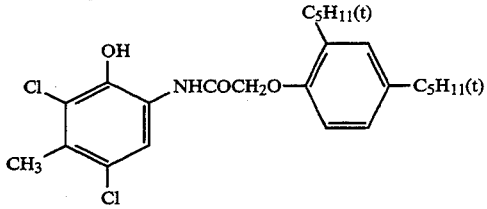

As is evident from the results shown in Table 6, even magenta and cyan stains in the unexposed portion were suppressed in the film samples containing the above-mentioned magenta and cyan couplers which are preferably used for the present invention.

It is also evident that yellow stains were also suppressed significantly in the film samples containing the magenta couples which are preferably employed in the present invention. The blue density difference in the unexposed portion was 0.11 to 0.12 when Magenta couplers F and G were used, but it was as small as 0.02 to 0.03 with the use of the magenta couplers preferably employed in the present invention.

EXAMPLE 8

The same evaluation as in Example 1 was made under the similar experimental conditions as for Experiment No. 1-1, expect that the amount of ammonium thiocyanate in the fixer and the fixer-replenisher was varied as shown in Table 6.

The results are shown in Table 6.

TABLE 6

| Experiment number | Thiocyanate concentration in fixer and replenisher (mol/l) | Unexposed portion blue density difference (transmission) |
|---|---|---|
| 6-1 | — | 0.06 |
| 6-2 | 0.1 | 0.03 |
| 6-3 | 0.2 | 0.02 |
| 6-4 | 1.0 | 0.02 |
| 6-5 | 2.0 | 0.02 |

As is evident from the results, the formation of yellow stains was suppressed due to the presence of ammonium thiocyanate in a fixer.

The liquid in the first chamber of the tank for the stabilizing solution which is used instead of water washing and tile stabilizing used in Experiment Nos. 6-1 to 6-5 was stored at 35° C., and it was found that in the liquid containing a thiocyanate, especially at a concentration of not less than 0.2 mol/l, the occurrence of precipitation was effectively prevented.

In Table 6, the blue density difference in the maximum density portion was reduced by about 0.02 when sample films were treated in the processing liquid containing a thiocyanate.

EXAMPLE 9

On a polyethylene-coated paper support were formed the following layers in this order from the support to prepare a photosensitive material.

The polyethylene-coated paper used was prepared by forming on the top face of wood free paper with a weight of 170g/m$^2$ a 0.035 mm thick coating layer comprising 7.0% by weight of anatase type titanium oxide and a mixture of 200 parts by weight of polyethylene with an average molecular weight of 100000 and a density of 0.95 and 20 parts by weight of polyethylene with an average molecular weight of 2000 and a density of 0.80 by the extrusion coating method and forming a 0.040 mm thick coating layer comprising polyethylene alone on the back face.

After pretreatment of the surface of the polyethylene coating layer of this support by corona discharge, the following layers were applied in this order.

Layer 1:

A blue-sensitive silver halide emulsion layer comprising a silver chlorobromide emulsion containing 0.5 mol% AgBr, wherein said emulsion contains 350 g of gelatin per mol silver halide, is sensitized with $2.4\times10^{-4}$ mol of Sensitizing Dye (I) of the following structure per mol silver halide (isopropyl alcohol is used as solvent) and contains 200 mg/m$^2$ 2,5-di-t-butylhydroquinone in solution and dispersion in dibutyl phthalate and $2\times10^{-1}$ mol of the following Yellow Coupler (Y) per mol silver halide, and is applied so that the amount of silver becomes 300 mg/m$^2$.

Layer 2

A gelatin layer containing 300 mg/m$^2$di-t-octylhydroquinone in solution and dispersion in dibutyl phthalate, a 210 mg/m$^2$ mixture (1:1:1:1) of 2-(2'-hydroxy-3', 5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3', 5'-di-t-butylphenyl)-5-chlorobenzotriazole as an ultraviolet absorbent, applied so that the gelatin amount becomes 2000 mg/m$^2$.

Layer 3

A green-sensitive silver halide emulsion layer comprising a silver chlorobromide emulsion containing 0.5 mol% AgBr, wherein said emulsion contains 450 g of gelatin per mol silver halide, is sensitized with $2.5\times10^{-4}$ mol of Sensitizing Dye (II) of the following structure per mol silver halide and contains $1.5\times10^{-1}$ mol of the preceding Magenta Coupler (M1-51) per mol silver halide in solution and dispersion in a solvent comprising a 2:1 mixture of dibutyl phthalate and tricresyl phosphate, applied so that the amount of silver becomes 200 mg/m$^2$.

Note that 2,2,4-timethyl-6-1-lauryloxy-7-t-octylchroman, as antioxidant, was added at 0.3 mol per mol coupler.

Layer 4

A gelatin layer containing 25 mg/m$^2$ di-toctylhydroquinone in solution and dispersion in dioctyl phthalate, a 500 mg/m$^2$ mixture (2:1.5:1.5:2) of 2-(2'-hydroxy-3', 5=-di-t-butylphenyl)benzotriazole, 2-(2'-hydroxy-5'-t-butylphenyl)benzotriazole, 2-(2'-hydroxy-3'-t-butyl-5'-methylphenyl)-5'-chlorobenzotriazole and 2-(2'-hydroxy-3', 5'-di-t-butylphenyl)-5-chlorobenzotriazole as an ultraviolet absorbent, applied so that the gelatin amount becomes 2000 mg/m$^2$.

Layer 5

A red-sensitive silver halide emulsion layer comprising a silver chlorobromide emulsion containing 0.5 mol% AgBr, wherein said emulsion contains 500 g of gelatin per mol silver halide, is sensitized with $2.5\times10^{-4}$ mol of Sensitizing Dye (III) of the following structure per mol silver halide and contains $4.0\times10^{-1}$ mol of the following Cyan Coupler (C) per mol silver halide in solution and dispersion in dibutyl phthalate that contains 2,5-di-t-butylhydroquinone (160 mm/g$^2$), applied so that the amount of silver becomes 250 mg/m$^2$.

Layer 6

A gelatin layer applied so that the gelatin amount becomes 900 mg/m$^2$.

The silver halide emulsions used in the photosensitive emulsion layers (Layers 1, 3 and 5) were prepared by the method described in Japanese Patent Examined Publication No. 7772/1971, chemically sensitized with sodium thiosulfate pentahydrate and supplemented with 4-hydroxy-6-methyl-1,3,3a,7-tetrazaindene (2.5g per mol silver halide) as stabilizer, bis(vinylsulfonylmethyl) ether as hardener (12 mg per g gelatin) and saponin as coating aid.

Sensitizing Dye (I)

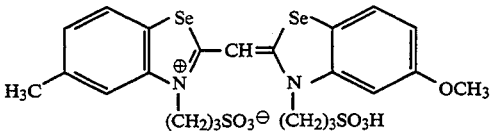

Sensitizing Dye (II)

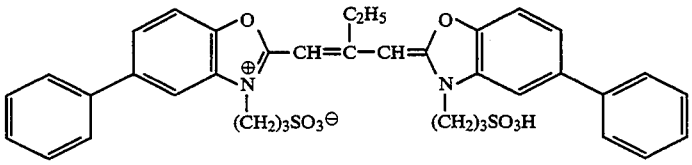

Sensitizing Dye (III)

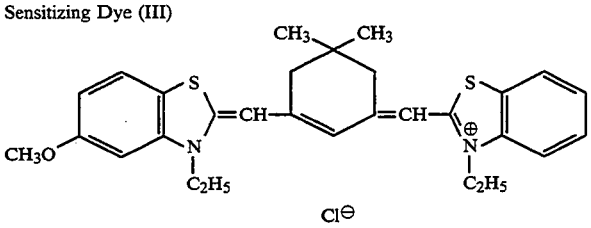

Yellow Coupler (Y)

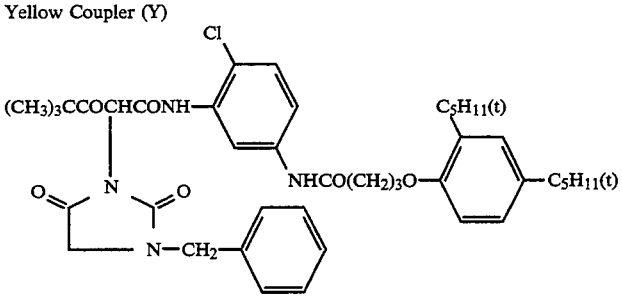

Cyan Coupler (C)

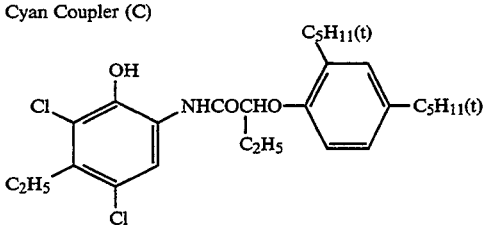

The color paper prepared by the preceding method was subjected to exposure and then processed using the following processing procedures and processing solutions.

| Processing procedure/Processing temperature/Processing time | | |
|---|---|---|
| (1) Color development | 35° C. | 45 sec. |
| (2) Bleach fixation | 37° C. | 35 sec. |
| (3) Stabilization (two tanks) | 30° C. | 90 sec. |
| (4) Drying | 60–80° C. | 1 min. 30 sec. |

The processing solutions used had the following compositions:

| [Color developer] | |
|---|---|
| Potassium sulfite (50% solution) | 1.0 ml |
| Potassium bromide | 0.02 g |

-continued

| [Color developer] | |
|---|---|
| Potassium chloride | 3.0 g |
| Potassium carbonate | 30.0 g |
| Diethylhydroxylamine (85%) | 5.0 g |
| 3-methyl-4-amino-N-ethyl-N-(β-methanesulfonamidoethyl)aniline sulfate | 5.7 g |
| Triethanolamine | 11.0 g |

Water was added to make a total quantity of 1 liter, and potassium hydroxide or 50% sulfuric acid was added to adjust the solution to pH 10.05.

| [Color developer replenisher] | |
|---|---|
| Potassium chloride | 3.0 g |
| Potassium sulfite (50% solution) | 2.0 ml |
| 3-methyl-4-amino-N-ethyl-N-(β-methanesulfonamidoethyl)aniline sulfate | 8.5 g |
| Diethylhydroxyl amine | 7.5 g |
| Triethanolamine | 10.0 g |
| Potassium carbonate | 30.0 g |

Water was added to make a total quantity of 1 liter, and potassium hydroxide or 50% sulfuric acid was added to adjust the solution to pit 10.40.

| [Bleach-fixer] | |
|---|---|
| Ferric complex salt of organic acid (described in Table 5) | 0.2 mol |
| Ethylenediaminetetraacetic acid | 3.0 g |
| Sodium thiosulfate (70% solution) | 100.0 ml |
| Ammonium sulfite (40% solution) | 27.5 ml |

Water was added to make a total quantity of 1 liter, and aqueous ammonia or glacial acetic acid was added to adjust the solution to pH 5.7.

| [Bleach-fixer replenisher] | |
|---|---|
| Ferric complex salt of organic acid (described in Table 5) | 0.25 mol |
| Ethylenediaminetetraacetic acid | 3.0 g |
| Sodium thiosulfate (70% solution) | 120.0 ml |
| Ammonium sulfite (40% solution) | 40.0 ml |

Water was added to make a total quantity of 1 liter, and aqueous ammonia or glacial acetic acid was added to adjust the solution to pH 5.40.

| [Tank solution and replenisher for nonwater washing treatment] | |
|---|---|
| 5-chloro-2-methyl-4-isothiazolin-3-one | 0.02 g |
| 2-methyl-4-isothiazolin-3-one | 0.02 g |
| Ethylene glycol | 1.0 g |
| 2-octyl-4-isothiazolin-3-one | 0.01 g |
| 1-hydroxyethylidine-1,1-diphosphonic acid (60% solution) | 3.0 g |
| Acetoaldehyde | $3.0 \times 10^{-3}$ mol |
| $BiCl_3$ (45% aqueous solution) | 0.70 g |
| $MgSO_4.7H_2O$ | 0.2 g |
| Aqueous ammonia (25% aqueous solution of ammonium hydroxide) | 2.4 g |
| Trisodium nitrilotriacetate | 1.5 g |

Water was added to make a total quantity of 1 liter, and aqueous ammonia and glacial acetic acid were added to adjust the solution to pH 7.0.

The preceding silver halide color photographic photosensitive material was subjected to exposure through an optical wedge and processed using the preceding processing solutions and processing procedures and then stored in a constant temperature constant humidity chamber maintained at a temperature of 70° C. and a relative humidity of 65% for 12 days. Then, the blue density (reflex) in the unexposured portion was determined using an optical densitometer PDA-65, (produced by Konica Corporation).

The results are shown in the following Table 7.

TABLE 7

| Experiment number | Ferric complex salt of organic acid | Unexposed portion blue density difference (reflex) | Maximum density portion blue density difference (reflex) |
|---|---|---|---|
| 7-1 (inventive) | (A-1).Fe | 0.05 | −0.02 |
| 7-2 (inventive) | (A-4).Fe | 0.06 | −0.03 |
| 7-3 (inventive) | (A-10).Fe | 0.07 | −0.04 |
| 7-4 (inventive) | (A-9).Fe | 0.06 | −0.03 |
| 7-5 (inventive) | (B-1).Fe | 0.05 | −0.03 |
| 7-6 (comparative) | EDTA.Fe | 0.12 | −0.08 |
| 7-7 (comparative) | CyDTA.Fe | 0.13 | −0.07 |

Note:
CyDTA Fe represents ferric ammonium 1,2-cyclohexanediaminetetraacetate.

As is evident from Table 7, even in color paper, an effect similar to that obtained in Example 1 was obtained when a ferric complex salt of organic acid for the present invention was used for processing.

EXAMPLE 10

Experiments were conducted in the same manner as in Example 1, except that the bleacher and fixer were replaced by a bleach-fixer with the following composition to conduct bleach-fixing, and that use was made of the same stabilizing solution as used in Example 9 except for the use of 0.5 g of hexamethylenetetramine (Example compound) instead of acetoaldehyde.

| Process | Processing time | Processing temperature | Amount of replenishment |
|---|---|---|---|
| Color development | 3 min. 15 sec. | 38° C. | 775 ml |
| Bleach-fixation | 3 min. 15 sec. | 38° C. | 670 ml |
| Stabilization* | 90 sec. | 38° C. | 670 ml |
| Drying | 1 min. | 40~70° C. | — |

FIGURES for the replenishing amount were values per square meter photosensitive mateterial
*3 - Chamber counter current system The composition of the bleach-fixer and replenisher are as follows:

| | |
|---|---|
| Ferric complex salt of organic acid (shown in Table 7) | 0.4 mol |
| Ammonium ethylenediaminetetraacetate | 1.5 g |
| Ammonium thiosulfate | 100 g |
| Ammonium thiocyanate | 150 g |
| Sodium sulfurous anhydride | 30 g |
| Ammonium bromide | 50 g |
| 5-amino-1,3,4-thiazole-2-thiol | 0.5 g |

Water was added to make a total quantity of 1 liter and ammonia or glacial acetic acid was added to adjust the solution to pH 7.0.

The results are shown in Table 8.

| Process | Processing time | Processing temperature | Amount of replenishment |
|---|---|---|---|
| Color development | 3 min. 15 sec. | 38° C. | 775 ml |
| Bleach-fixation | 3 min. 15 sec. | 38° C. | 670 ml |
| Stabilization* | 90 sec. | 38° C. | 670 ml |
| Drying | 1 min. | 40~70° C. | — |

FIGURES for the replenishing amount were values per square meter photosensitive mateterial
*3 - Chamber counter current system As seen in Table 8, the present invention significantly suppressed yellow stain in the unexposed portion as in Example 1 even in bleach-fixing process.

The preservability of the stabilizing solution was also checked by allowing the solution to stand at room temperature. The results showed the precipitation in the solution containing DTPA Fe was the smallest.

The similar results as in Example 9 were obtained as to the maximum density portion blue density difference.

Effect of the invention

Since the present invention permits dye image stabilization without adding an aldehyde compound to the stabilizer by the addition of a ferric complex salt of organic acid represented by the preceding Formula [A] or [B] or diethylenetriaminepentaacetic acid to the processing solution capable of bleaching and by the addition of an aldehyde derivative represented by Formula [I] or hexamethylene tetramines to the stabilizer, it is possible to reduce formaldehyde concentration in the stabilizer or add no formaldehyde compound without degrading dye image stability.

Further, the present invention also reduces precipitation in the stabilizer in cases where processing with a processing solution capable of fixing is followed by nonwater treatment with a stabilizing bath.

What is claimed is:

1. A process for processing exposed silver halide photographic material comprising the steps of:

(a) a color developing step;

(b) a bleaching step with a solution capable of bleaching;

(c) a fixing step with a solution capable of fixing; and (d) a stabilizing step without a water washing step intermediate between said fixing and stabilizing steps;

wherein the solution capable of bleaching comprises at least one ferric complex salt of organic acid selected from the group consisting of compounds represented by formula A, B and diethylenetriaminepentaacetic acid;

Formula A

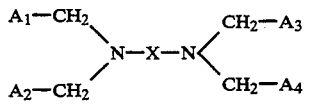

wherein $A_1$, $A_2$, $A_3$ and $A_4$ independently represent $—CH_2OH$, —COOM or $—PO_3M_1M_2$, in which M, $M_1$ and $M_2$ independently represent hydrogen, sodium, potassium or an ammonium group, X represents an alkylene group with a carbon number of 3 to 6, Formula B

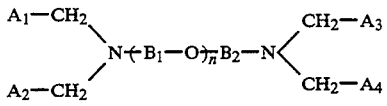

wherein $A_1$, $A_2$, $A_3$, and $A_4$ independently represent $—CH_2OH$, —COOM or $—PO_3M_1M_2$, in which M, $M_1$ and $M_2$ independently represent hydrogen, sodium, potassium or an ammonium group; n represents an integer of 1 to 8; $B_1$ and $B_2$ independently represent an alkylene group with a carbon number of 2 to 5;

the solution capable of fixing comprises thiocyanate and thiosulfate; and a stabilizing solution comprising at least one compound selected from the group consisting of compounds represented by the formula I and hexamethylenetetramine or its derivatives;

Formula I $R_1$—CHO wherein, $R_1$ represents an alkyl group with a carbon number of 1 to 5 or formyl group; and an amount of formaldehyde in the stabilizing solution being not more than $1.0\times10^{-2}$mol per liter, and wherein the silver halide photographic material comprises a magenta coupler selected from the group consisting of compounds represented by formulae M-1 and X-1

Formula M-1

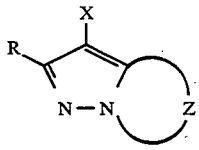

wherein Z represents a group of nonmetallic atoms necessary for formation of a nitrogen-containing heterocyclic ring and X represents a hydrogen atom or a substituent capable of splitting off by reaction with an oxidation product of a color developing agent, R represents hydrogen atom or a substituent, Formula X-I

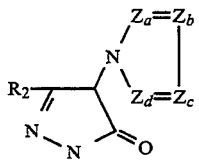

wherein R1 represents an aromatic group, an aliphatic group or a heterocyclic group; $R_2$ represents a substituent; Za, Zb, Zc, and Zd independently represents a methine group, a substituted methine group or —N=.

2. The process of claim 1 wherein the silver halide photographic material comprising a light sensitive material for photographing.

3. The process of claim 1, wherein a stabilizing solution contains formaldehyde in an amount of not more than $5.0\times10^{-3}$ mol per liter.

4. The process of claim 1 wherein the stabilizing step is the final step followed by drying process.

5. The process of claim 1, the solution capable of bleaching having content of the ferric complex salt of organic acid not less than 0.2 mol per liter of the solution.

6. The process of claim 1 wherein the volume of the replenishment of the stabilizing solution is 2–30 times of the solution brought by the silver halide photographic material into the stabilizing step from the preceding steps.

7. The process of claim 1 wherein the solution capable of bleaching has a pH in the range of not less than 3.0 and not more than 5.0.

8. The process of claim 1, wherein the photographic material further comprises a cyan coupler selected from the group consisting of a compound represented by Formulae C-1 and C-U, Formula C-1

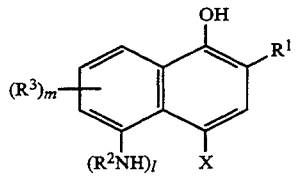

wherein $R^1$ represents —$CONR^4R^5$, —$NHCOR^4$, —$NHCOR^6$, —$NHSO_2R^6$, —$NHCONR^4R^5$, or —$NHSO_2NR^4R^5$; $R^2$ and $R^3$ independently represent a hydrogen atom or a substituent; X represents a group capable of splitting off by reaction with an oxidation product of an aromatic primary amine-based developing agent; l represents 0 or 1; m represents an integer of 0 to 3; $R^4$ and $R^5$ independently represent a hydrogen atom, an aromatic group, an aliphatic group, or a heterocyclic group; $R^6$ represents an aromatic group, an aliphatic group or a heterocyclic group; when m is 2 or 3, the $R^3$ units may be identical or not, and may bind with each other to form a ring; and $R^4$ and $R^5$, $R^2$ and $R^3$, and $R^2$ and X may independently combine together to form a ring; and when l is 0, m represents 0 and $R^1$ represents —$CONHR^7$ and $R^7$ represents an aromatic group; and the groups represented by $R^2$, $R^3$, $R^4$, $R^5$, $R^6$ or $R^7$ include those having a substituent;

Formula CU

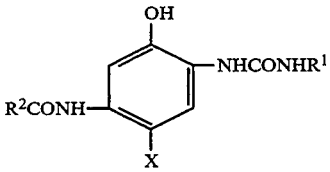

wherein X represents a hydrogen atom or group capable of splitting off by coupling with an oxidation product of an aromatic primary amine-based color developing agent, $R^1$ represents an aryl group or a heterocyclic group; $R^2$ represents an aryl group or an aliphatic group; the groups represented by $R^1$ or $R^2$ include those having a substituent; $R^1$ and $R^2$ may form a dimer or a higher polymer; $R^1$ and $R^2$ singly or in cooperation, possess a sufficient shape and size to provide the coupler represented by Formula Cu and a dye formed thereby with diffusion resistance.

* * * * *

UNITED STATES PATENT AND TRADEMARK OFFICE

CERTIFICATE OF CORRECTION

PATENT NO. 5,360,700

DATED November 1, 1994

INVENTOR(S) Tomonori Kawamura and Shigeharu Koboshi

It is certified that error appears in the above-indentified patent and that said Letters Patent is hereby corrected as shown below:

In claim 1, col. 126, between lines 46 and 53, delete Formula X-I and insert therefor -- 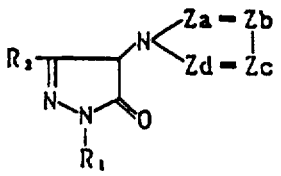 --;

Line 55, "R1" should read --$R_1$--.

Signed and Sealed this

Ninth Day of May, 1995

Bruce Lehman

*Attest:*

BRUCE LEHMAN

*Attesting Officer*

*Commissioner of Patents and Trademarks*